US006578944B1

(12) United States Patent
Kamei et al.

(10) Patent No.: US 6,578,944 B1
(45) Date of Patent: Jun. 17, 2003

(54) IMAGE-RECORDING DEVICE RECORDING IMAGE ON SHEET IN RECORDING MODE THAT IS APPROPRIATE TO TYPE OF SHEET

(75) Inventors: Toshihito Kamei, Tokyo (JP); Masanori Hirano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 266 days.

(21) Appl. No.: 09/656,948

(22) Filed: Sep. 7, 2000

(30) Foreign Application Priority Data

Sep. 8, 1999 (JP) ..... 11-253742
Mar. 16, 2000 (JP) ..... 2000-073338
Jul. 24, 2000 (JP) ..... 2000-221617

(51) Int. Cl.[7] ..... B41J 2/01
(52) U.S. Cl. ..... 347/16; 347/14; 347/15; 347/104; 347/106
(58) Field of Search ..... 347/16, 106, 104, 347/14, 15

(56) References Cited

U.S. PATENT DOCUMENTS 4,475,128 A * 10/1984 Koumura ..... 358/296
6,149,327 A * 11/2000 Ward et al. ..... 400/582
6,378,977 B1 * 4/2002 Gompertz ..... 347/19

FOREIGN PATENT DOCUMENTS

JP 0532024 2/1993
JP 06134982 5/1994

* cited by examiner

*Primary Examiner*—Craig Hallacher
(74) *Attorney, Agent, or Firm*—Cooper & Dunham, LLP.

(57) ABSTRACT

An image-recording device records a high-quality image on a surface of a sheet by altering recording parameters for a one-side recording mode and a two-sided recording mode, for instance, a path number that is a number of paths, which a recording head of the image-recording device takes to record an image on the surface of the sheet, a nozzle number that is a number of nozzles, which the recording head uses to record the image on the surface of the sheet, drive frequency that is a frequency of the recording head at which the recording head records the image on the surface of the sheet, a dot number that is a maximum number of dots, which the recording head records in an area unit of the surface of the sheet and dot density that is density of dots, which the recording head records in an area unit of the surface of the sheet.

48 Claims, 52 Drawing Sheets

FIG.9A
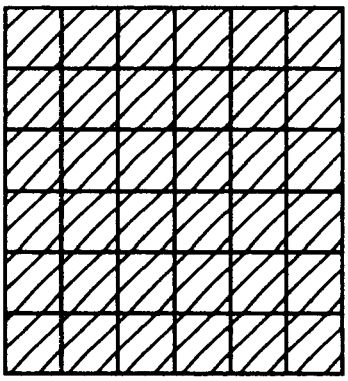
FIG.9B
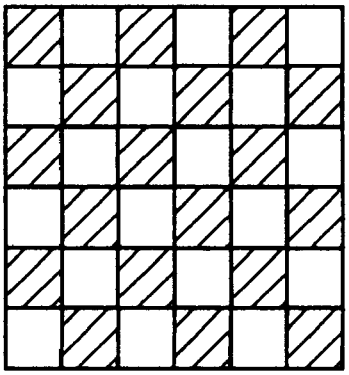
FIG.9C
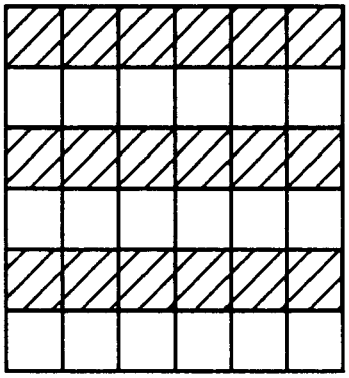
FIG.9D
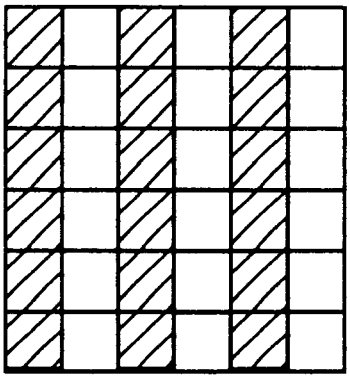
FIG.9E
| | | | | | |
|---|---|---|---|---|---|
| 1 | 2 | 1 | 2 | 1 | 2 |
| 3 | 4 | 3 | 4 | 3 | 4 |
| 1 | 2 | 1 | 2 | 1 | 2 |
| 3 | 4 | 3 | 4 | 3 | 4 |
| 1 | 2 | 1 | 2 | 1 | 2 |
| 3 | 4 | 3 | 4 | 3 | 4 |
FIG.9F
| | | | | | |
|---|---|---|---|---|---|
| 1 | 5 | 3 | 7 | 1 | 5 |
| 8 | 2 | 6 | 4 | 8 | 2 |
| 1 | 5 | 3 | 7 | 1 | 5 |
| 8 | 2 | 6 | 4 | 8 | 2 |
| 1 | 5 | 3 | 7 | 1 | 5 |
| 8 | 2 | 6 | 4 | 8 | 2 |

FIG.32

| DRIVE FREQUENCY (kHz) | PATH TIME (s) |
|---|---|
| 1 | 4.8 |
| 2 | 2.4 |
| 5 | 1.0 |
| 10 | 0.5 |
| 20 | 0.2 |
| 50 | 0.1 |

| LEVEL | DOT NUMBER (DOT) |
|---|---|
| 1 | 8.7M |
| 2 | 12M |
| 3 | 20M |
| 4 | 35M |
| 5 | 49M |
| 6 | 100M |
| 7 | 140M |
| 8 | 190M |

| LEVEL | DOT DENSITY (dpi) |
|---|---|
| 1 | 300 |
| 2 | 360 |
| 3 | 400 |
| 4 | 600 |
| 5 | 720 |
| 6 | 800 |
| 7 | 1200 |
| 8 | 1440 |

IMAGE-RECORDING DEVICE RECORDING IMAGE ON SHEET IN RECORDING MODE THAT IS APPROPRIATE TO TYPE OF SHEET

BACKGROUND OF THE INVENTION

1. Field of the Invention

The present invention relates to an image-recording device, and more particularly to an image recording-device that can record image on both sides of a sheet, and a printer driver that controls recording condition of the image-recording device.

2. Description of the Related Art

A recording device such as an inkjet recording device including a printer, a copier machine, a facsimile and a plotter records image on a sheet by discharging ink from its inkjet head onto the sheet so that the ink may permeate through the sheet from one side to the other. Consequently, the image on one side of the sheet seen from the other side may be blurred, and the sheet may be curled and cockled. It should be noted that a type of the sheet is not limited to paper, and includes any types of material whereto the ink adheres.

Especially when the inkjet recording device records images on both sides of the sheet, quality of the images decreases substantially if the image on one side seen from the other side is blurred by ink permeation, and conveyance ability of the sheet decreases by the inkjet recording device if the sheet is curled or cockled.

Accordingly, a conventional inkjet recording device as disclosed in Japanese Laid-Open Patent Application No. 06-134982 alters color density of an image to be recorded on a sheet (a record medium) depending on a recording-side mode that is either a two-sided recording mode or a one-side recording mode. Alternatively, the conventional inkjet recording device alters a waiting period that lies after recording one side and before recording the other side in the two-sided recording mode according to a type of the sheet so that ink on the sheet dries quickly. Additionally, a conventional inkjet recording device as disclosed in Japanese Laid-Open Patent Application No. 05-32024 decreases the color density of the image to be recorded on the sheet.

However, the quality of the images on both sides of the sheet decreases on the two-sided recording mode by altering the color density of the images depending on the two-sided recording mode or the one-side recording mode. Additionally, recording speed on the two-sided recording mode decreases by providing the waiting period, and does not prevent the above-described problems.

SUMMARY OF THE INVENTION

Accordingly, it is a general object of the present invention to provide an image-recording device that records a high-quality image on a sheet by minimizing blurriness of an image on one side of the sheet seen from the other side of the sheet, and curling and cockling of the sheet.

The above-described object of the present invention is achieved by an image-recording device, including a control unit setting a recording-side mode to one of a one-side recording mode and a two-sided recording mode, and setting a recording parameter related to a recording speed and quality of the image recorded on the sheet for each surface of the sheet, wherein the control unit sets a first numerical value to the recording parameter when the recording-side mode is set to the one-side recording mode, and sets a second numerical value to the recording parameter when the recording-side mode is set to the two-sided recording mode, and a recording head that records the image on the sheet in the recording-side mode set by the control unit.

The image-recording device records the high-quality image on the surface of the sheet by altering the first numerical value for the one-side recording mode and the second numerical value for the two-sided recording mode as the recording parameter, for instance, a path number that is a number of paths, which the recording head takes to record the image on the surface of the sheet, a nozzle number that is a number of nozzles, which the recording head uses to record the image on the surface of the sheet, drive frequency that is a frequency of the recording head at which the recording head records the image on the surface of the sheet, a dot number that is a maximum number of dots, which the recording head records in an area unit of the surface of the sheet and dot density that is density of dots, which the recording head records in an area unit of the surface of the sheet.

Additionally, the other object of the present invention is to provide a printer driver that controls an image-recording device to record a high-quality image on a sheet by minimizing blurriness of an image on one side of the sheet seen from the other, and curling and cockling of the sheet.

The other object of the present invention is achieved by a printer driver controlling an image-recording device that records an image on a surface or images on both surfaces of a sheet according to a recording-side mode by use of a recording head, wherein the image-recording device records the image on the surface when the recording-side mode is set to a one-side recording mode, and the images on both surfaces of the sheet when the recording-side mode is set to a two-sided recording mode, the printer driver setting a recording parameter related to a recording speed and quality of the image recorded on the surface of the sheet to a first numerical value for the one-side recording mode, and a second numerical value for the two-sided recording mode.

Other objects, features and advantages of the present invention will become more apparent from the following detailed description when read in conjunction with the accompanying drawings.

BRIEF DESCRIPTION OF THE DRAWINGS

FIGS. 9A–9F is a diagram showing patterns of a scanning path that a recording head of the image-recording device takes;

FIG. 32 is a table for describing relation between a drive frequency and a path time for the image-recording device to record the certain image;

DESCRIPTION OF THE PREFERRED EMBODIMENTS

A description will now be given of preferred embodiments of the present invention, with reference to the accompanying drawings.

Figure 1:
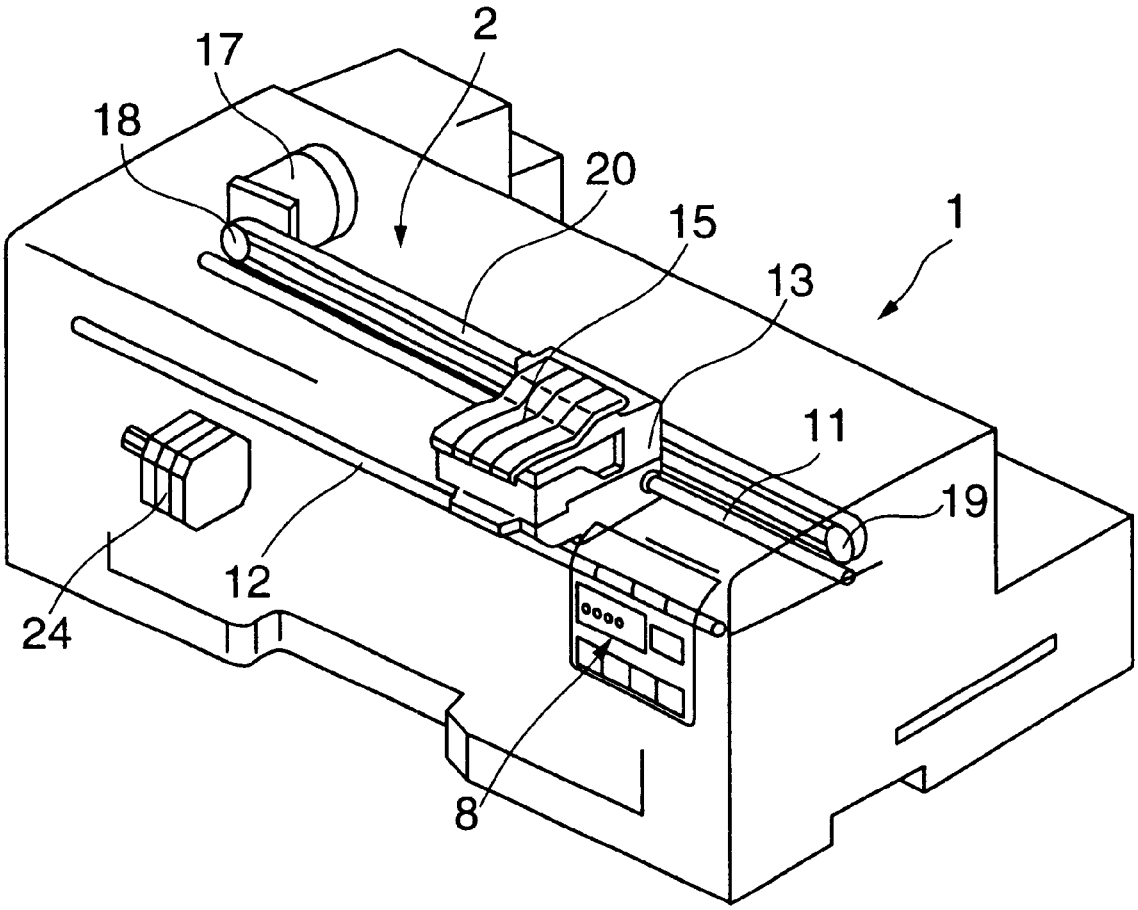
FIG. 1 is a perspective diagram of an image-recording device according to the present invention.

FIG. 1 is a perspective diagram showing an image-recording device according to the present invention. Additionally, FIG. 2 is a side view of a mechanism of the image-recording device according to the present invention.

An image-recording device 1 includes a recording-mechanism unit 2, a document cassette 4, a document-supplying tray 5, a document-ejecting tray 6 and a control panel 8.

Figure 2:
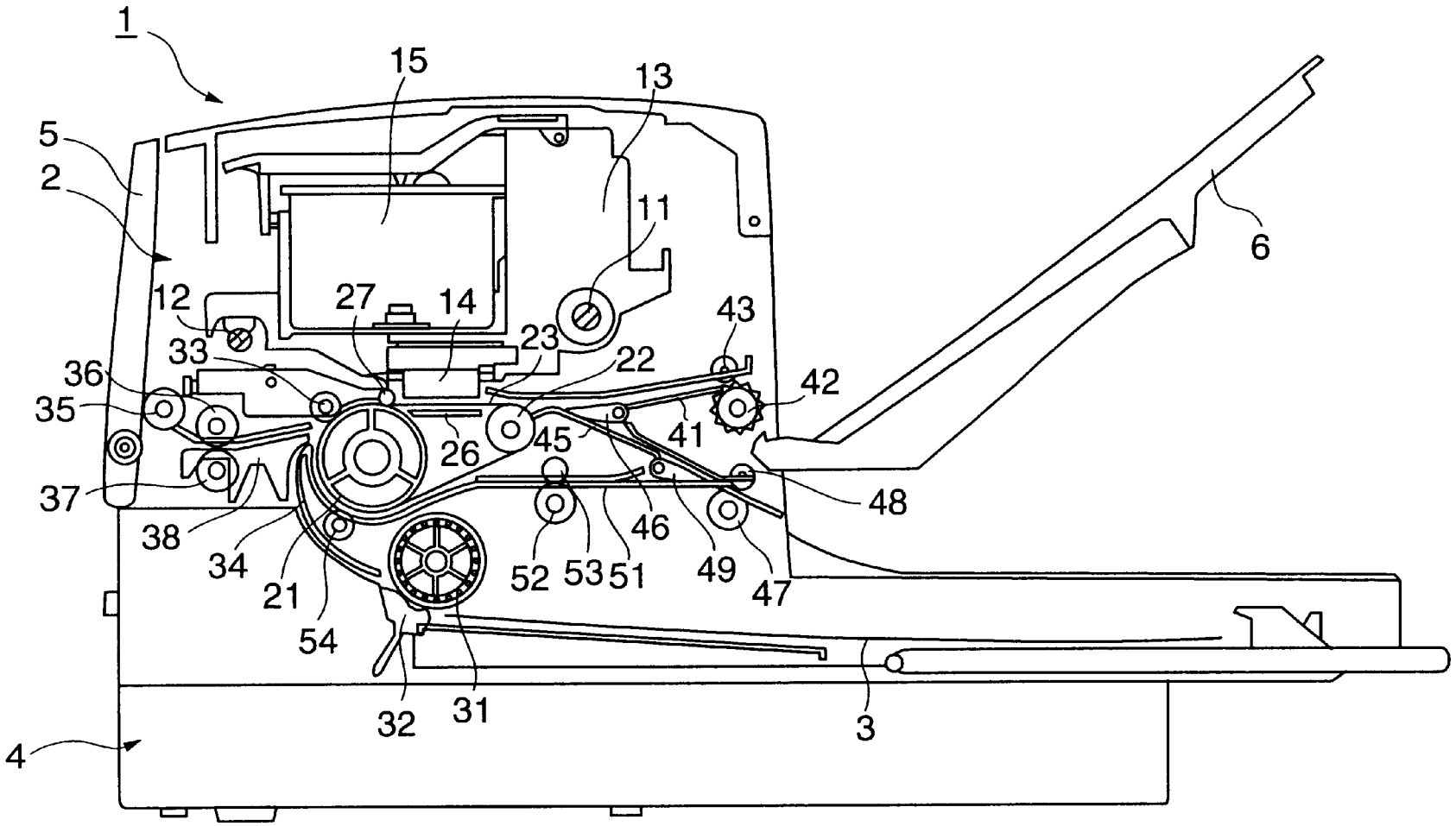
FIG. 2 is a side view of a mechanism of the image-recording device according to the present invention.

The document cassette 4 is a removable cassette that can slide to and from the left side in FIG. 2, and can loads a plurality of sheets 3. The document-supplying tray 5 supplies the sheet 3 to the recording-mechanism unit 2, and can be opened and closed. The document-ejecting tray 6 receives the sheet 3 from the recording-mechanism unit 2. The control panel 8 is provided on the front side of the device shown in FIG. 1.

The recording-mechanism unit 2 includes a main guide rod 11, a sub guide rod 12, a carriage 13, a recording head 14, an ink cartridge 15, a main scanner motor 17, a drive pulley 18, an idle pulley 19, a timing belt 20, a conveyance roller 21, a conveyance idle roller 22, a conveyance belt 23, a sub scanner motor 24, a record-supporting unit 26, a front roller 27, a paper-supplying roller 31, a friction pad 32, an intermediate roller 33, a guide unit 34, a pick-up roller 35, paper-feeding rollers 36 and 37, a guide unit 38, a guide unit 41, a paper-ejecting roller 42, a paper-ejecting idle roller 43, a guide unit 45, a first switching hook 46, a switchback roller 47, a switchback idle roller 48, a second switching hook 49, a guide unit 51, a relay roller 52, a relay idle roller 53, a conveyance idle roller 54, a switchback-roller motor 71, and solenoids 72 and 73.

The main guide rod 11 and the sub guide rod 12 are attached to the sidewalls (not shown in the figures) of the image-recording device 1, and hold the carriage 13 so that the carriage 13 can slide in its main scanning direction (a direction moving perpendicularly in FIG. 2). The recording head 14 is provided on the bottom of the carriage 13, and includes a nozzle to discharge ink onto the sheet 3. The nozzle discharges various types of colored ink such as yellow (Y), cyan (C), magenta (M) and black (Bk). The ink cartridge 15 is provided on the top of the carriage 13, and supplies various types of colored ink by exchanging the ink cartridge 15 to another ink cartridge.

Additionally, the recording head 14 may includes a plurality of the heads lining up in its main scanning direction wherein each head discharges an individual colored ink drop. Alternatively, the recording head 14 may include a single head that discharges various types of colored ink.

Additionally, the recording head 14 may be a recording head that discharges an ink drop by pressurizing ink in the ink cartridge 15 by use of a method, wherein the recording head increases volume of the ink in the ink cartridge 15 by displacing an vibrating plate by use of an electromechanical transducer such as a piezoelectric element. Alternatively, the recording head 14 may be a recording head that discharges an ink drop by pressurizing ink in the ink cartridge 15 by use of a method, wherein the recording head generates bubbles in the ink cartridge 15 by film boiling of a heating resistor placed therein. Alternatively, the recording head 14 may be a recording head that discharges an ink drop by use of a method, wherein the recording head displaces an vibrating plate that forms sidewall of the ink cartridge 15 by use of electrostatic force between the vibrating plate and an electrode that is placed against the vibrating plate.

The main scanner motor 17 makes the drive pulley 18 and the idle pulley 19 rotate. The timing belt 20 is placed between the drive pulley 18 and the idle pulley 19, and the carriage 13 is attached thereto so that the carriage 13 can slide in its main scanning direction by controlling the main scanner motor 17.

The conveyance belt 23 is attached between the conveyance roller 21 and the conveyance idle roller 22, and conveys the sheet 3 that adheres to the conveyance belt 23 by use of electrostatic force. The sub scanner motor 24 shown in FIG. 1 makes the conveyance roller 21 rotate in a sub scanning direction (a direction moving from the left to the right in FIG. 2) by transferring mechanical force thereto through gears not shown in the figures.

The conveyance roller 21 must secure close adherence of the sheet 3, and has a diameter of, for example, 30ø or higher that prevents a curvature separation of the sheet 3 therefrom. The conveyance belt 23 is preferably made of middle-resistance material which volume resistance is between $10^9$ Ucm and $10^{12}$ Ucm.

The record-supporting unit 26 is provided at a position facing the recording head 14, wherein the conveyance belt 23 is placed between them. The front roller 27 is situated to direct the sheet 3 to be transferred with a correct angle by pressing the sheet 3 on the conveyance belt 23 against the conveyance roller 21.

The paper-supplying roller 31 and the friction pad 32 separates a stack of the sheet 3 in the document cassette 4 one by one, and supplies the sheet 3 to the conveyance belt 23 by use of the guide unit 34 and the intermediate roller 33 that is placed next to the conveyance roller 23.

Alternatively, the sheet 3 is supplied from the document-supplying tray 5 to the conveyance belt 23 by picking up the sheet 3 by the pick-up roller 35 and supplying to the intermediate roller 33 with support of the guide unit 38, and the paper-feeding rollers 36 and 37.

After recording an image on the sheet 3 by use of the recording head 14, the sheet 3 is guided by the guide unit 41, and is ejected to the document-ejecting tray 6 by the paper-ejecting roller 42 and the paper-ejecting idle roller 43.

In a case that images are recorded on both sides of the sheet 3, the sheet 3 is again supplied to the conveyance roller 23 after an image is recorded on one side thereof. The guide unit 45 is provided to guide the sheet 3 with the image recorded on one side thereof to the right bottom direction in FIG. 2 after the sheet 3 passes the recording head 14. The first switching hook 46 that is placed between the guide units 41 and 45 controls a path of the sheet 3 by moving upward and downward. At the right end of the guide unit 45, the switchback roller 47 and the switchback idle roller 48 are provided to elect the sheet 3 to the top surface of the document cassette 4. The switchback roller 47 stops rotating in a clockwise direction in FIG .2, and stops ejecting the sheet 3 at a certain point near the end of the sheet 3 in the sheet ejecting direction so that the switchback roller 47 and the switchback idle roller 48 can still hold the sheet 3 not releasing the sheet 3 completely onto the top surface of the document cassette 4, and executes the next step. Subsequently, the switchback roller 47 supplies the sheet 3 back into the image-recording device 1 by rotating in a counterclockwise direction in FIG. 2.

The second switching hook 49 is placed between the switchback roller 47 and the guide unit 51. The second switching hook 49 controls a path of the sheet 3 to eject the sheet 3 to the top of the document cassette 4, or to supply back to the image-recording device 1.

The sheet 3 is guided by the guide unit 51 and is supplied back to the conveyance belt 23 by supplying the sheet 3 to the intermediate roller 33 by use of the relay roller 52, the relay idle roller 53 and the conveyance idle roller 54.

Figure 3:
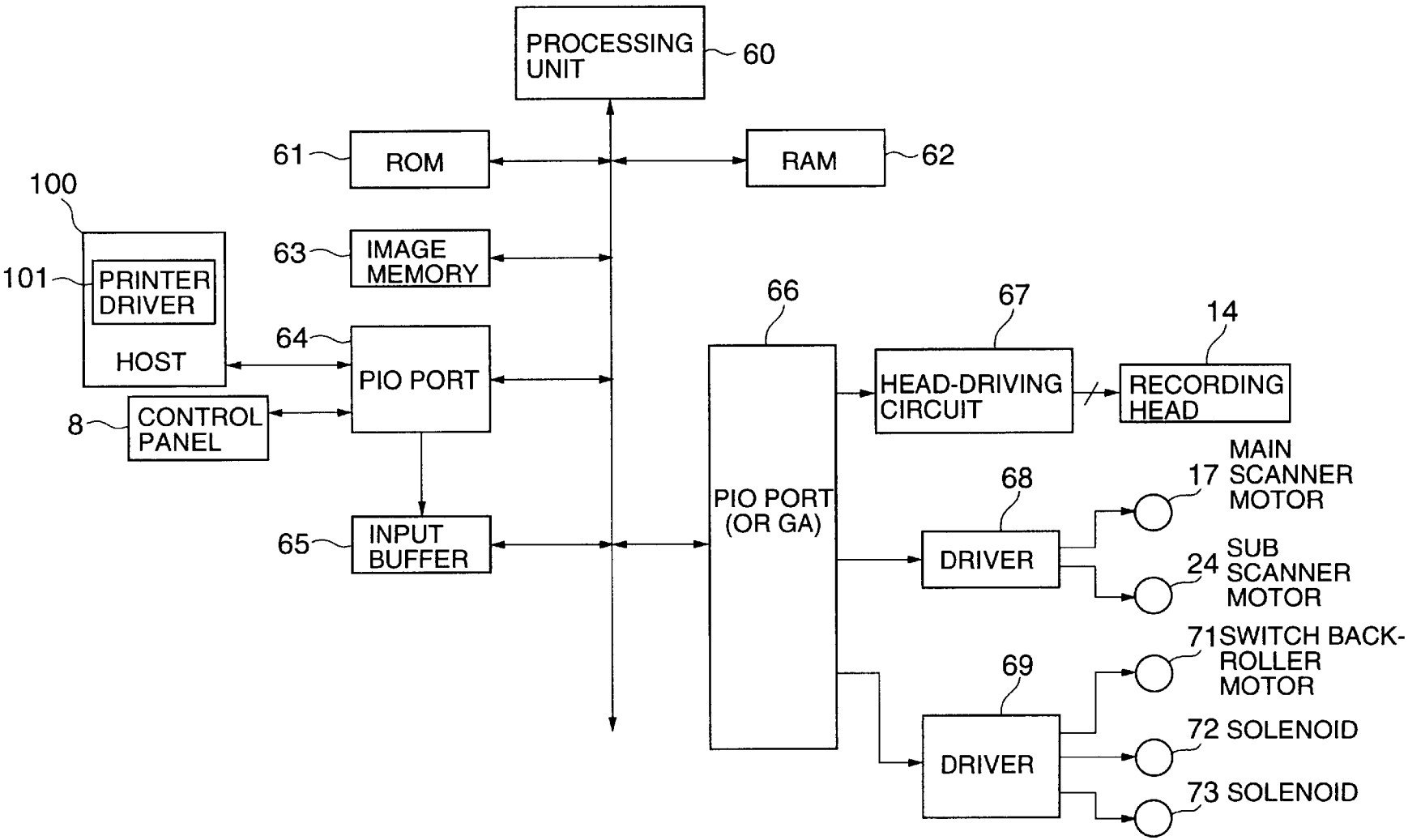
FIG. 3 is a block diagram showing a control unit of the image-recording device according to the present invention.
Figure 4:
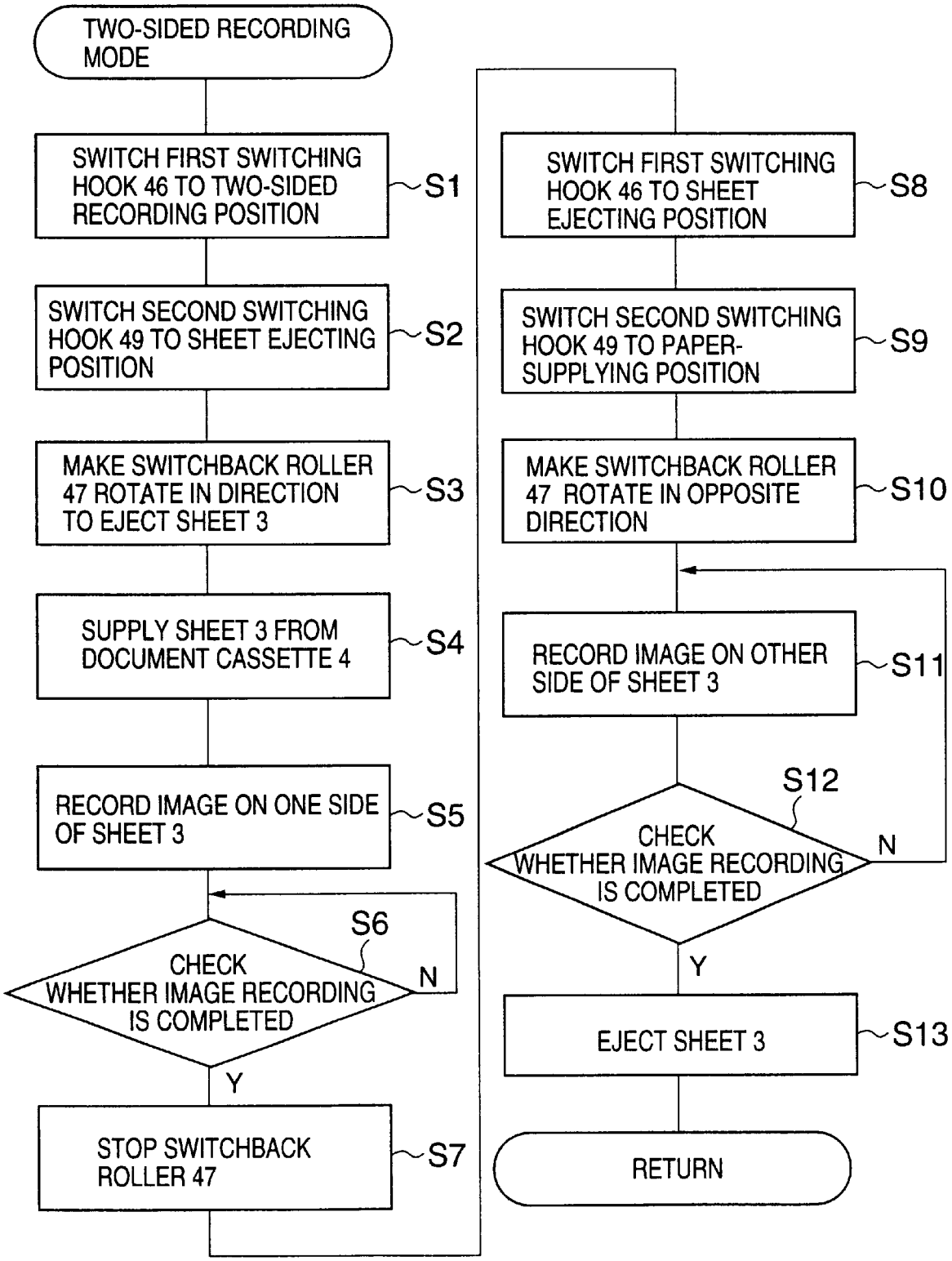
FIG. 4 is a flowchart for describing the steps of a two-sided recording mode that records images on both surfaces of a sheet 3.

The switchback-roller motor 71 shown in FIG. 3 makes the switchback roller 47 rotate. The solenoids 72 and 73 shown in FIG. 3 make the first switching hook 46 and the second switching hook 49 move respectively by use of electromagnetic force.

A description will now be given of a control unit of the image-recording device 1 with reference to FIG. 3.

The control unit of the image-recording device 1 includes a processing unit 60, a ROM (Read Only Memory) 61, a RAM (Random Access Memory) 62, an image memory 63, a PIO (Parallel Input Output) port 64, an input buffer 65, a PIO port 66 that can be substituted by a gate array (GA), a head-driving circuit 67 and drivers 68 and 69.

It should be noted that a recording-side mode of the image-recording device 1 is switched between a one-side recording mode wherein the device 1 records an image on one side of the sheet 3, and a two-sided recording mode wherein the device 1 records images on both sides of the sheet 3.

The processing unit 60 includes, for instance, procedures to select a path number, a nozzle number, drive frequency, a dot number and dot density. The ROM 61 stores fixed information necessary for the processing unit 60 to operate the image-recording device 1. The RAM 62 is used as a working area for the processing unit 60. The image memory 63 stores image data after being processed by the processing unit 60.

The PIO port 64 receives information to select the recording-side mode, a paper type, the path number, the nozzle number, the drive frequency, the dot number and the dot density from a printer driver 101 located in a host 100. Additionally the PIO port 64 receives image information from the host 100, various types of control information from the control panel 8 shown in FIG. 1, and signals from sensors located in the image-recording device 1 such as a home-position sensor detecting a home position (standard position) of the carriage 13. Additionally, the control unit outputs information necessary to control the image-recording device 1 through the PIO port 64 to the host 100 and the control panel 8.

The head-driving circuit 67 applies a waveform that matches the image information received from the host 100 to an actuator corresponding to each nozzle located in the recording head 14 according to data and signals received through the PIO port 66. The waveform applied to the actuator may take a form of a square pulse, a triangular wave and a sine wave.

The driver 68, by receiving data about driving the motors 17 and 24, controls the main scanner motor 17 to make the carriage 13 slide in the main scanning direction of the sheet 3, and controls the sub scanner motor 24 to make the conveyance roller 21 to rotate in the sub scanning direction of the sheet 3. The driver 69 controls the switchback-roller motor 71 to rotate the switchback roller 47, and controls the solenoids 72 and 73 to respectively make the first switching hook 46 and the second switching hook 49 move.

Figure 5:
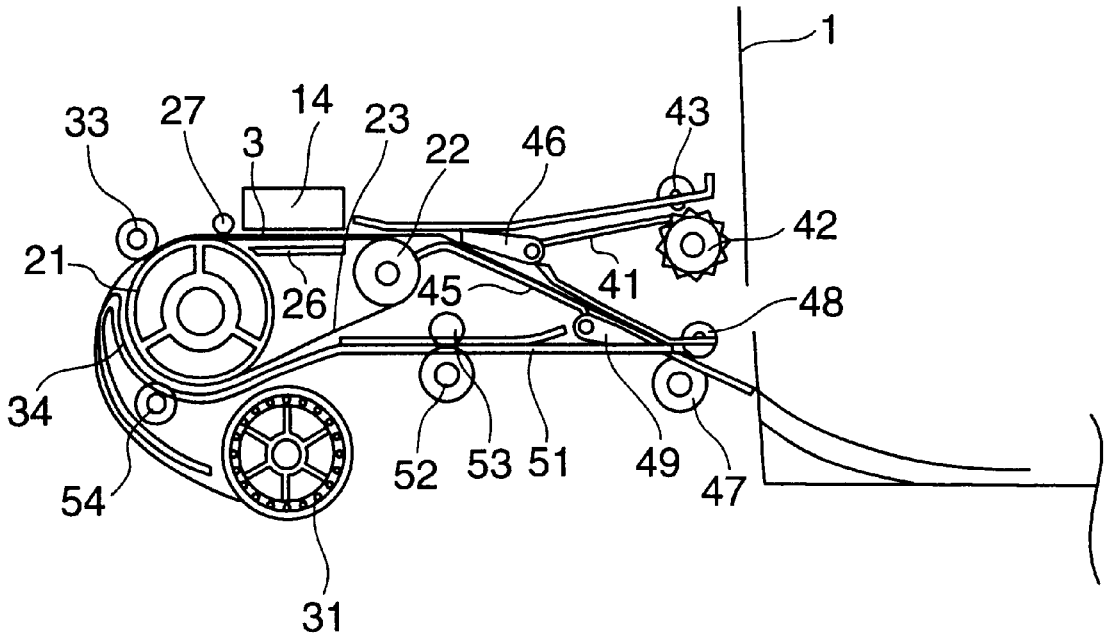
FIG. 5 is a block diagram showing a path switching mechanism of the image-recording device in the two-sided recording mode.

A description will now be given of the two-sided recording mode of the image-recording device 1 with reference to FIG. 4 through FIG. 7. After receiving a signal directing the device 1 to switch to the two-sided recording mode from the host 100, the device 1 switches the first switching hook 46 to a both-sides recording position at a step S1 and the second switching hook 49 to a sheet ejecting position at a step S2 as shown in FIG. 5. At a step S3, the device 1 directs the switchback roller 47 to rotate in a clockwise direction (a direction to eject the sheet 3) in FIG. 5.

Additionally, at a step S4, the document cassette 4 supplies the sheet 3 to the conveyance belt 23 by driving the paper-supplying roller 31. The sheet 3 then adheres onto the conveyance belt 23 by electrostatic force, and is carried to a recording area underneath the recording head 14 in the sub scanning direction. At a step S5, the recording head 14 attached to the carriage 13 records an image on one side of the sheet 3 by moving the carriage 13 in the main scanning direction and driving the actuator of the recording head 14. The device 1 checks if the image is recorded on one side of the sheet 3 at a step S6.

Figure 6:
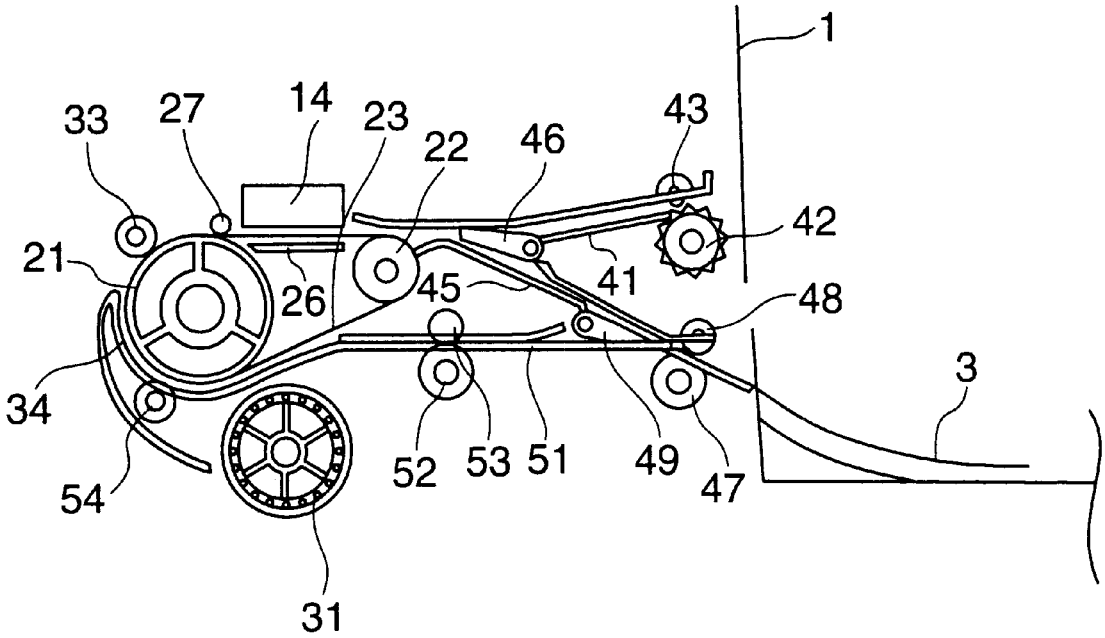
FIG. 6 is a block diagram showing the path switching mechanism of the image-recording device in the two-sided recording mode.

Being guided by the guide unit 45 after the image is recorded on one side of the sheet 3, the sheet 3 is inserted between the switchback roller 47 and the switchback idle roller 48, and is ejected by the rollers 47 and 48 from the device 1 as shown in FIG. 6. When a part near the edge of the sheet 3 slides between the rollers 47 and 48, the device 1 stops the switchback roller 47 so that the rollers 47 and 48 hold the sheet 3 at a step S7.

Figure 7:
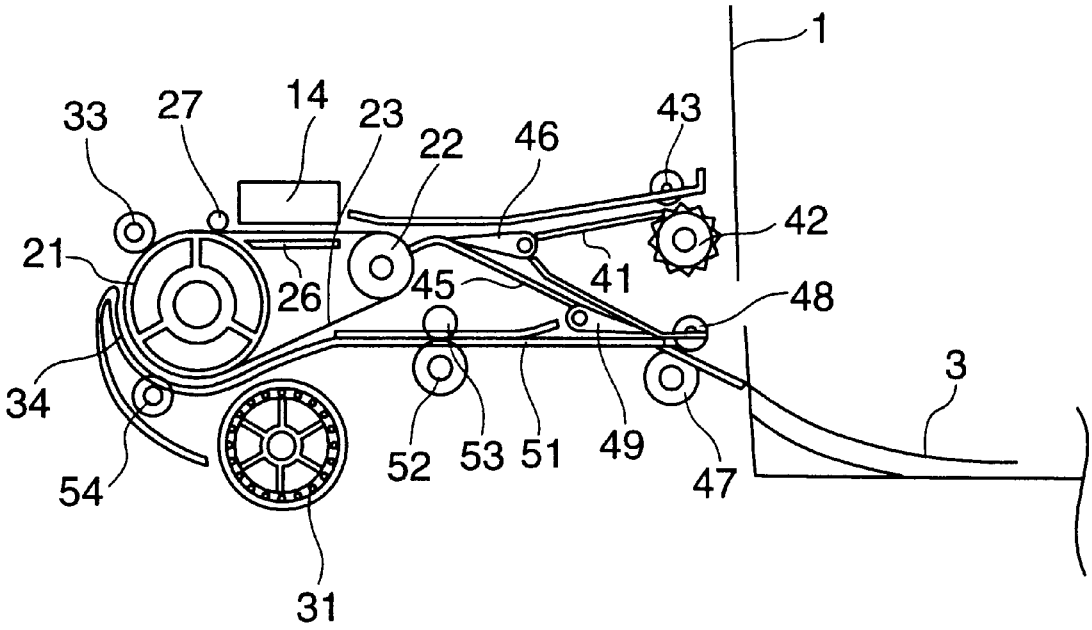
FIG. 7 is a block diagram showing the path switching mechanism of the image-recording device in the two-sided recording mode.
Figure 8:
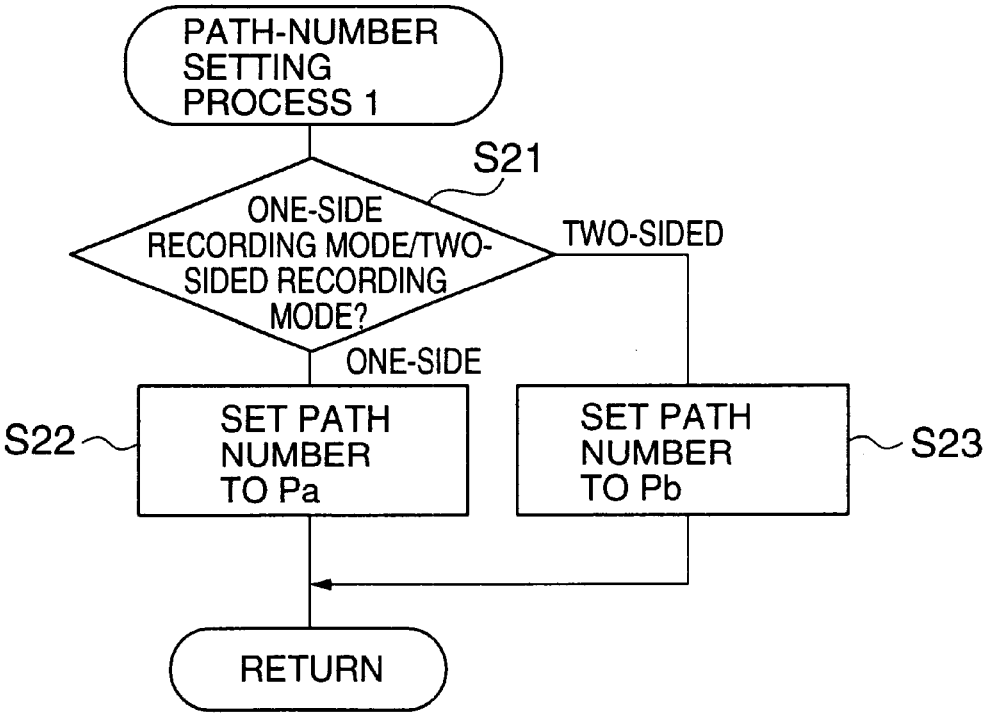
FIG. 8 is a flowchart for describing a first example of a path-number setting process according to a first embodiment of the present invention.

The device 1 switches the first switching hook 46 to the sheet ejecting position at a step S8, and the second switching hook 49 to a paper-supplying position at a step S9 as shown in FIG. 7. Subsequently, at a step S10, the device 1 directs the switchback roller 47 to rotate in a counterclockwise direction (a direction to supply the sheet 3) in FIG. 5, and directs the relay roller 52 to rotate in the counterclockwise direction in FIG. 5. Being guided by the guide unit 51, the sheet 3 is carried by the relay roller 52 and the relay idle roller 53 to the conveyance belt 23.

The angular velocity of the relay roller 52 is same as the angular velocity of the conveyance roller 21 so that the sheet 3 is supplied to the conveyance belt 23 without being rubbed by the conveyance belt 23 according to the velocity difference between the rollers 52 and 21.

The sheet 3 is carried to the recording area as described above, and the recording head 14 records an image on the other side of the sheet 3 at a step S11. The device 1 checks whether the image is recorded on the other side of the sheet 3 at a step S12. Subsequently, the sheet 3 with the images on both sides thereof is guided by the guide unit 41, and is ejected by the paper-ejecting roller 42 and the paper-ejecting idle roller 43 to the document-ejecting tray 6 at a step S13.

As described above, by ejecting the sheet 3 once after recording an image on one side thereof by use of the recording head 14 and supplying the sheet 3 back to the device 1 for recording an image on the other side thereof by use of the recording head 14, the device 1 can obtain a certain period for ink on the sheet 3 to dry outside the device 1 so that recording quality of the sheet 3 increases. Additionally, only one recording head 14 is required for recording images on both sides of the sheet 3 so that a mechanical structure of the device 1 becomes simpler than that of a device with two recording heads.

Although the sheet 3 becomes heavier because of ink adheres thereto after an image is recorded on one side, the sheet 3 is easily and stably ejected by being carried downward by the switchback roller 47 and the switchback idle roller 48 in the device 1. A location where the sheet 3 is ejected is set to a top surface of the document cassette 4 so that an extra tray is not required for keeping the sheet 3. The sheet 3 may be processed through other operations outside the device 1 before being supplied back to the device 1. Alternatively, the sheet 3 may be ejected once to the document-ejecting tray 6 by using the paper-ejecting roller 42 as a switchback roller instead of ejecting by use of the switchback roller 47.

A description will now be given of setting parameters that affect recording quality and recording speed of the sheet 3 in the image-recording device 1 according the present invention.

Blurriness of an image on one side seen from the other side of the sheet 3 when the ink permeates from one side to the other side is measured by measuring color density of the other side of the sheet 3. The higher the color density of the other side of the sheet 3 is, the higher the blurriness of the image on one side seen from the other side. Additionally, the curliness of the sheet 3 is measured by a method wherein the sheet 3 positioned on a plane is ranked by its curled shape. In the method, the closer to a circular cylinder the curled shape of the sheet 3 is, the higher the curliness of the sheet 3 is. Alternatively, the curliness of the sheet 3 is measured by measuring the height from the plane to each edge of the sheet 3 positioned on the plane. In this case, the higher the height from the plane to each edge of the sheet 3, the higher the curliness of the sheet 3 is. Additionally, how much the sheet 3 is cockled is, hereinafter, referred to as a degree of cockling of the sheet 3. The degree of cockling of the sheet 3 is measured by measuring amplitude of unevenness on a surface of the sheet 3. The larger the amplitude of the unevenness of the surface of the sheet 3, the higher the degree of cockling of the sheet 3 is.

A description will now be given of a first example of a path-number setting process according to a first embodiment of the present invention that is taken by the processing unit 60 in the control unit depending on the recording-side mode of the image-recording device 1 that is either the one-side recording mode or the two-sided recording mode, with reference to FIG. 8 through FIG. 12.

The path number is a total number of passes, wherein the image-recording device 1 moves the carriage 13 in the main scanning direction when recording an image on either side of the sheet 3 by separating the image into blocks and recording the blocks separately. A recording pattern of the image is, for example, a pattern shown in FIG. 9A through FIG. 9F. Each block in FIG. 9A through FIG. 9F is a block with the highest resolution that the image-recording device 1 can record on a sheet. FIG. 9A shows a pattern with the path number set to "1", and the image-recording device 1 records the image at once by moving the carriage 13 in the main scanning direction. FIG. 9B shows a recording pattern with the path number set to "2". In the recording pattern shown in FIG. 9B, the image-recording device 1 records white blocks first, and records black blocks next. Alternatively, the image-recording device 1 can record the black blocks first, and records the white blocks subsequently.

FIG. 9C shows a recording pattern with the path number set to "2", wherein black blocks and white blocks form sidelines. FIG. 9D shows a recording pattern with the path number set to "2", wherein black blocks and white blocks form vertical lines. FIG. 9E shows a recording pattern with the path number set to "4", wherein each block with a number 1 through 4 is recorded respectively in the first through the fourth pass of the recording movement of the image-recording device 1. FIG. 9F shows a recording pattern with the path number set to "8", wherein each block with a number 1 through 8 is recorded respectively in the first through the eighth pass of the recording movement. It should be noted that the path number and the recording pattern are not limited to examples shown in FIG. 9A through FIG. 9F.

Figure 10:
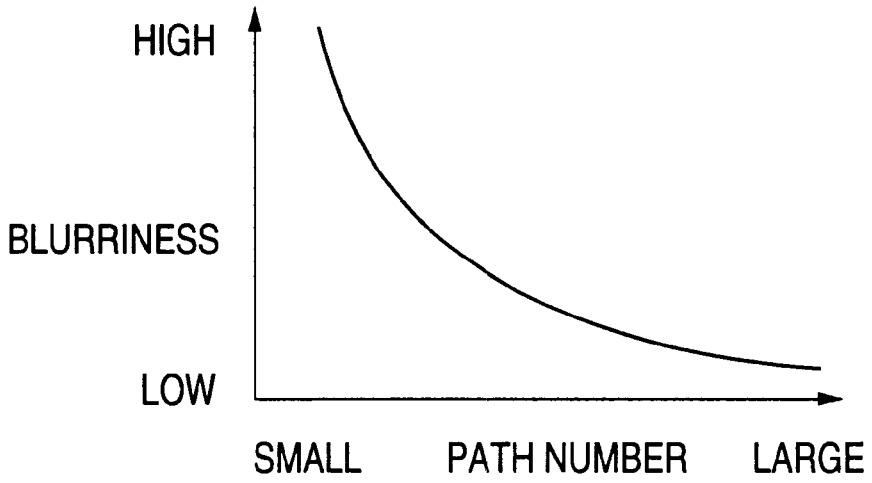
FIG. 10 is a diagram showing relation between a path number and blurriness of an image recorded on one side of the sheet 3 seen from the other side of the sheet 3.
Figure 11:
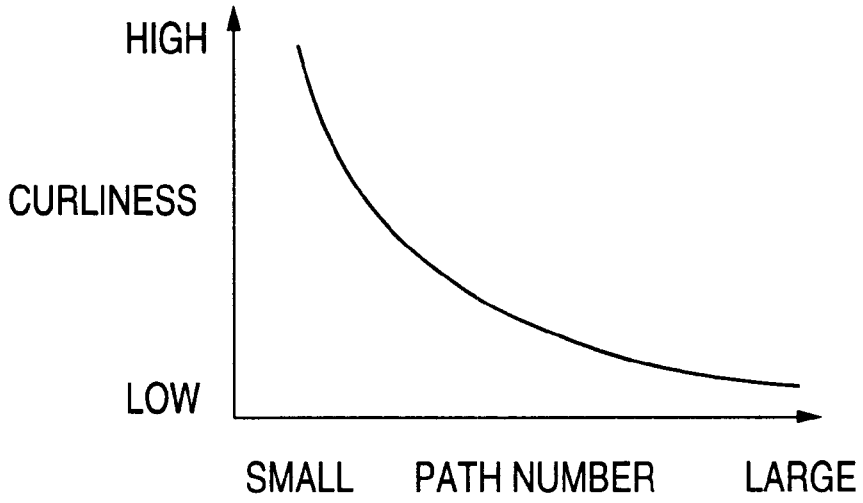
FIG. 11 is a diagram showing relation between the path number and curliness of the sheet 3.
Figure 12:
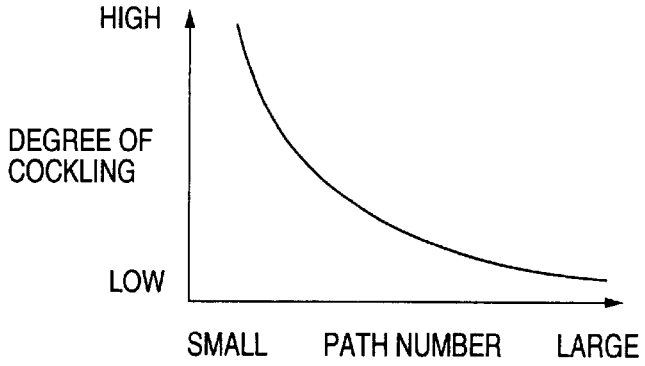
FIG. 12 is a diagram showing relation between the path number and a degree of cockling of the sheet 3.

FIG. 10 shows a relation between the path number and the blurriness of an image on one side seen from the other side of the sheet 3 after recording an image on one side of the sheet 3 by use of the path number and the recording pattern. FIG. 11 shows a relation between the path number and the curliness of the sheet 3. FIG. 12 shows a relation between the path number and the degree of cockling of the sheet 3. As shown in FIGS. 10, 11 and 12, the higher the path number is, the lower the blurriness of the other side of the sheet 3, the curliness of the sheet 3 and the degree of cockling of the sheet 3 are. Consequently, the image quality increases by increasing the path number.

Accordingly, the processing unit 60 in the control unit selects the most appropriate path number, wherein the image-recording device 1 can record images on both sides of the sheet 3 with the highest image quality possible by taking the following steps. Preceding an image recording executed by the image-recording device 1, the processing unit 60 decides whether the recording-side mode notified by the host 100 is the one-side recording mode or the two-sided recording mode at a step S21 of FIG. 8. If the recording-side mode is set to the one-side recording mode, the processing unit 60 sets the path number to Pa at a step S22. If the recording-side mode is set to the two-sided recording mode, the processing unit 60 sets the path number to Pb that is greater than Pa (Pb>Pa) at a step S23. Subsequently, the image-recording device 1 records an image on one side or images on both sides of the sheet 3 by moving the carriage 13 for the path number set respectively at the step S22 or S23.

In the two-sided recording mode, there is a case that recording an image on the other side becomes difficult after having an image on one side of the sheet 3 blurred and the sheet 3 curled or cockled. Therefore, by setting the path number Pb for the two-sided recording mode higher than the path number Pa for the one-side recording mode, the image-recording device 1 can prevent the blurriness of the image on one side of the sheet 3, the curliness and the degree of cockling of the sheet 3 when recording the image on one side of the sheet 3 so that an image can be recorded on the other side of the sheet 3 with higher image quality.

A description will now be given of a second example of the path-number setting process taken by the processing unit 60 in the control unit with reference to FIG. 13 through FIG. 15.

When the image-recording device 1 records an image on the sheet 3, if recording speed of the image-recording device 1 increases, quality of the image recorded on the sheet 3 generally decreases. On the other hand, if the recording speed of the image-recording device 1 decreases, quality of the image recorded on the sheet 3 increases. Accordingly, in the second example of the path-number setting process, a recording-priority mode that is either a recording-speed priority mode or a recording-quality priority mode is provided to the image-recording device 1.

In the recording-speed priority mode, the processing unit 60 sets the recording speed of the image-recording device 1 to take priority over quality of the image recorded on the sheet 3. Additionally, in the recording-quality priority mode, the processing unit 60 sets the recording quality of the image on the sheet 3 to take priority over the recording speed of the image-recording device 1. The recording-priority mode is selected by the control panel 8 of the image-recording device 1 or by the printer driver 101 located in the host 100.

Figure 13:
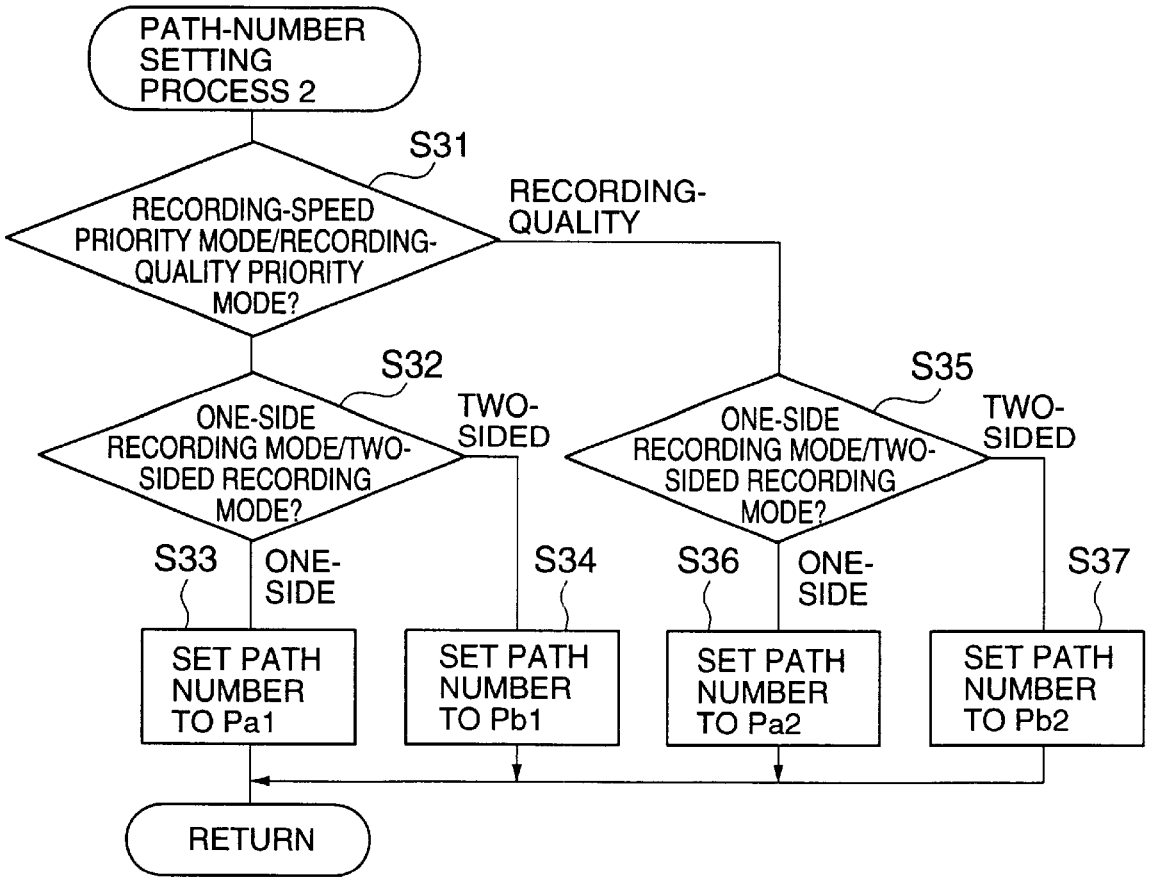
FIG. 13 is a flowchart for describing a second example of the path-number setting process according to the first embodiment of the present invention.

The processing unit 60 in the control unit of the image-recording device 1 decides whether the recording-priority mode is the recording-speed priority mode or the recording-quality priority mode at a step S31 of FIG. 13. If the recording-priority mode is set to the recording-speed priority mode, the processing unit 60 proceeds to a step S32, and decides whether the recording-side mode is set to the one-side recording mode or the two-sided recording mode. If the recording-side mode is set to the one-side recording mode, the processing unit 60 proceeds to a step S33, and sets the path number to Pa1. If it is ascertained at the step S32 that the recording-side mode is set to the two-sided recording mode, the processing unit 60 proceeds to a step S34, and sets the path number to Pb1 that is greater than Pa1 (Pb1>Pa1).

If it is ascertained at the step S31 that the recording-priority mode is set to the recording-quality priority mode, the processing unit 60 proceeds to a step S35, and decides whether the recording-side mode is set to the one-side recording mode or the two-sided recording mode. If the recording-side mode is set to the one-side recording mode, the processing unit 60 proceeds to a step S36, and sets the path number to Pa2 that is greater than Pa1 (Pa2>Pa1). If it is ascertained at the step S35 that the recording-side mode is set to the two-sided recording mode, the processing unit 60 proceeds to a step S37, and sets the path number to Pb2 that is greater than Pa2 (Pb2>Pa2). After setting the path number as described above, the image-recording device 1 records an image on one side or images on both sides of the sheet 3 by moving the carriage 13 for the path number.

Figure 14:
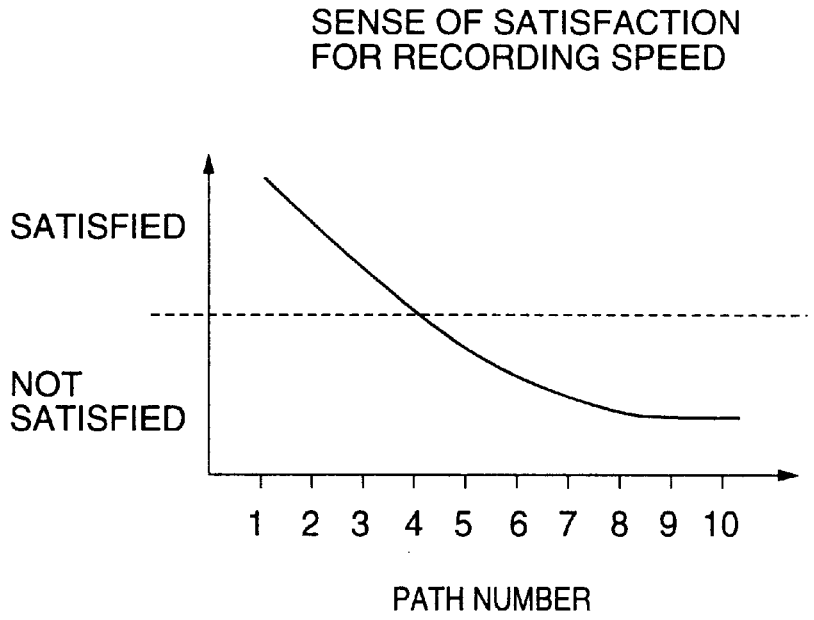
FIG. 14 is a diagram showing relation between the path number and a recording speed of the image-recording device.
Figure 15:
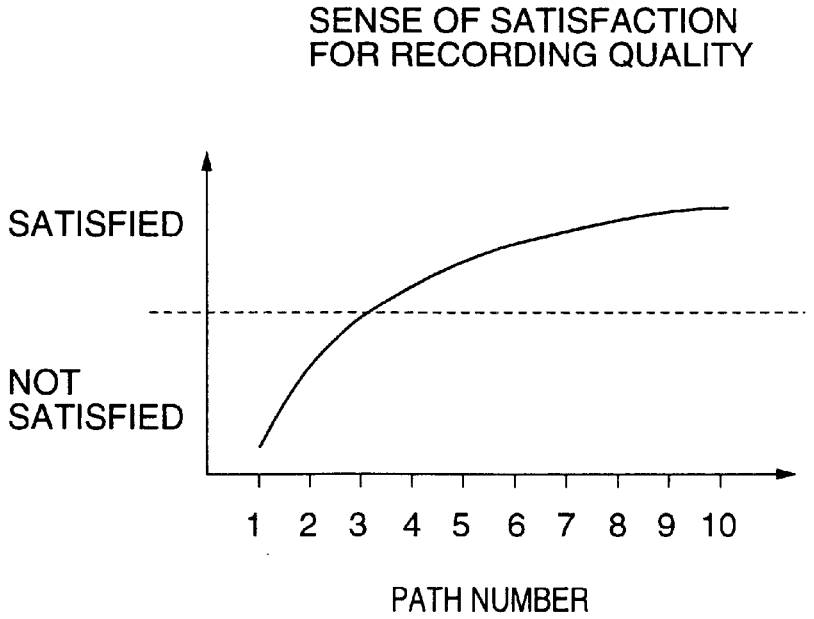
FIG. 15 is a diagram showing relation between the path number and quality of the image recorded by the image-recording device.

FIG. 14 shows a relation between the path number and a subjective sense of satisfaction for the recording speed of the image-recording device 1. Additionally, FIG. 15 shows a relation between the path number and a subjective sense of satisfaction for the recording quality of an image on the sheet 3. FIGS. 14 and 15 are created with data taken from enough number of experiments for the relation between the path number and the sense of satisfaction for the recording speed and the recording quality. As shown in FIGS. 14 and 15, when the path number is less than or equal to "4", the recording speed is fulfilled. Additionally, if the path number is greater or equal to "3", the recording quality is fulfilled. Accordingly, the ascendant order of the path numbers Pa1, Pa2, Pb1 and Pb2 are preferably set to Pa1<Pb1<Pa2<Pb2.

For instance, in the recording-speed priority mode, the path number Pa1 for the one-side recording mode is set to "1", and the path number Pb1 for the two-sided recording mode is set to "2". Additionally in the recording-quality priority mode, the path number Pa2 for the one-side recording mode is set to "5", and the path number Pb2 for the two-sided recording mode is set to "10". The recording speed is fulfilled in the recording-speed priority mode, and the recording quality is fulfilled in the recording-quality mode according to evaluation of the integers given for each of the path numbers Pa1, Pa2, Pb1 and Pb2.

According to the second example of the path-number setting process, the image-recording device 1 can record an image on one side in the one-side recording mode or images on both sides of the sheet 3 in the two-sided recording mode with the recording speed and the recording quality requested by the control panel 8 of the image-recording device 1 or by the printer driver 101 in the host 100.

A description will now be given of a third example of the path-number setting process taken by the processing unit 60 in the control unit with reference to FIG. 16.

Figure 16:
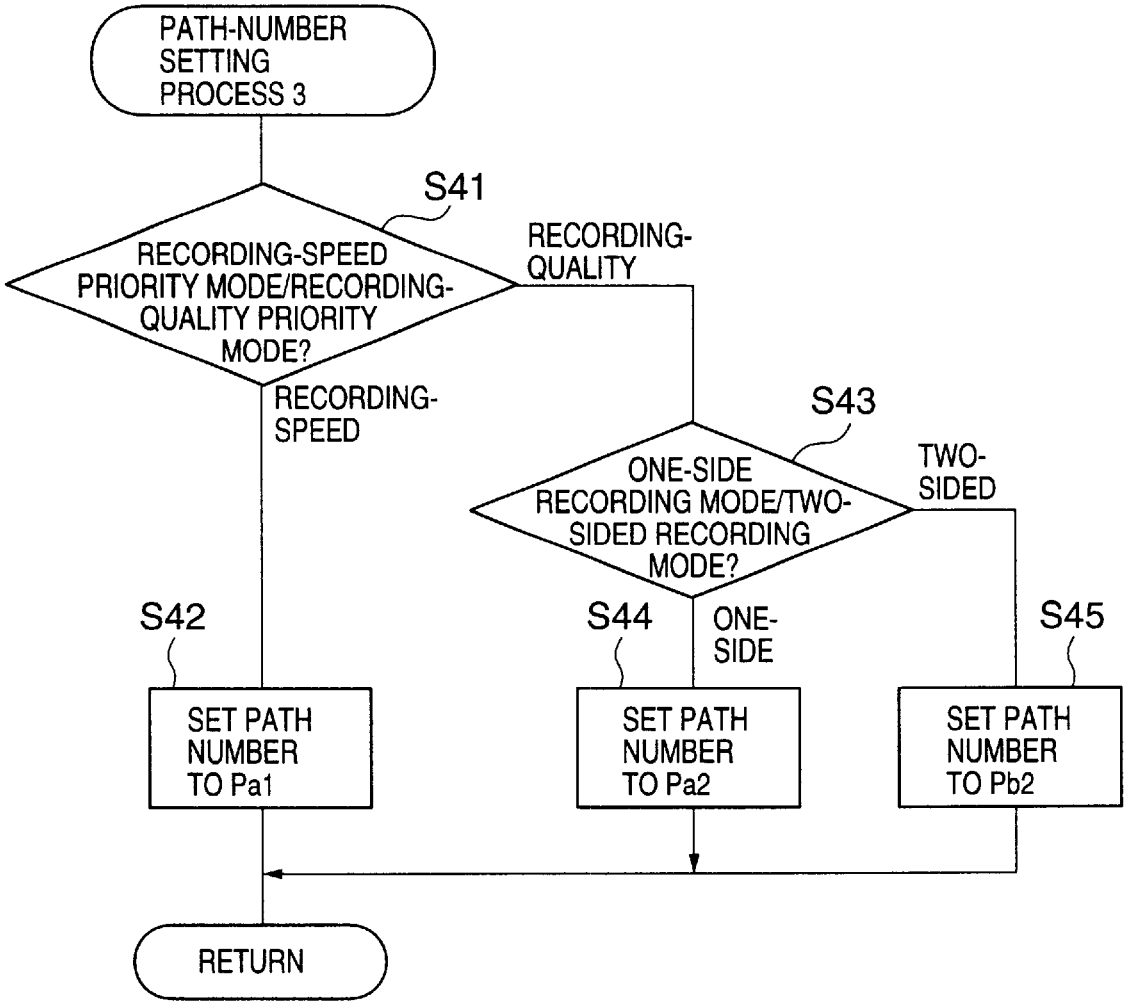
FIG. 16 is a flowchart for describing a third example of the path-number setting process according to the first embodiment of the present invention.

The processing unit 60 in the control unit of the image-recording device 1 decides whether the recording-priority mode is the recording-speed priority mode or the recording-quality priority mode at a step S41 of FIG. 16. If the recording-priority mode is set to the recording-speed priority mode, the processing unit 60 proceeds to a step S42, and sets the path number to Pa1. If it is ascertained at the step S41 that the recording-priority mode is set to the recording-quality priority mode, the processing unit 60 proceeds to a step S43, and decides whether the recording-side mode is set to the one-side recording mode or the two-sided recording mode. If the recording-side mode is set to the one-side recording mode, the processing unit 60 proceeds to a step S44, and sets the path number to Pa2 that is greater than Pa1 (Pa2>Pa1). If it is ascertained at the step S43 that the recording-side mode is set to the two-sided recording mode, the processing unit 60 proceeds to a step S45, and sets the path number to Pb2 that is greater than Pa2 (Pb2>Pa2). After setting the path number as described above, the image-recording device 1 records an image on one side or images on both sides of the sheet 3 by moving the carriage 13 for the path number.

As described above, the path numbers for the one-side recording mode and the two-sided recording mode in the recording-speed priority mode are set to Pa1 so that the image-recording device 1 can set the recording-speed to its first priority. For instance, in the recording-speed priority mode, the path number Pa1 for the one-side recording mode and the two-sided recording mode is set to "1". Additionally in the recording-quality priority mode, the path number Pa2 for the one-side recording mode is set to "5", and the path number Pb2 for the two-sided recording mode is set to "10". The recording speed is more fulfilled than the recording speed in the second example of the path-number setting process in the recording-speed priority mode, and the recording quality is fulfilled as much as the recording quality in the second example of the path-number setting process in the recording-quality mode according to evaluation of the integers given for each of the path numbers Pa1, Pa2 and Pb2.

According to the third example of the path-number setting process, by setting the path numbers for the one-side recording mode and the two-sided recording mode to be same in the recording-speed priority mode, the image-recording device 1 can record images on both sides of the sheet 3 in the recording-speed priority mode with higher recording speed than that of the second example of the path-number setting process.

A description will now be given of a fourth example of the path-number setting process taken by the processing unit 60 in the control unit with reference to FIG. 17.

Figure 17:
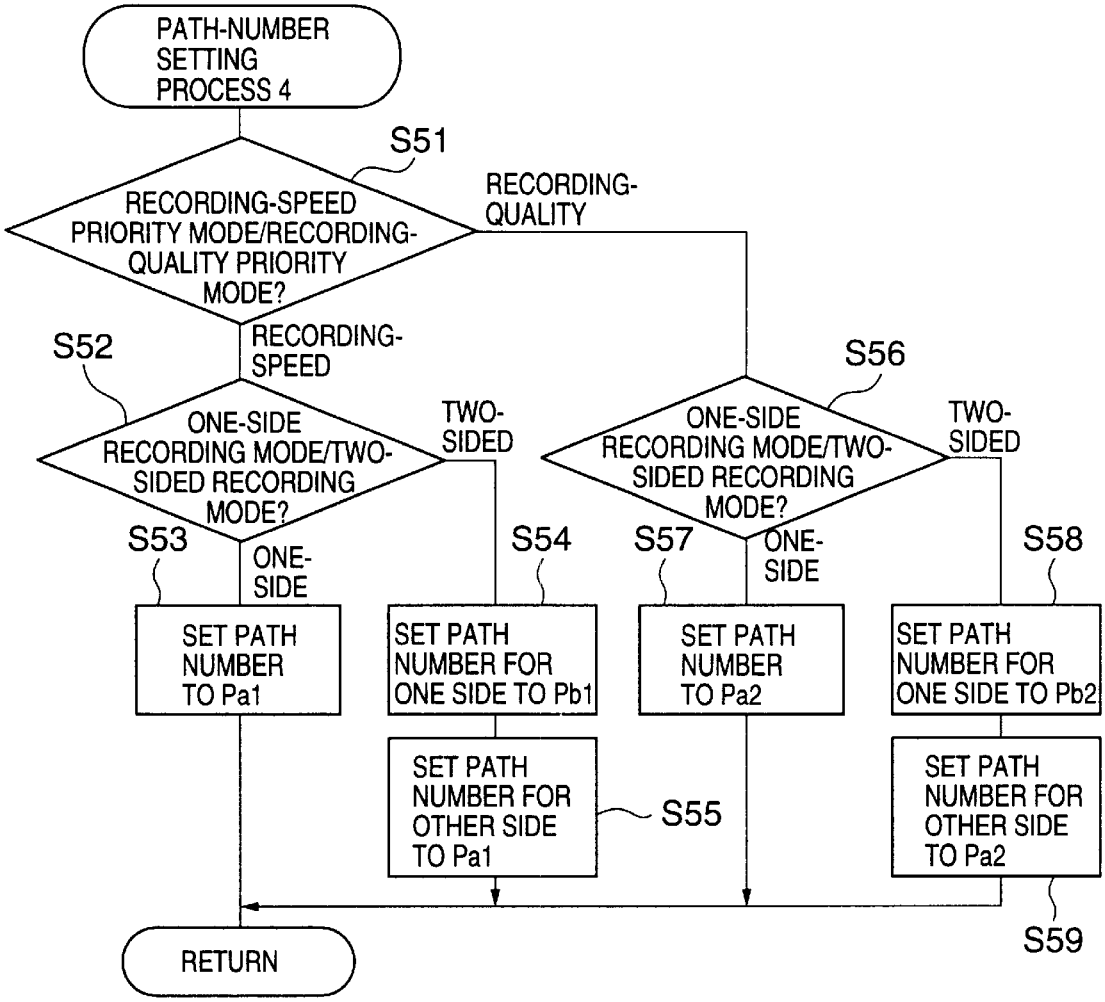
FIG. 17 is a flowchart for describing a fourth example of the path-number setting process according to the first embodiment of the present invention.

The processing unit 60 in the control unit of the image-recording device 1 decides whether the recording-priority mode is the recording-speed priority mode or the recording-quality priority mode at a step S51 of FIG. 17. If the recording-priority mode is set to the recording-speed priority mode, the processing unit 60 proceeds to a step S52, and decides whether the recording-side mode is set to the one-side recording mode or the two-sided recording mode. If the recording-side mode is set to the one-side recording mode, the processing unit 60 proceeds to a step S53, and sets the path number to Pa1. If it is ascertained at the step S52 that the recording-side mode is set to the two-sided recording mode, the processing unit 60 proceeds to a step S54, and sets the path number for recording an image on one side of the sheet 3 to Pb1 that is greater than Pa1 (Pb1>Pa1). Subsequently, the processing unit 60 sets the path number for recording an image on the other side of the sheet 3 to Pa1 at a step S55.

If it is ascertained at the step S51 that the recording-priority mode is set to the recording-quality priority mode, the processing unit 60 proceeds to a step S56, and decides whether the recording-side mode is set to the one-side recording mode or the two-sided recording mode. If the recording-side mode is set to the one-side recording mode, the processing unit 60 proceeds to a step S57, and sets the path number to Pa2 that is greater than Pa1 (Pa2>Pa1). If it is ascertained at the step S56 that the recording-side mode is set to the two-sided recording mode, the processing unit 60 proceeds to a step S58, and sets the path number for recording an image on one side of the sheet 3 to Pb2 that is greater than Pa2 (Pb2>Pa2). Subsequently, the processing unit 60 sets the path number for recording an image on the other side of the sheet 3 to Pa2 at a step S59. After setting the path number as described above, the image-recording device 1 records an image on one side or images on both sides of the sheet 3 by moving the carriage 13 for the path number.

For instance, in the recording-speed priority mode, the path number Pa1 for the one-side recording mode and for recording an image on the other side of the sheet 3 in the two-sided recording mode is set to "1", and the path number Pb1 for recording an image on one side of the sheet 3 in the two-sided recording mode is set to "2". Additionally in the recording-quality priority mode, the path number Pa2 for the one-side recording mode and for recording an image on the other side of the sheet 3 in the two-sided recording mode is set to "5", and the path number Pb2 for recording an image on one side of the sheet 3 in the two-sided recording mode is set to "10".

The recording speed of the image-recording device 1 is more fulfilled than the recording speeds in the second example and in the third example of the path-number setting process in the two-sided recording mode according to evaluation of the integers given for each of the path numbers Pa1, Pa2, Pb1 and Pb2.

According to the fourth example of the path-number setting process, by setting the path number for recording an image on the other side of the sheet 3 different from the path number for recording one side of the sheet 3 in the two-sided recording mode, the image-recording device 1 can record images on both sides of the sheet 3 in the two-sided recording mode with the higher recording speed than that of the second example of the path-number setting process and that of the third example of the path-number setting process.

A description will now be given of a first example of a nozzle-number setting process according to a second embodiment of the present invention that is taken by the processing unit 60 in the control unit depending on the recording-side mode of the image-recording device 1 that is either the one-side recording mode or the two-sided recording mode, with reference to FIG. 18 through FIG. 24.

Figure 19:
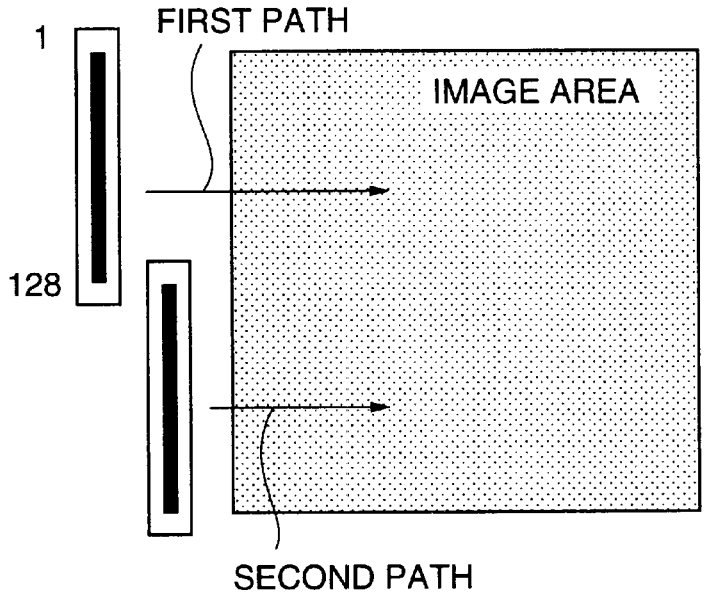
FIG. 19 is a diagram showing relation between the nozzle number and number of paths the image-recording device takes for recording the image on a surface of the sheet 3.
Figure 20:
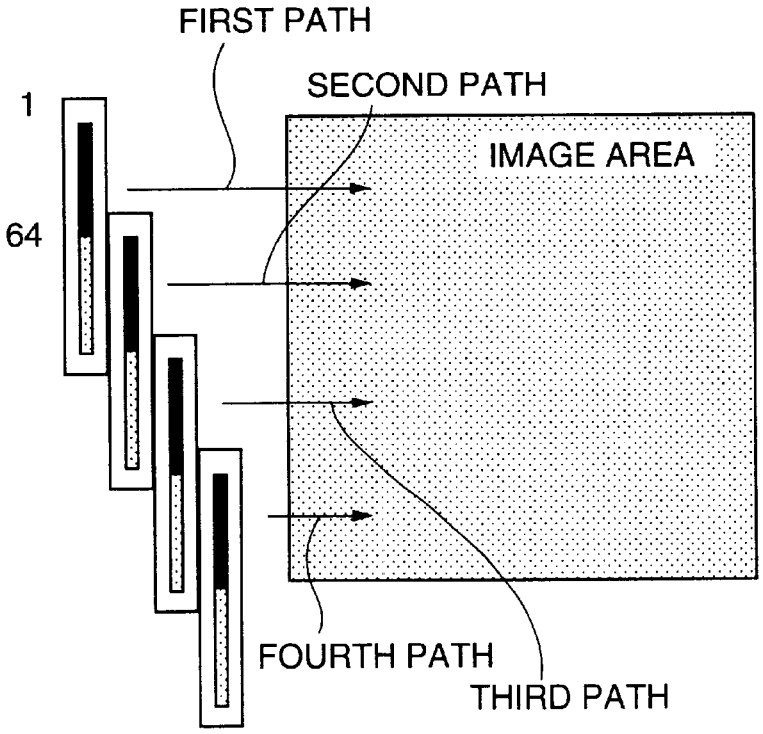
FIG. 20 is a diagram showing relation between the nozzle number and number of paths the image-recording device takes for recording the image on a surface of the sheet 3.
Figure 21:
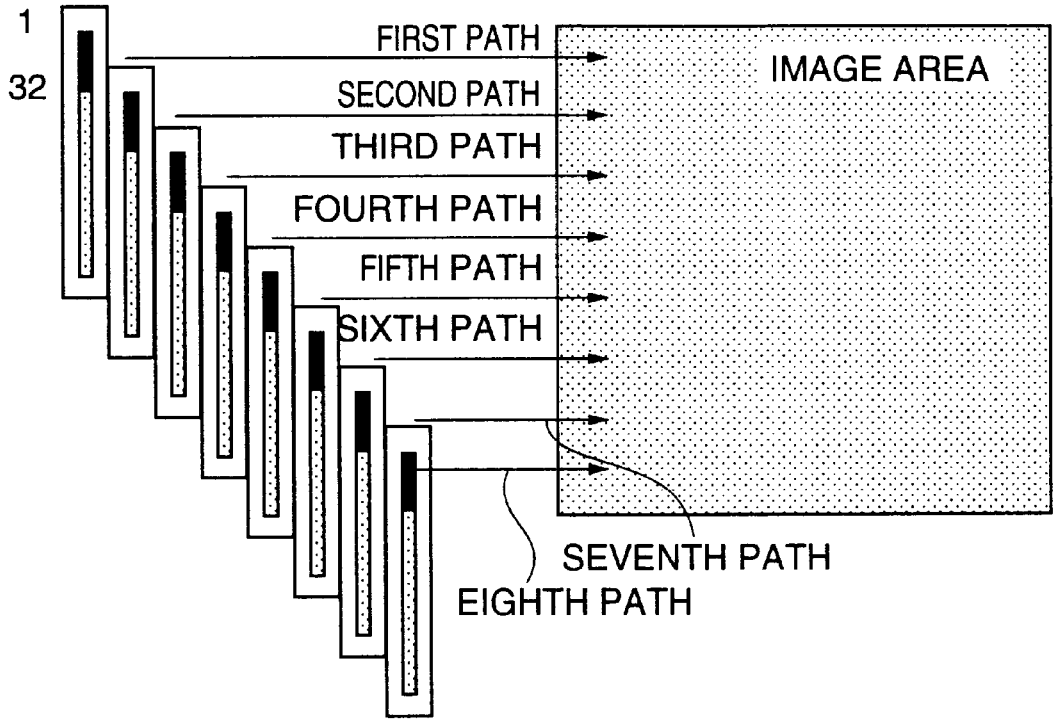
FIG. 21 is a diagram showing relation between the nozzle number and number of paths the image-recording device takes for recording the image on a surface of the sheet 3.

The nozzle number is a total number of nozzles attached to the recording head 14 that are used for recording an image on a surface of the sheet 3. Relations between the nozzle number and its corresponding recording pattern of an image are shown in FIGS. 19, 20 and 21 in a case that a total number of nozzles attached to the recording head 14 is "128". In FIG. 19, the nozzle number is set to "128", and the image-recording device 1 uses 128 nozzles for recording an image in 2 paths. If the nozzle number is set to "64", the image-recording device 1 uses 64 nozzles for recording the image in 4 paths as shown in FIG. 20. Additionally, as shown in FIG. 21, the image-recording device 1 uses 32 nozzles for recording the image in 8 paths if the nozzle number is set to "32".

Figure 22:
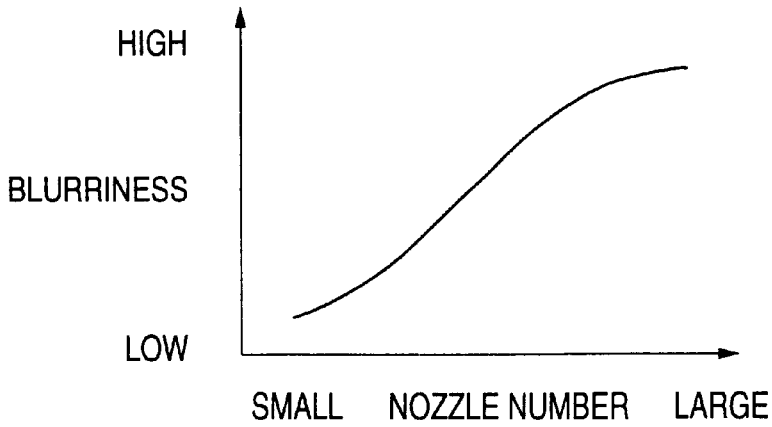
FIG. 22 is a diagram showing relation between the nozzle number and blurriness of the image recorded on one side of the sheet 3 seen from the other side of the sheet 3.
Figure 23:
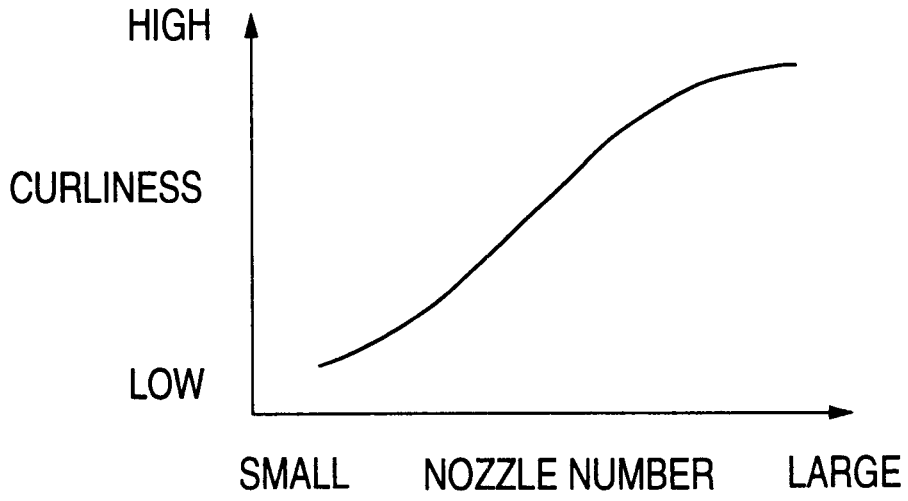
FIG. 23 is a diagram showing relation between the nozzle number and curliness of the sheet 3.
Figure 24:
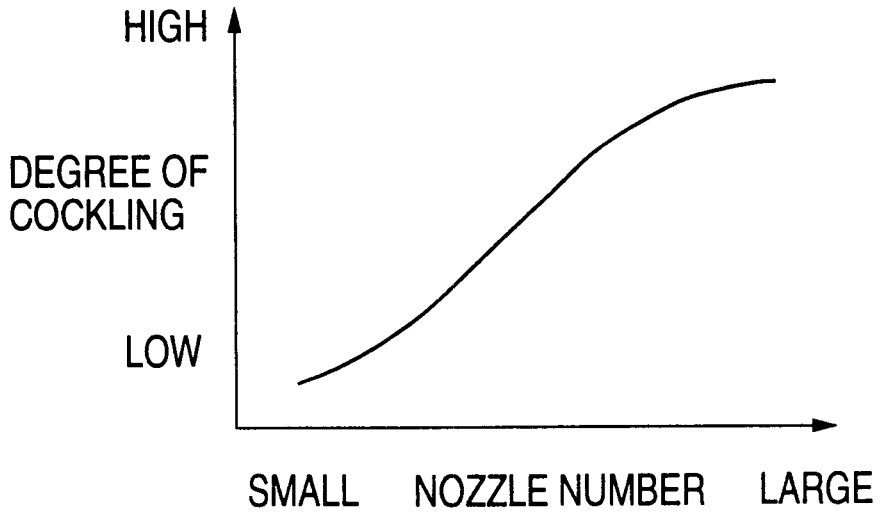
FIG. 24 is a diagram showing relation between the nozzle number and the degree of cockling of the sheet 3.

FIGS. 22, 23 and 24 show respectively relation between the nozzle number and the blurriness of an image recorded on one side of the sheet 3 seen from the other side, relation between the nozzle number and the curliness of the sheet 3, and relation between the nozzle number and the degree of cockling of the sheet 3. As seen from FIGS. 22, 23 and 24, the lower the nozzle number is, the lower the blurriness, the curliness, the degree of cockling are. Accordingly, the lower the nozzle number is, the higher the image quality is.

Figure 18:
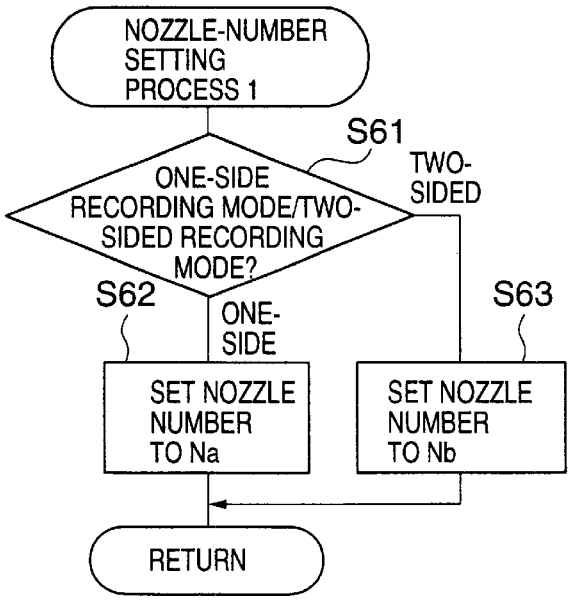
FIG. 18 is a flowchart for describing a first example of a nozzle-number setting process according to a second embodiment of the present invention.

The processing unit 60 in the control unit executes the nozzle-number setting process preceding an image recording on the sheet 3. In FIG. 18, the processing unit 60 decides whether the recording-side mode is set to the one-side recording mode or the two-sided recording mode at a step S61. If it is ascertained at the step S61 that the recording-side mode is set to the one-side recording mode, the processing unit 60 proceeds to a step S62, and sets the nozzle number to Na. If it is ascertained at the step S61 that the recording-side mode is set to the two-sided recording mode, the processing unit 60 proceeds to a step S63, and sets the nozzle number to Nb that is smaller than Na (Nb<Na). After setting the nozzle number, the image-recording device 1 records an image on one side of the sheet 3 or images on both sides of the sheet 3 by discharging ink onto the sheet 3 from the nozzles attached to the recording head 14.

In the two-sided recording mode, there is a case that recording an image on the other side becomes difficult after having an image on one side of the sheet 3 blurred and the sheet 3 curled or cockled. Therefore, by setting the nozzle number Nb for the two-sided recording mode smaller than the nozzle number Na for the one-side recording mode, the image-recording device 1 can prevent the blurriness of the image on one side of the sheet 3, the curliness and the degree of cockling of the sheet 3 when recording the image on one side of the sheet 3 so that an image can be recorded on the other side of the sheet 3 with higher image quality.

Accordingly, the image-recording device 1 can record an image on one side of the sheet 3 or images on both sides of the sheet 3 with higher image quality by setting the nozzle number to an appropriate number depending on the one-side recording mode or the two-sided recording mode.

A description will now be given of a second example of the nozzle-number setting process taken by the processing unit 60 in the control unit with reference to FIGS. 25, 26 and 27.

When the image-recording device 1 records an image on the sheet 3, if recording speed of the image-recording device 1 increases, quality of the image recorded on the sheet 3 generally decreases. On the other hand, if the recording speed of the image-recording device 1 decreases, quality of the image recorded on the sheet 3 increases. Accordingly, in the second example of the nozzle-number setting process, a recording-priority mode that is either a recording-speed priority mode or a recording-quality priority mode is provided to the image-recording device 1.

In the recording-speed priority mode, the processing unit 60 sets the recording speed of the image-recording device 1 to take priority over quality of the image recorded on the sheet 3. Additionally, in the recording-quality priority mode, the processing unit 60 sets the recording quality of the image on the sheet 3 to take priority over the recording speed of the image-recording device 1. The recording-priority mode is selected by the control panel 8 of the image-recording device 1 or by the printer driver 101 located in the host 100.

Figure 25:
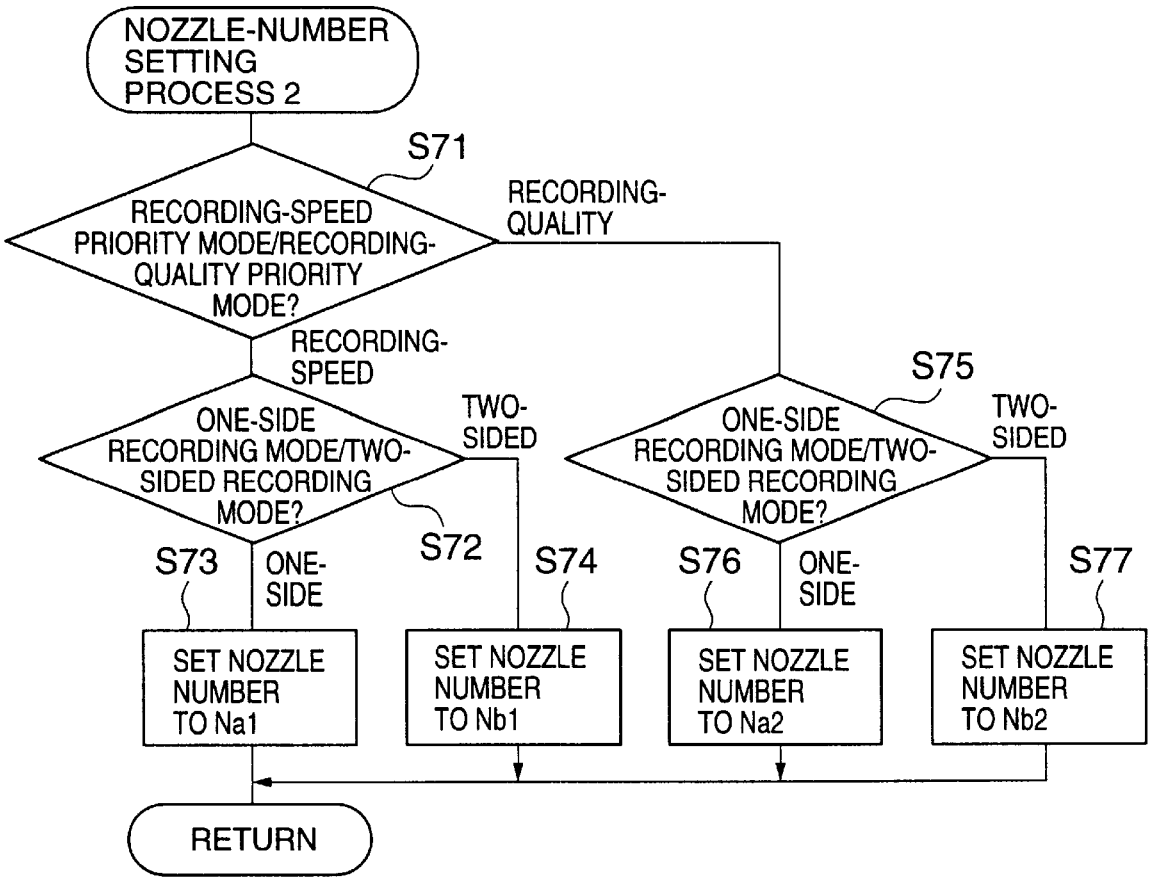
FIG. 25 is a flowchart for describing a second example of the nozzle-number setting process according to the second embodiment of the present invention.

The processing unit 60 in the control unit of the image-recording device 1 decides whether the recording-priority mode is the recording-speed priority mode or the recording-quality priority mode at a step S71 of FIG. 25. If the recording-priority mode is set to the recording-speed priority mode, the processing unit 60 proceeds to a step S72, and decides whether the recording-side mode is set to the one-side recording mode or the two-sided recording mode. If the recording-side mode is set to the one-side recording mode, the processing unit 60 proceeds to a step S73, and sets the nozzle number to Na1. If it is ascertained at the step S72 that the recording-side mode is set to the two-sided recording mode, the processing unit 60 proceeds to a step S74, and sets the nozzle number to Nb1 that is smaller than Na1 (Nb1<Na1).

If it is ascertained at the step S71 that the recording-priority mode is set to the recording-quality priority mode, the processing unit 60 proceeds to a step S75, and decides whether the recording-side mode is set to the one-side recording mode or the two-sided recording mode. If the recording-side mode is set to the one-side recording mode, the processing unit 60 proceeds to a step S76, and sets the nozzle number to Na2 that is smaller than Na1 (Na2<Na1). If it is ascertained at the step S75 that the recording-side mode is set to the two-sided recording mode, the processing unit 60 proceeds to a step S77, and sets the nozzle number to Nb2 that is smaller than Na2 (Nb2<Na2). After setting the nozzle number as described above, the image-recording device 1 records an image on one side or images on both sides of the sheet 3 by discharging ink from the nozzles attached to the recording head 14.

Figure 26:
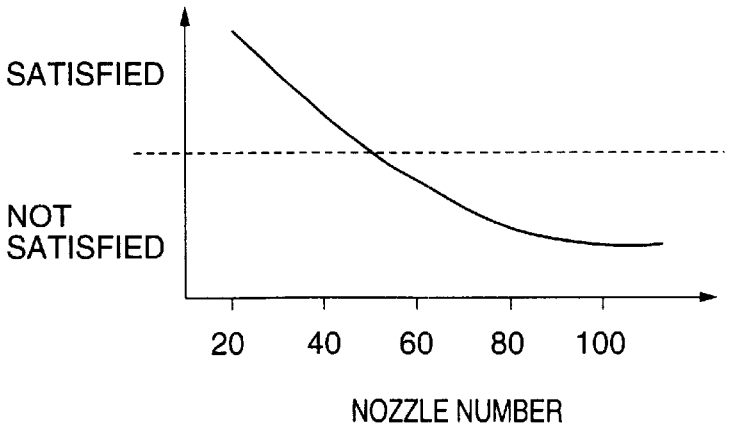
FIG. 26 is a diagram showing relation between the nozzle number and the recording speed of the image-recording device.
Figure 27:
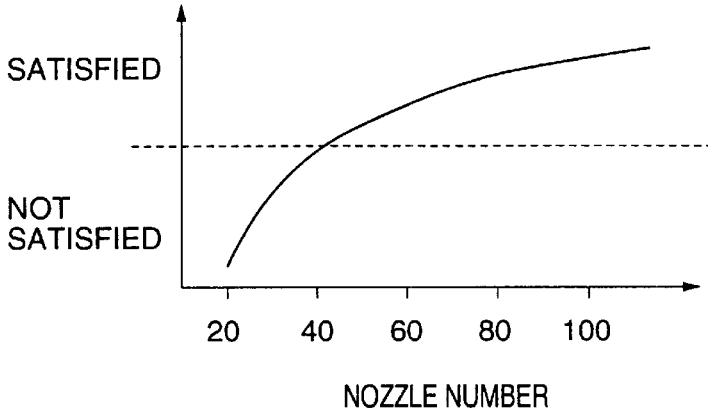
FIG. 27 is a diagram showing relation between the nozzle number and quality of the image recorded by the image-recording device.

FIG. 26 shows a relation between the nozzle number and a subjective sense of satisfaction for the recording speed of the image-recording device 1. Additionally, FIG. 27 shows a relation between the nozzle number and a subjective sense of satisfaction for the recording quality of an image on the sheet 3. FIGS. 26 and 27 are created with data taken from enough number of experiments for the relation between the nozzle number and the sense of satisfaction for the recording speed and the recording quality. As shown in FIGS. 26 and 27, when the nozzle number is greater than or equal to "40", the recording speed is fulfilled. Additionally, if the nozzle number is less than or equal to "50", the recording quality is fulfilled. Accordingly, the decreasing order of the nozzle numbers Na1, Na2, Nb1 and Nb2 are preferably set to Na1>Nb1>Na2>Nb2.

For instance, in the recording-speed priority mode, the nozzle number Na1 for the one-side recording mode is set to "128", and the nozzle number Nb1 for the two-sided recording mode is set to "64". Additionally in the recording-quality priority mode, the nozzle number Na2 for the one-side recording mode is set to "32", and the nozzle number Nb2 for the two-sided recording mode is set to "16". The recording speed is fulfilled in the recording-speed priority mode, and the recording quality is fulfilled in the recording-quality mode according to evaluation of the integers given for each of the nozzle numbers Na1, Na2, Nb1 and Nb2.

According to the second example of the nozzle-number setting process, by altering the nozzle number depending on the recording-side mode, the image-recording device 1 can record an image on one side of the sheet 3 in the one-side recording mode or images on both sides of the sheet 3 in the two-sided recording mode with the recording speed and the recording quality requested by the control panel 8 of the image-recording device 1 or by the printer driver 101 in the host 100.

A description will now be given of a third example of the nozzle-number setting process taken by the processing unit 60 in the control unit with reference to FIG. 28.

Figure 28:
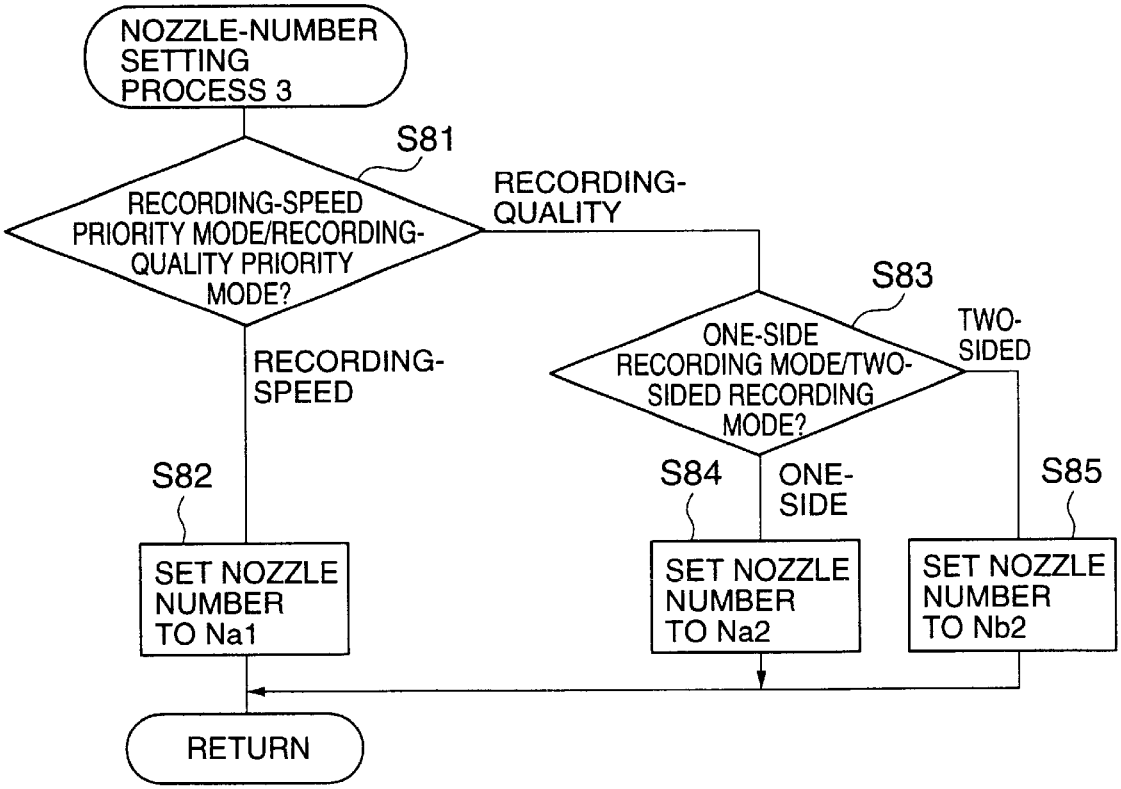
FIG. 28 is a flowchart for describing a third example of the nozzle-number setting process according to the second embodiment of the present invention.

The processing unit 60 in the control unit of the image-recording device 1 decides whether the recording-priority mode is the recording-speed priority mode or the recording-quality priority mode at a step S81 of FIG. 28. If the recording-priority mode is set to the recording-speed priority mode, the processing unit 60 proceeds to a step S82, and sets the nozzle number to Na1. If it is ascertained at the step S81 that the recording-priority mode is set to the recording-quality priority mode, the processing unit 60 proceeds to a step S83, and decides whether the recording-side mode is set to the one-side recording mode or the two-sided recording mode. If the recording-side mode is set to the one-side recording mode, the processing unit 60 proceeds to a step S84, and sets the nozzle number to Na2 that is smaller than Na1 (Na2<Na1). If it is ascertained at the step S83 that the recording-side mode is set to the two-sided recording mode, the processing unit 60 proceeds to a step S85, and sets the nozzle number to Nb2 that is smaller than Na2 (Nb2<Na2). After setting the nozzle number as described above, the image-recording device 1 records an image on one side or images on both sides of the sheet 3 by discharging ink onto the sheet 3 from the nozzles attached to the recording head 14.

As described above, the nozzle numbers for the one-side recording mode and the two-sided recording mode in the recording-speed priority mode are set to Na1 so that the image-recording device 1 can set the recording-speed to its first priority. For instance, in the recording-speed priority mode, the nozzle number Na1 for the one-side recording mode and the two-sided recording mode is set to "128". Additionally in the recording-quality priority mode, the nozzle number Na2 for the one-side recording mode is set to "32", and the nozzle number Nb2 for the two-sided recording mode is set to "16". The recording speed is more fulfilled than the recording speed in the second example of the nozzle-number setting process in the recording-speed priority mode, and the recording quality is fulfilled as much as the recording quality in the second example of the nozzle-number setting process in the recording-quality mode according to evaluation of the integers given for each of the nozzle numbers Na1, Na2 and Nb2.

According to the third example of the nozzle-number setting process, by setting the nozzle numbers for the one-side recording mode and the two-sided recording mode to be same in the recording-speed priority mode, the image-recording device 1 can record images on both sides of the sheet 3 in the recording-speed priority mode with higher recording speed than that of the second example of the nozzle-number setting process.

A description will now be given of a fourth example of the nozzle-number setting process taken by the processing unit 60 in the control unit with reference to FIG. 29.

Figure 29:
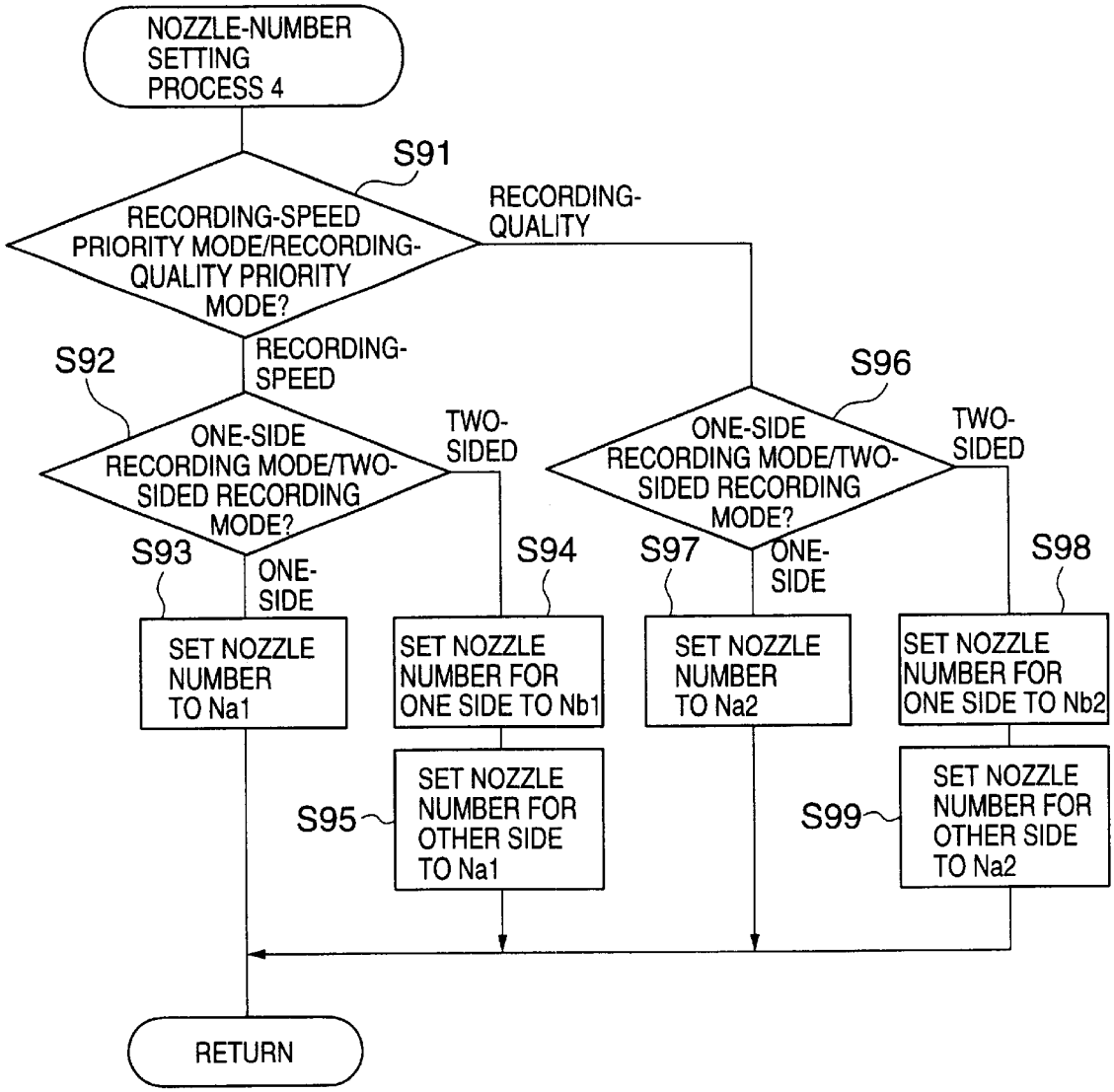
FIG. 29 is a flowchart for describing a fourth example of the nozzle-number setting process according to the second embodiment of the present invention.

The processing unit 60 in the control unit of the image-recording device 1 decides whether the recording-priority mode is the recording-speed priority mode or the recording-quality priority mode at a step S91 of FIG. 29. If the recording-priority mode is set to the recording-speed priority mode, the processing unit 60 proceeds to a step S92, and decides whether the recording-side mode is set to the one-side recording mode or the two-sided recording mode. If the recording-side mode is set to the one-side recording mode, the processing unit 60 proceeds to a step S93, and sets the nozzle number to Na1. If it is ascertained at the step S92 that the recording-side mode is set to the two-sided recording mode, the processing unit 60 proceeds to a step S94, and sets the nozzle number for recording an image on one side of the sheet 3 to Nb1 that is smaller than Na1 (Nb1<Na1). Subsequently, the processing unit 60 sets the nozzle number for recording an image on the other side of the sheet 3 to Na1 at a step S95.

If it is ascertained at the step S91 that the recording-priority mode is set to the recording-quality priority mode, the processing unit 60 proceeds to a step S96, and decides whether the recording-side mode is set to the one-side recording mode or the two-sided recording mode. If the recording-side mode is set to the one-side recording mode, the processing unit 60 proceeds to a step S97, and sets the nozzle number to Na2 that is smaller than Na1 (Na2<Na1). If it is ascertained at the step S56 that the recording-side mode is set to the two-sided recording mode, the processing unit 60 proceeds to a step S98, and sets the nozzle number for recording an image on one side of the sheet 3 to Nb2 that is smaller than Na2 (Nb2<Na2). Subsequently, the processing unit 60 sets the nozzle number for recording an image on the other side of the sheet 3 to Na2 at a step S99. After setting the nozzle number as described above, the image-recording device 1 records an image on one side or images on both sides of the sheet 3 by discharging ink onto the sheet 3 from the nozzles attached to the recording head 14.

For instance, in the recording-speed priority mode, the nozzle number Na1 for the one-side recording mode and for recording an image on the other side of the sheet 3 in the two-sided recording mode is set to "128", and the nozzle number Nb1 for recording an image on one side of the sheet 3 in the two-sided recording mode is set to "64". Additionally in the recording-quality priority mode, the nozzle number Na2 for the one-side recording mode and for recording an image on the other side of the sheet 3 in the two-sided recording mode is set to "32", and the nozzle number Nb2 for recording an image on one side of the sheet 3 in the two-sided recording mode is set to "16".

The recording speed of the image-recording device 1 is more fulfilled than the recording speeds in the second example and in the third example of the nozzle-number setting process in the two-sided recording mode according to evaluation of the integers given for each of the nozzle numbers Na1, Na2, Nb1 and Nb2.

According to the fourth example of the nozzle-number setting process, by setting the nozzle number for recording an image on the other side of the sheet 3 different from the nozzle number for recording an image on one side of the sheet 3 in the two-sided recording mode, the image-recording device 1 can record images on both sides of the sheet 3 in the two-sided recording mode with the higher recording speed than that of the second example of the nozzle-number setting process and that of the third example of the nozzle-number setting process.

A description will now be given of a first example of a drive-frequency setting process according to a third embodiment of the present invention that is taken by the processing unit 60 in the control unit depending on the recording-side mode of the image-recording device 1 that is either the one-side recording mode or the two-sided recording mode, with reference to FIG. 30 through FIG. 35.

Figure 31:
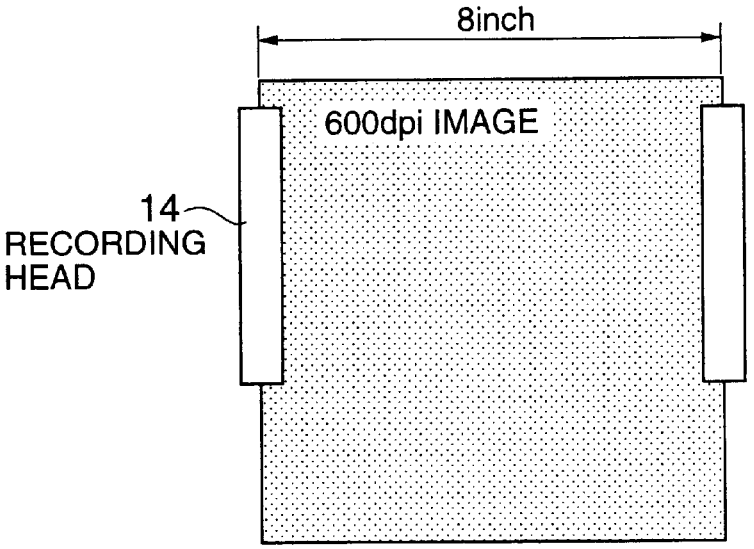
FIG. 31 is a diagram showing a path that the recording head takes to record a certain image.

When the image-recording device 1 records a 600 dpi image on the sheet 3 as shown in FIG. 31, relation between the drive frequency of the recording head 14 and a period for the recording head 14 to move one path (a path time) can be described as shown in FIG. 32. If the image-recording device 1 records the 600 dpi image with lower drive frequency, the period taken for the image-recording device 1 to move its recording head 14 for one path becomes longer.

Figure 33:
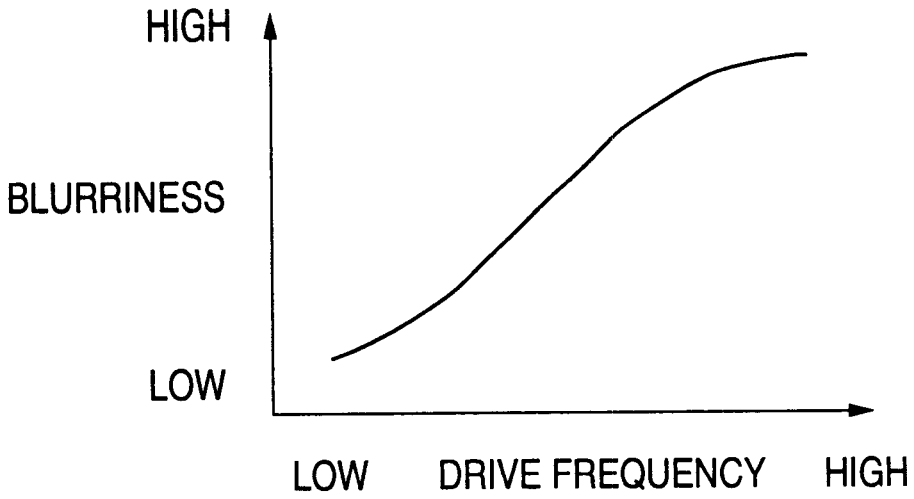
FIG. 33 is a diagram showing relation between the drive frequency and blurriness of the image recorded on one side of the sheet 3 seen from the other side of the sheet 3.
Figure 34:
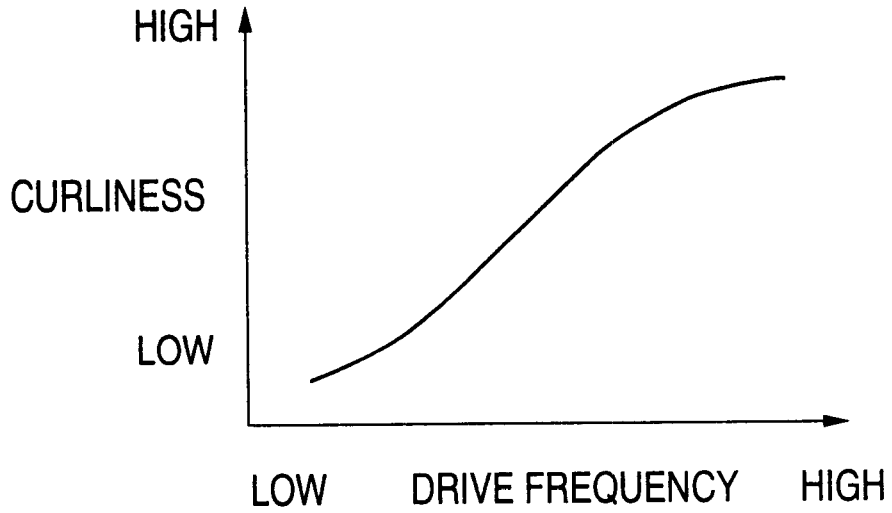
FIG. 34 is a diagram showing relation between the drive frequency and curliness of the sheet 3.
Figure 35:
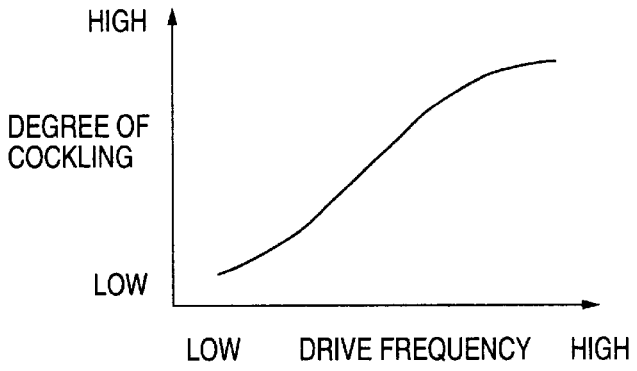
FIG. 35 is a diagram showing relation between the drive frequency and the degree of cockling of the sheet 3.

FIGS. 33, 34 and 35 show respectively relation between the drive frequency and the blurriness of an image recorded on one side of the sheet 3 seen from the other side, relation between the drive frequency and the curliness of the sheet 3, and relation between the drive frequency and the degree of cockling of the sheet 3. As seen from FIGS. 33, 34 and 35, the lower the drive frequency is, the lower the blurriness, the curliness, the degree of cockling are. Accordingly, the lower the drive frequency is, the higher the image quality is.

Figure 30:
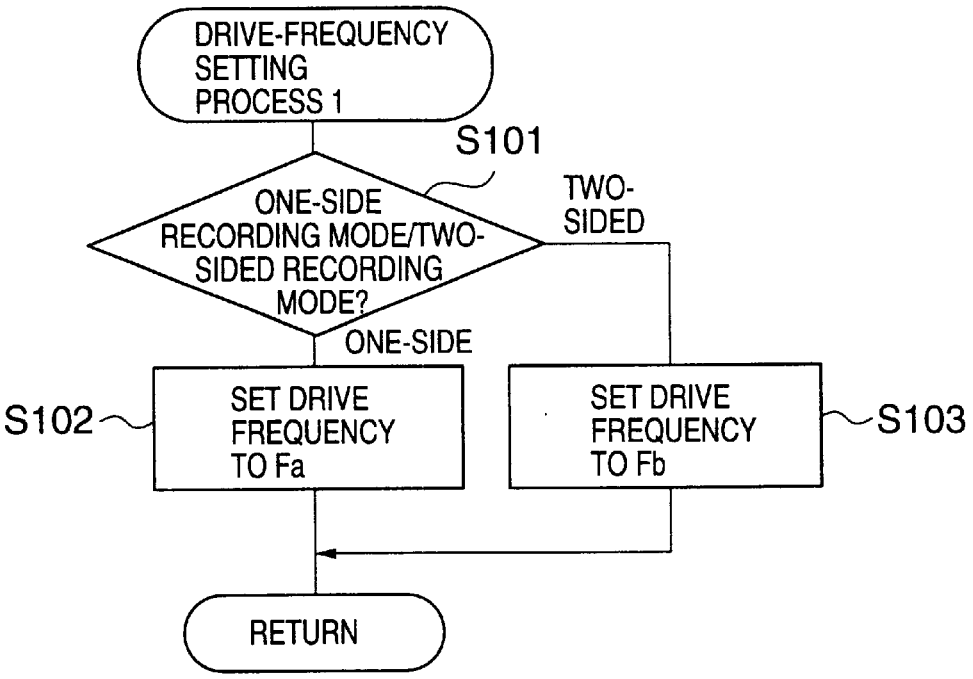
FIG. 30 is a flowchart for describing a first example of a drive-frequency setting process according to a third embodiment of the present invention.

The processing unit 60 in the control unit executes the drive-frequency setting process preceding an image recording on the sheet 3. In FIG. 30, the processing unit 60 decides whether the recording-side mode is set to the one-side recording mode or the two-sided recording mode at a step S101. If it is ascertained at the step S101 that the recording-side mode is set to the one-side recording mode, the processing unit 60 proceeds to a step S102, and sets the drive frequency to Fa. If it is ascertained at the step S101 that the recording-side mode is set to the two-sided recording mode, the processing unit 60 proceeds to a step S103, and sets the drive frequency to Fb that is lower than Fa (Fb<Fa). After setting the drive frequency, the image-recording device 1 records an image on one side of the sheet 3 or images on both sides of the sheet 3 by discharging ink onto the sheet 3 from the nozzles attached to the recording head 14 with the drive frequency set at the step S102 or the step S103.

In the two-sided recording mode, there is a case that recording an image on the other side becomes difficult after having an image on one side of the sheet 3 blurred and the sheet 3 curled or cockled. Therefore, by setting the drive frequency Fb for the two-sided recording mode lower than the drive frequency Fa for the one-side recording mode, the image-recording device 1 can prevent the blurriness of the image on one side of the sheet 3, the curliness and the degree of cockling of the sheet 3 when recording the image on one side of the sheet 3 so that an image can be recorded on the other side of the sheet 3 with higher image quality.

Accordingly, the image-recording device 1 can record an image on one side of the sheet 3 or images on both sides of the sheet 3 with higher image quality by setting the drive frequency to an appropriate number depending on the one-side recording mode or the two-sided recording mode.

A description will now be given of a second example of the drive-frequency setting process taken by the processing unit 60 in the control unit with reference to FIGS. 36, 37 and 38.

When the image-recording device 1 records an image on the sheet 3, if recording speed of the image-recording device 1 increases, quality of the image recorded on the sheet 3 generally decreases. On the other hand, if the recording speed of the image-recording device 1 decreases, quality of the image recorded on the sheet 3 increases. Accordingly, in the second example of the drive-frequency setting process, a recording-priority mode that is either a recording-speed priority mode or a recording-quality priority mode is provided to the image-recording device 1.

In the recording-speed priority mode, the processing unit 60 sets the recording speed of the image-recording device 1 to take priority over quality of the image recorded on the sheet 3. Additionally, in the recording-quality priority mode, the processing unit 60 sets the recording quality of the image on the sheet 3 to take priority over the recording speed of the image-recording device 1. The recording-priority mode is selected by the control panel 8 of the image-recording device 1 or by the printer driver 101 located in the host 100.

Figure 36:
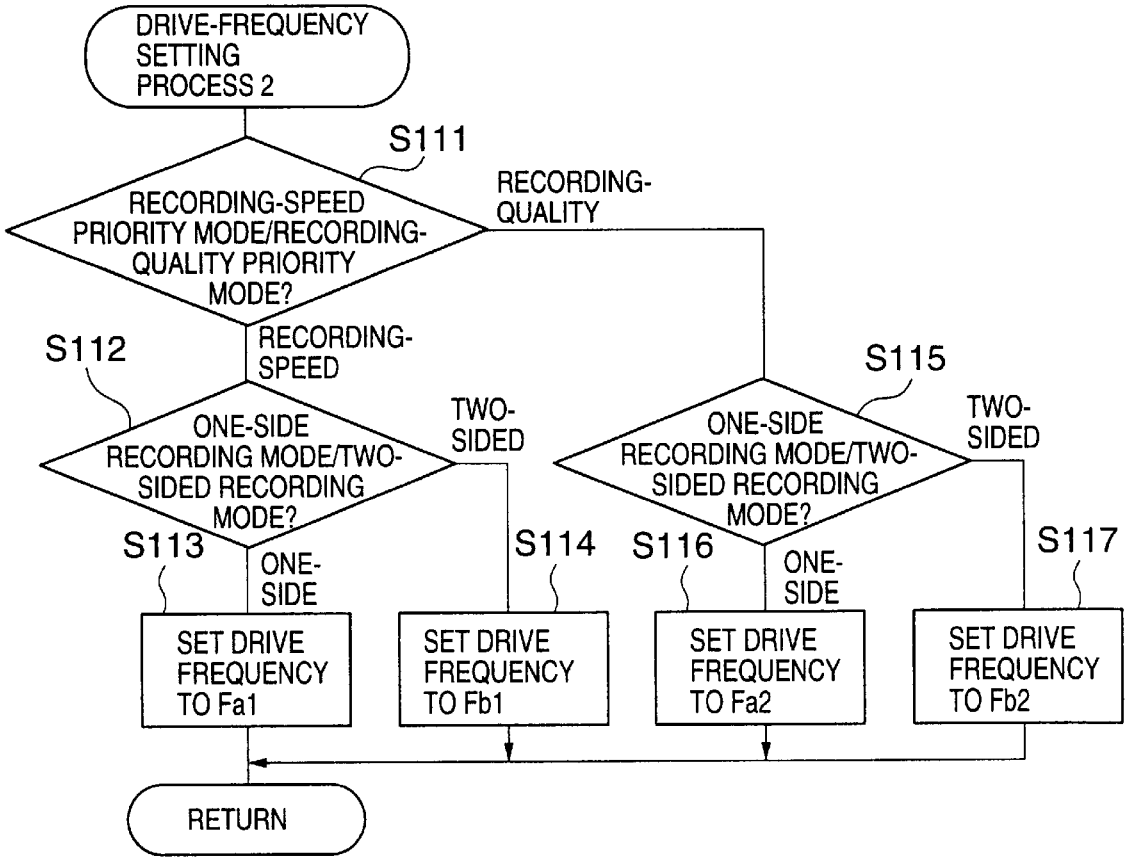
FIG. 36 is a flowchart for describing a second example of the drive-frequency setting process according to the third embodiment of the present invention.

The processing unit 60 in the control unit of the image-recording device 1 decides whether the recording-priority mode is the recording-speed priority mode or the recording-quality priority mode at a step S111 of FIG. 36. If the recording-priority mode is set to the recording-speed priority mode, the processing unit 60 proceeds to a step S112, and decides whether the recording-side mode is set to the one-side recording mode or the two-sided recording mode. If the recording-side mode is set to the one-side recording mode, the processing unit 60 proceeds to a step S113, and sets the drive frequency to Fa1. If it is ascertained at the step S112 that the recording-side mode is set to the two-sided recording mode, the processing unit 60 proceeds to a step S114, and sets the drive frequency to Fb1 that is lower than Fa1 (Fb1<Fa1).

If it is ascertained at the step S111 that the recording-priority mode is set to the recording-quality priority mode, the processing unit 60 proceeds to a step S115, and decides whether the recording-side mode is set to the one-side recording mode or the two-sided recording mode. If the recording-side mode is set to the one-side recording mode, the processing unit 60 proceeds to a step S116, and sets the drive frequency to Fa2 that is lower than Fa1 (Fa2<Fa1). If it is ascertained at the step S115 that the recording-side mode is set to the two-sided recording mode, the processing unit 60 proceeds to a step S117, and sets the drive frequency to Fb2 that is lower than Fa2 (Fb2<Fa2). After setting the drive frequency as described above, the image-recording device 1 records an image on one side or images on both sides of the sheet 3 by discharging ink from the nozzles attached to the recording head 14 with the drive frequency set at the above-described steps.

Figure 37:
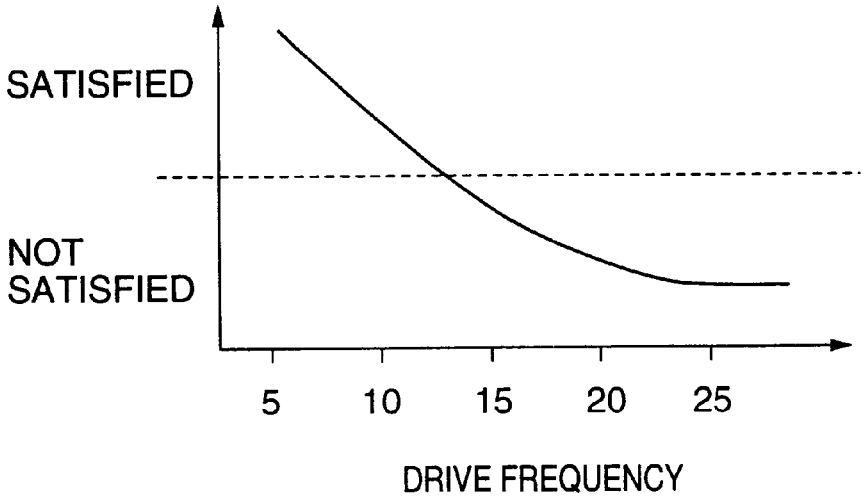
FIG. 37 is a diagram showing relation between the drive frequency and the recording speed of the image-recording device.
Figure 38:
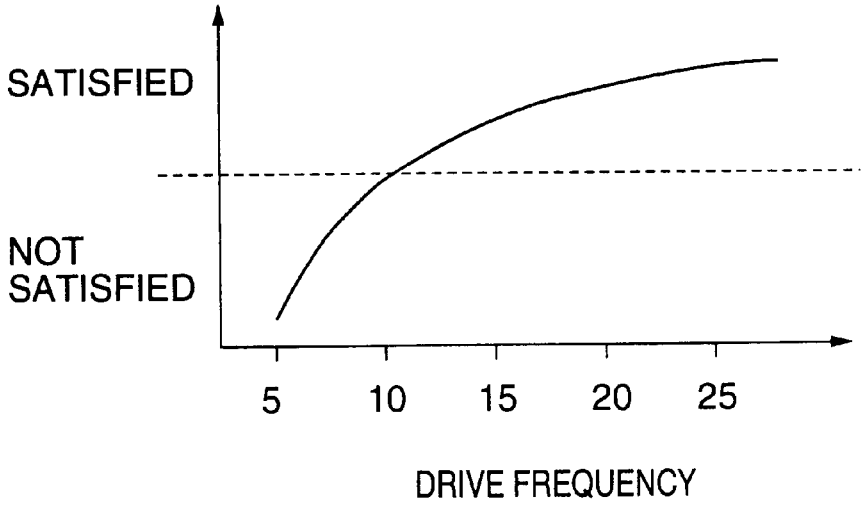
FIG. 38 is a diagram showing relation between the drive frequency and quality of the image recorded by the image-recording device.

FIG. 37 shows a relation between the drive frequency and a subjective sense of satisfaction for the recording speed of the image-recording device 1. Additionally, FIG. 38 shows a relation between the drive frequency and a subjective sense of satisfaction for the recording quality of an image on the sheet 3. FIGS. 37 and 38 are created with data taken from enough number of experiments for the relation between the drive frequency and the sense of satisfaction for the recording speed and the recording quality. As shown in FIGS. 37 and 38, when the drive frequency is greater than or equal to 10 kHz, the recording speed is fulfilled. Additionally, if the drive frequency is less than or equal to 12 kHz, the recording quality is fulfilled. Accordingly, the decreasing order of the drive frequencies Fa1, Fa2, Fb1 and Fb2 are preferably set to Fa1>Fb1>Fa2>Fb2.

For instance, in the recording-speed priority 5 mode, the drive frequency Fa1 for the one-side recording mode is set to 20 kHz, and the drive frequency Fb1 for the two-sided recording mode is set to 10 kHz. Additionally in the recording-quality priority mode, the drive frequency Fa2 for the one-side recording mode is set to 10 kHz, and the drive frequency Fb2 for the two-sided recording mode is set to 5 kHz. The recording speed is fulfilled in the recording-speed priority mode, and the recording quality is fulfilled in the recording-quality mode according to evaluation of the integers given for each of the drive frequencies Fa1, Fa2, Fb1 and Fb2.

According to the second example of the drive-frequency setting process, by altering the drive frequency of the recording head 14 depending on the recording-side mode, the image-recording device 1 can record an image on one side of the sheet 3 in the one-side recording mode or images on both sides of the sheet 3 in the two-sided recording mode with the recording speed and the recording quality requested by the control panel 8 of the image-recording device 1 or by the printer driver 101 in the host 100.

A description will now be given of a third example of a drive-frequency setting process taken by the processing unit 60 in the control unit with reference to FIG. 39.

Figure 39:
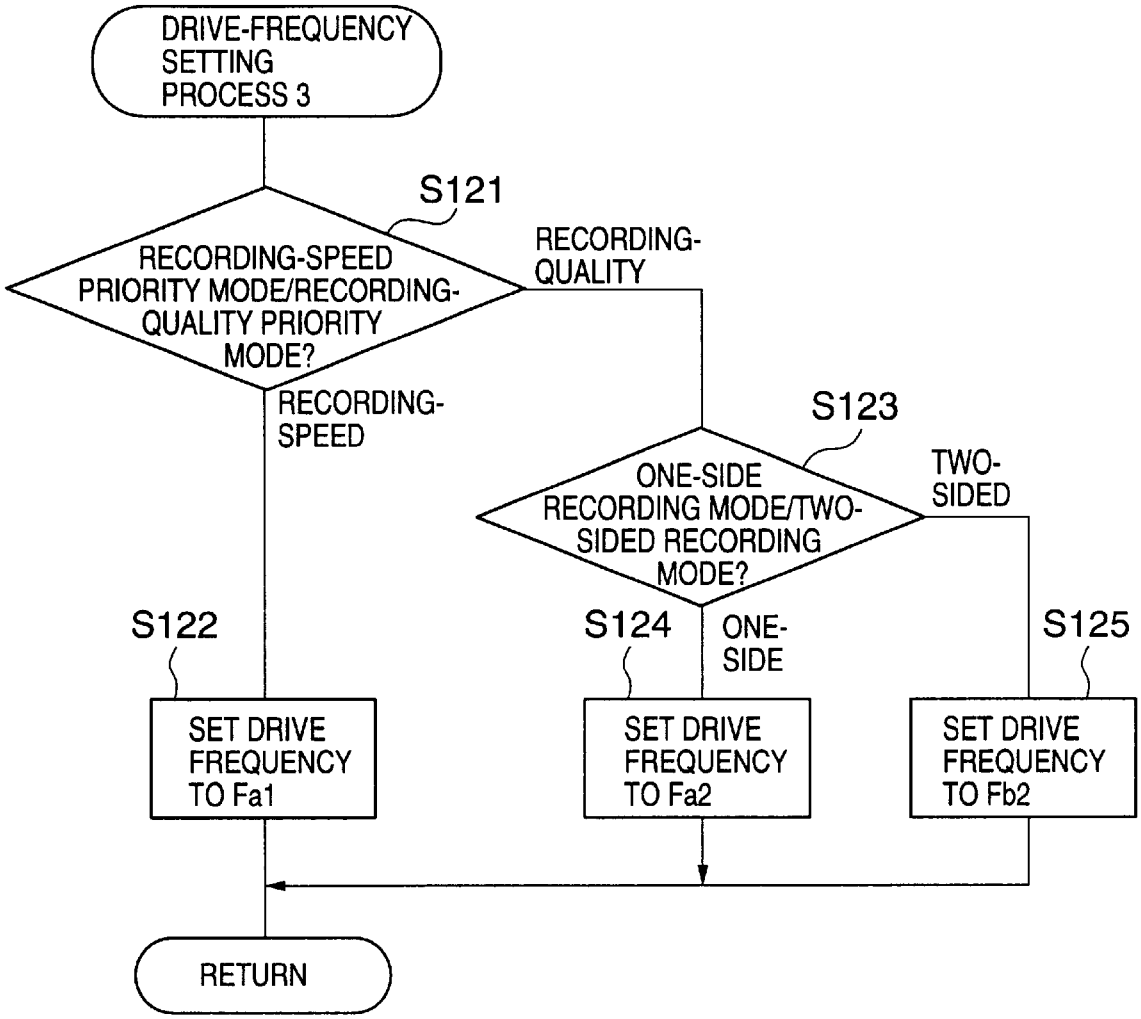
FIG. 39 is a flowchart for describing a third example of the drive-frequency setting process according to the third embodiment of the present invention.

The processing unit 60 in the control unit of the image-recording device 1 decides whether the recording-priority mode is the recording-speed priority mode or the recording-quality priority mode at a step S121 of FIG. 39. If the recording-priority mode is set to the recording-speed priority mode, the processing unit 60 proceeds to a step S122, and sets the drive frequency to Fa1. If it is ascertained at the-step S121 that the recording-priority mode is set to the recording-quality priority mode, the processing unit 60 proceeds to a step S123, and decides whether the recording-side mode is set to the one-side recording mode or the two-sided recording mode. If the recording-side mode is set to the one-side recording mode, the processing unit 60 proceeds to a step S124, and sets the drive frequency to Fa2 that is lower than Fa1 (Fa2<Fa1). If it is ascertained at the step S123 that the recording-side mode is set to the two-sided recording mode, the processing unit 60 proceeds to a step S125, and sets the drive frequency to Fb2 that is lower than Fa2 (Fb2<Fa2). After setting the drive frequency as described above, the image-recording device 1 records an image on one side or images on both sides of the sheet 3 by discharging ink onto the sheet 3 from the nozzles attached to the recording head 14 with the drive frequency set at the above-described steps.

As described above, the drive frequencies for the one-side recording mode and the two-sided recording mode in the recording-speed priority mode are set to Fa1 so that the image-recording device 1 can set the recording-speed to its first priority. For instance, in the recording-speed priority mode, the drive frequency Fa1 for the one-side recording mode and the two-sided recording mode is set to 20 kHz. Additionally in the recording-quality priority mode, the drive frequency Fa2 for the one-side recording mode is set to 10 kHz, and the drive frequency Fb2 for the two-sided recording mode is set to 5 kHz. The recording speed is more fulfilled than the recording speed in the second example of the drive-frequency setting process in the recording-speed priority mode, and the recording quality is fulfilled as much as the recording quality in the second example of the drive-frequency setting process in the recording-quality mode according to evaluation of the integers given for each of the drive frequencies Fa1, Fa2 and Fb2.

According to the third example of the drive-frequency setting process, by setting the drive frequencies for the one-side recording mode and the two-sided recording mode to be same in the recording-speed priority mode, the image-recording device 1 can record images on both sides of the sheet 3 in the recording-speed priority mode with higher recording speed than that of the second example of the drive-frequency setting process.

A description will now be given of a fourth example of a drive-frequency setting process taken by the processing unit 60 in the control unit with reference to FIG. 40.

Figure 40:
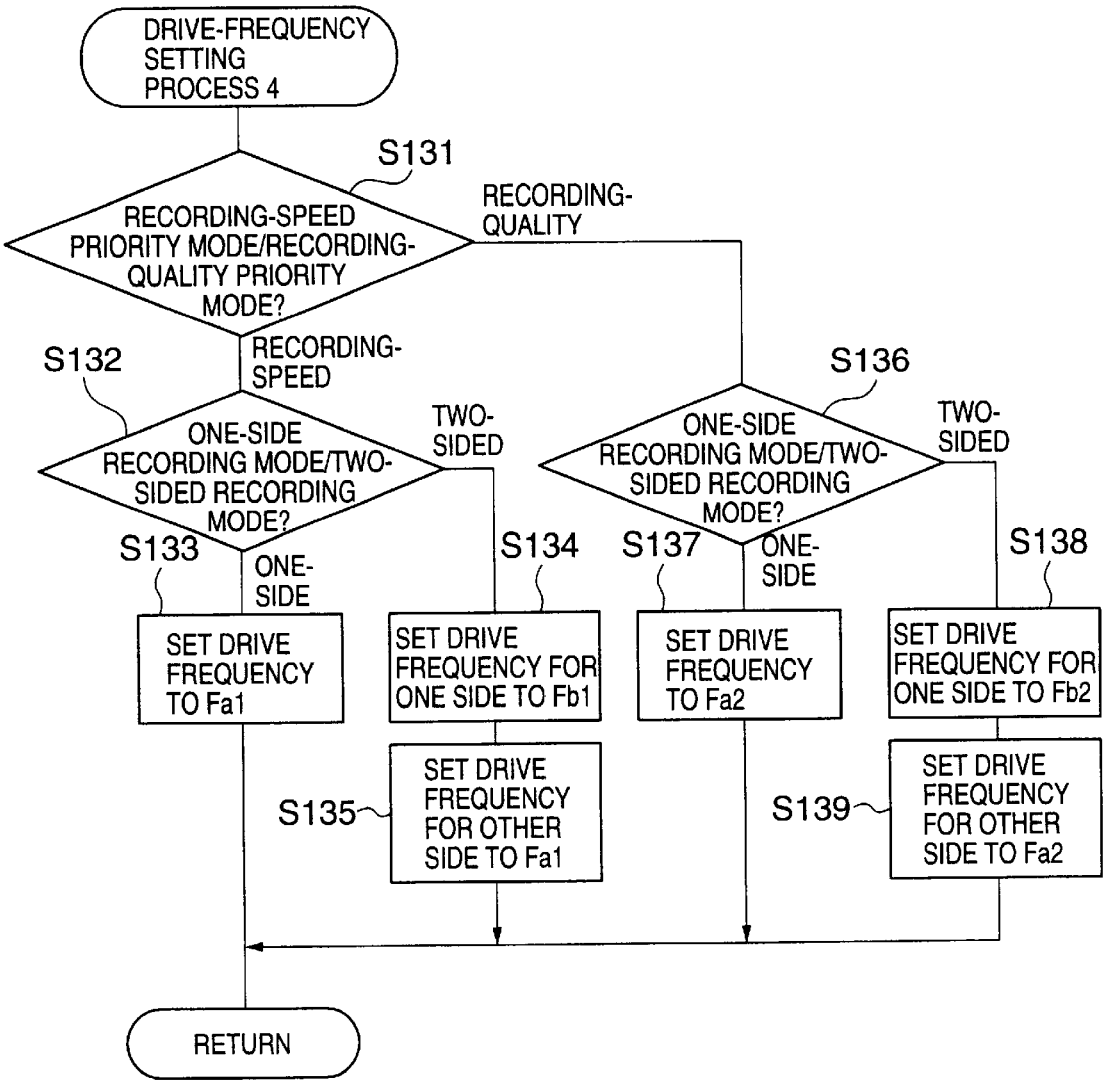
FIG. 40 is a flowchart for describing a fourth example of the drive-frequency setting process according to the third embodiment of the present invention.

The processing unit 60 in the control unit of the image-recording device 1 decides whether the recording-priority mode is the recording-speed priority mode or the recording-quality priority mode at a step S131 of FIG. 40. If the recording-priority mode is set to the recording-speed priority mode, the processing unit 60 proceeds to a step S132, and decides whether the recording-side mode is set to the one-side recording mode or the two-sided recording mode. If the recording-side mode is set to the one-side recording mode, the processing unit 60 proceeds to a step S133, and sets the drive frequency to Fa1. If it is ascertained at the step S132 that the recording-side mode is set to the two-sided recording mode, the processing unit 60 proceeds to a step S134, and sets the drive frequency for recording an image on one side of the sheet 3 to Fb 1 that is lower than Fa1 (Fb1<Fa1). Subsequently, the processing unit 60 sets the drive frequency for recording an image on the other side of the sheet 3 to Fa1 at a step S135.

If it is ascertained at the step S131 that the recording-priority mode is set to the recording-quality priority mode, the processing unit 60 proceeds to a step S136, and decides whether the recording-side mode is set to the one-side recording mode or the two-sided recording mode. If the recording-side mode is set to the one-side recording mode, the processing unit 60 proceeds to a step S137, and sets the drive frequency to Fa2 that is lower than Fa1 (Fa2<Fa1). If it is ascertained at the step S136 that the recording-side mode is set to the two-sided recording mode, the processing unit 60 proceeds to a step S138, and sets the drive frequency for recording an image on one side of the sheet 3 to Fb2 that is lower than Fa2 (Fb2<Fa2). Subsequently, the processing unit 60 sets the drive frequency for recording an image on the other side of the sheet 3 to Fa2 at a step S139. After setting the drive frequency as described above, the image-recording device 1 records an image on one side or images on both sides of the sheet 3 by discharging ink onto the sheet 3 from the nozzles attached to the recording head 14 with the drive frequency set at the above-described steps.

For instance, in the recording-speed priority mode, the drive frequency Fa1 for the one-side recording mode and for recording an image on the other side of the sheet 3 in the two-sided recording mode is set to 20 kHz, and the drive frequency Fb1 for recording an image on one side of the sheet 3 in the two-sided recording mode is set to 10 kHz. Additionally in the recording-quality priority mode, the drive frequency Fa2 for the one-side recording mode and for recording an image on the other side of the sheet 3 in the two-sided recording mode is set to 10 kHz, and the drive frequency Fb2 for recording an image on one side of the sheet 3 in the two-sided recording mode is set to 5 kHz.

The recording speed of the image-recording device 1 is more fulfilled than the recording speeds in the second example and in the third example of the drive-frequency setting process in the two-sided recording mode according to evaluation of the integers given for each of the drive frequencies Fa1, Fa2, Fb1 and Fb2.

According to the fourth example of the drive-frequency setting process, by setting the drive frequency for recording an image on the other side of the sheet 3 different from the drive frequency for recording an image on one side of the sheet 3 in the two-sided recording mode, the image-recording device 1 can record images on both sides of the sheet 3 in the two-sided recording mode with the higher recording speed than that of the second example of the drive-frequency setting process and that of the third example of the drive-frequency setting process.

A description will now be given of a first example of a dot-number setting process according to a fourth embodiment of the present invention that is taken by the processing unit 60 in the control unit depending on the recording-side mode of the image-recording device 1 that is either the one-side recording mode or the two-sided recording mode, with reference to FIG. 41 through FIG. 45.

Figures 41, 42:
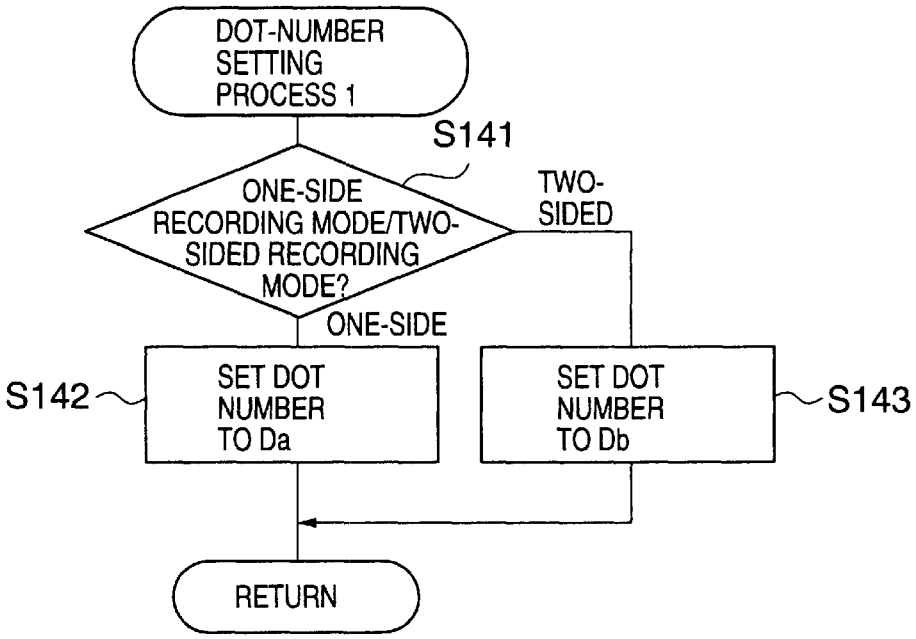
FIG. 41 is a flowchart for describing a first example of a dot-number setting process according to a fourth embodiment of the present invention.
FIG. 42 is a table showing a level number and its corresponding dot number.
Figure 43:
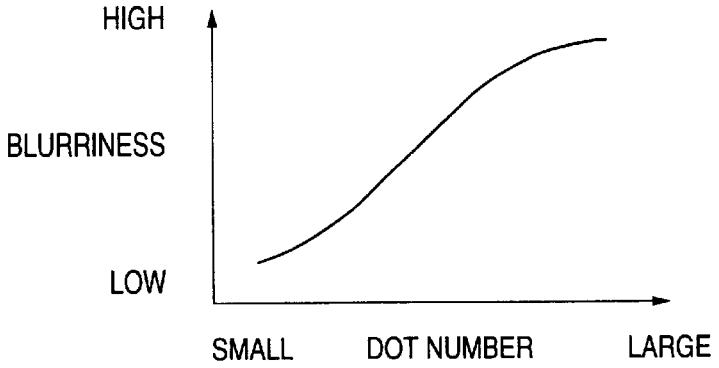
FIG. 43 is a diagram showing relation between the dot number and blurriness of the image recorded on one side of the sheet 3 seen from the other side of the sheet 3.
Figure 44:
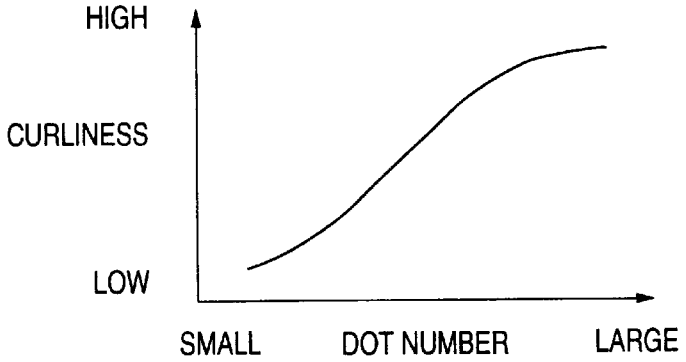
FIG. 44 is a diagram showing relation between the dot number and curliness of the sheet 3.
Figure 45:
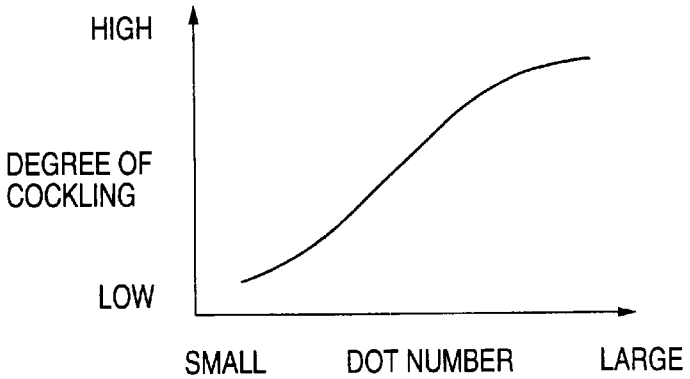
FIG. 45 is a diagram showing relation between the dot number and the degree of cockling of the sheet 3.

A dot number is a maximum number of dots discharged in an area unit of an image recorded on the sheet 3 by the nozzles attached to the recording head 14 of the image-recording device 1. FIG. 42 shows levels 1 though 8 and the corresponding maximum number of dots discharged on a surface of an A4-sized sheet. FIGS. 43, 44 and 45 show respectively relation between the dot number and the blurriness of an image recorded on one side of the sheet 3 seen from the other side, relation between the dot number and the curliness of the sheet 3, and relation between the dot number and the degree of cockling of the sheet 3. As seen from FIGS. 43, 44 and 45, the lower the dot number is, the lower the blurriness, the curliness, the degree of cockling are. Accordingly, the lower the dot number is, the higher the image quality is.

The processing unit 60 in the control unit executes the dot-number setting process preceding an image recording on the sheet 3. In FIG. 41, the processing unit 60 decides whether the recording-side mode is set to the one-side recording mode or the two-sided recording mode at a step S141. If it is ascertained at the step S141 that the recording-side mode is set to the one-side recording mode, the processing unit 60 proceeds to a step S142, and sets the dot number to Da. If it is ascertained at the step S141 that the recording-side mode is set to the two-sided recording mode, the processing unit 60 proceeds to a step S143, and sets the dot number to Db that is smaller than Da (Db<Da). After setting the dot number, the image-recording device 1 records an image on one side of discharging ink onto the sheet 3 from the nozzles attached to the recording head 14 with the dot number set at the step S142 or the step S143.

In the two-sided recording mode, there is a case that recording an image on the other side becomes difficult after having an image on one side of the sheet 3 blurred and the sheet 3 curled or cockled. Therefore, by setting the dot number Db for the two-sided recording mode lower than the dot number Da for the one-side recording mode, the image-recording device 1 can prevent the blurriness of the image on one side of the sheet 3, the curliness and the degree of cockling of the sheet 3 when recording the image on one side of the sheet 3 so that an image can be recorded on the other side of the sheet 3 with higher image quality.

Accordingly, the image-recording device 1 can record an image on one side of the sheet 3 or images on both sides of the sheet 3 with higher image quality by setting the dot number to an appropriate number depending on the one-side recording mode or the two-sided recording mode.

In the following second, third and fourth examples of the dot-number setting process, by ignoring the blurriness of an image recorded on one side of the sheet 3 seen from the other side, and the curliness and sheet 3 seen from the other side, and the curliness and the degree of cockling of the sheet 3, recording speed of the image-recording device 1 generally decreases, and recording quality of an image on the sheet 3 generally increases as the dot number increases.

A description will now be given of a second example of the dot-number setting process taken by the processing unit 60 in the control unit with reference to FIGS. 46, 47 and 48.

When the image-recording device 1 records an image on the sheet 3, if the recording speed of the image-recording device 1 increases, the quality of the image recorded on the sheet 3 generally decreases. On the other hand, if the recording speed of the image-recording device 1 decreases, the quality of the image recorded on the sheet 3 increases. Accordingly, in the second example of the dot-number setting process, a recording-priority mode that is either a recording-speed priority mode or a recording-quality priority mode is provided to the image-recording device 1.

In the recording-speed priority mode, the processing unit 60 sets the recording speed of the image-recording device 1 to take priority over the quality of the image recorded on the sheet 3. Additionally, in the recording-quality priority mode, the processing unit 60 sets the recording quality of the image on the sheet 3 to take priority over the recording speed of the image-recording device 1. The recording-priority mode is selected by the control panel 8 of the image-recording device 1 or by the printer driver 101 located in the host 100.

Figure 46:
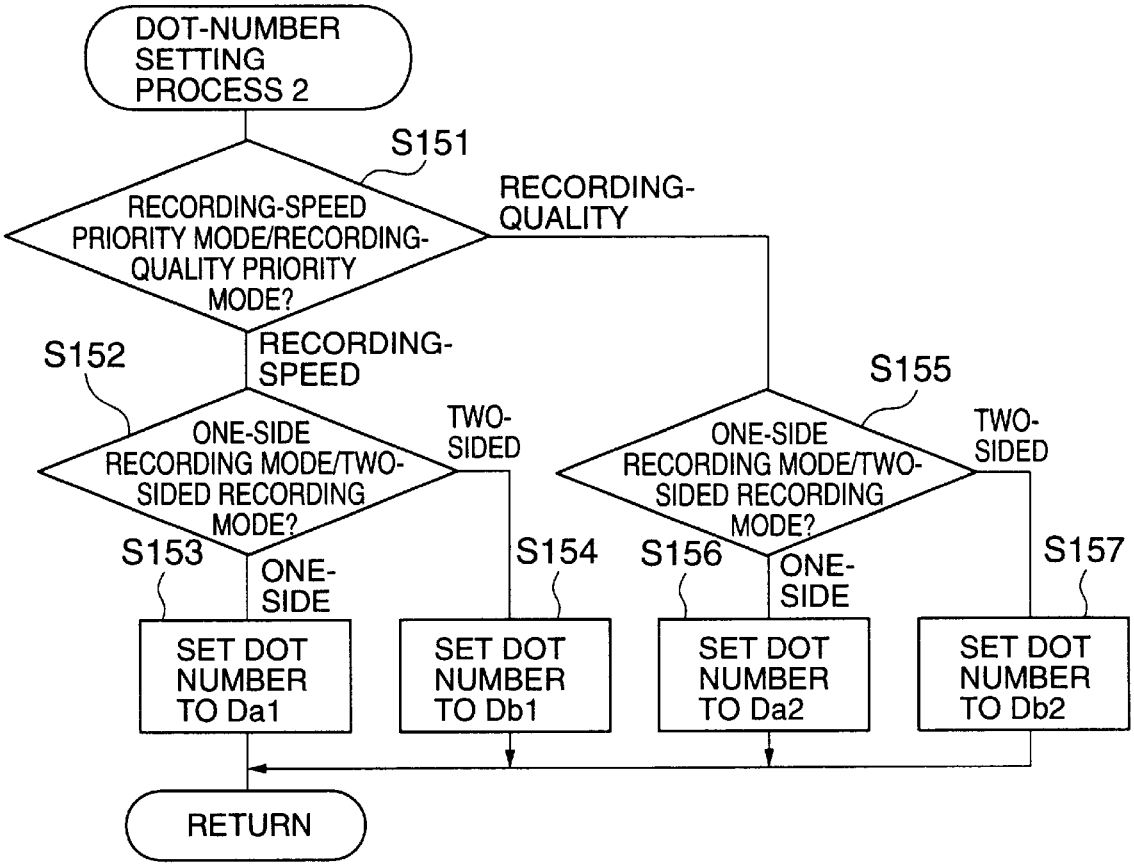
FIG. 46 is a flowchart for describing a second example of the dot-number setting process according to the fourth embodiment of the present invention.

The processing unit 60 in the control unit of the image-recording device 1 decides whether the recording-priority mode is the recording-speed priority mode or the recording-quality priority mode at a step S151 of FIG. 46. If the recording-priority mode is set to the recording-speed priority mode, the processing unit 60 proceeds to a step S152, and decides whether the recording-side mode is set to the one-side recording mode or the two-sided recording mode. If the recording-side mode is set to the one-side recording mode, the processing unit 60 proceeds to a step S153, and sets the dot number to Da1. If it is ascertained at the step S152 that the recording-side mode is set to the two-sided recording mode, the processing unit 60 proceeds to a step S154, and sets the dot number to Db1 that is smaller than Da1 (Db1<Da1).

If it is ascertained at the step S151 that the recording-priority mode is set to the recording-quality priority mode, the processing unit 60 proceeds to a step S155, and decides whether the recording-side mode is set to the one-side recording mode or the two-sided recording mode. If the recording-side mode is set to the one-side recording mode, the processing unit 60 proceeds to a step S156, and sets the dot number to Da2. If it is ascertained at the step S155 that the recording-side mode is set to the two-sided recording mode, the processing unit 60 proceeds to a step S157, and sets the dot number to Db2 that is smaller than Da2 (Db2<Da2). After setting the dot number as described above, the image-recording device 1 records an image on one side or images on both sides of the sheet 3 by discharging ink from the nozzles attached to the recording head 14 with the dot number set at the above-described steps.

Figure 47:
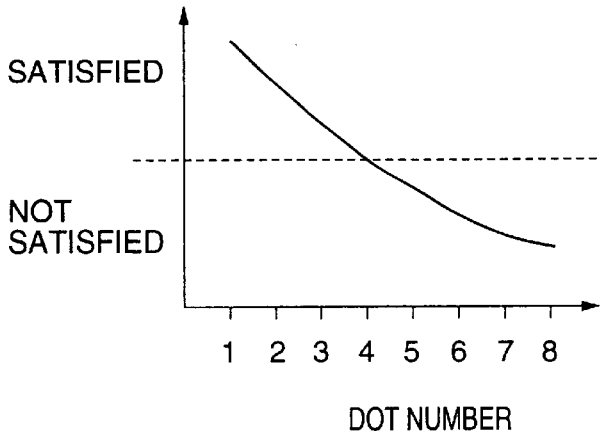
FIG. 47 is a diagram showing relation between the dot number and the recording speed of the image-recording device.
Figure 48:
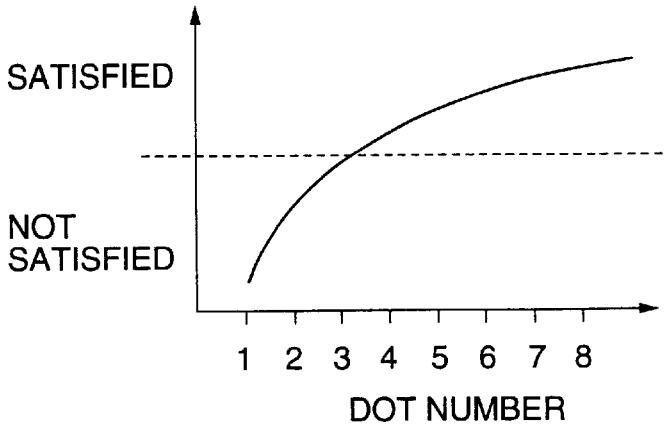
FIG. 48 is a diagram showing relation between the dot number and quality of the image recorded by the image-recording device.

FIG. 47 shows a relation between the dot number and a subjective sense of satisfaction for the recording speed of the image-recording device 1. Additionally, FIG. 48 shows a relation between the dot number and a subjective sense of satisfaction for the recording quality of an image on the sheet 3. FIGS. 47 and 48 are created with data taken from enough number of experiments for the relation between the dot number and the sense of satisfaction for the recording speed and the recording quality. As shown in FIGS. 47 and 48, when the dot number is smaller than or equal to the level 4, the recording speed is fulfilled. Additionally, if the dot number is greater than or equal to the level 3, the recording quality is fulfilled. Accordingly, the ascendant order of the drive frequencies Da1, Da2, Db1 and Db2 are preferably set to Db1<Da1<level 3<Db2<Da2, or Db1<Da1<level 4<Db2<Da2.

For instance, in the recording-speed priority mode, the dot number Da1 for the one-side recording mode is set to the level 2, and the dot number Db1 for the two-sided recording mode is set to the level 1. Additionally in the recording-quality priority mode, the dot number Da2 for the one-side recording mode is set to the level 8, and the dot number Db2 for the two-sided recording mode is set to the level 5. The recording speed is fulfilled in the recording-speed priority mode, and the recording quality is fulfilled in the recording-quality mode according to evaluation of the integers given for each of the drive frequencies Da1, Da2, Db1 and Db2.

According to the second example of the dot-number setting process, by altering the dot number depending on the recording-side mode, the image-recording device 1 can record an image on one side of the sheet 3 in the one-side recording mode or images on both sides of the sheet 3 in the two-sided recording mode with the recording speed and the recording quality requested by the control panel 8 of the image-recording device 1 or by the printer driver 101 in the host 100.

A description will now be given of a third example of a dot-number setting process taken by the processing unit 60 in the control unit with reference to FIG. 49.

Figure 49:
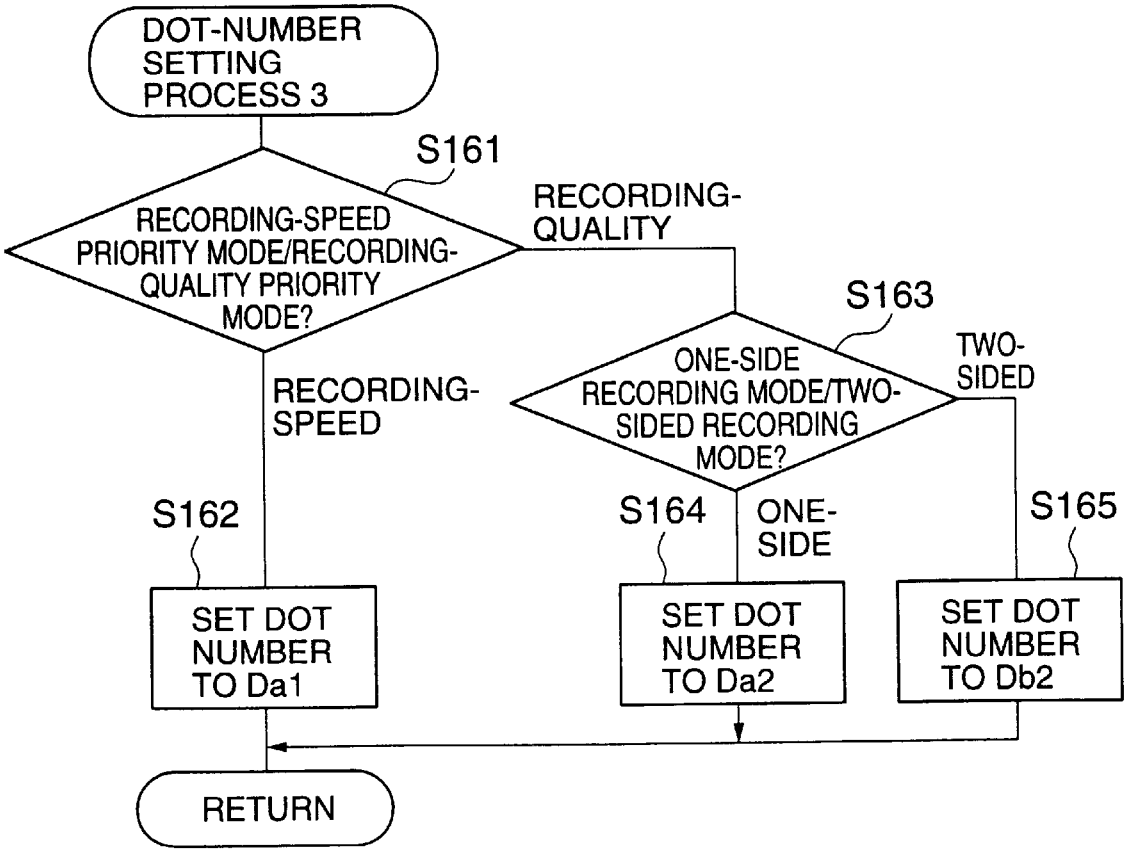
FIG. 49 is a flowchart for describing a third example of the dot-number setting process according to the fourth embodiment of the present invention.

The processing unit 60 in the control unit of the image-recording device 1 decides whether the recording-priority mode is the recording-speed priority mode or the recording-quality priority mode at a step S161 of FIG. 49. If the recording-priority mode is set to the recording-speed priority mode, the processing unit 60 proceeds to a step S162, and sets the dot number to Da1. If it is ascertained at the step S161 that the recording-priority mode is set to the recording-quality priority mode, the processing unit 60 proceeds to a step S163, and decides whether the recording-side mode is set to the one-side recording mode or the two-sided recording mode. If the recording-side mode is set to the one-side recording mode, the processing unit 60 proceeds to a step S164, and sets the dot number to Da2. If it is ascertained at the step S163 that the recording-side mode is set to the two-sided recording mode, the processing unit 60 proceeds to a step S165, and sets the dot number to Db2 that is smaller than Da2 (Db2<Da2). After setting the dot number as described above, the image-recording device 1 records an image on one side or images on both sides of the sheet 3 by discharging ink onto the sheet 3 from the nozzles attached to the recording head 14 with the dot number set at the above-described steps.

As described above, the drive frequencies for the one-side recording mode and the two-sided recording mode in the recording-speed priority mode are set to Da1 so that the image-recording device 1 can set the recording-speed to its first priority. For instance, in the recording-speed priority mode, the dot number Da1 for the one-side recording mode and the two-sided recording mode is set to the level 1. Additionally in the recording-quality priority mode, the dot number Da2 for the one-side recording mode is set to the level 8, and the dot number Db2 for the two-sided recording mode is set to the level 5. The recording speed is more fulfilled than the recording speed in the second example of the dot-number setting process in the recording-speed priority mode, and the recording quality is fulfilled as much as the recording quality in the second example of the dot-number setting process in the recording-quality mode according to evaluation of the integers given for each of the drive frequencies Da1, Da2 and Db2.

According to the third example of the dot-number setting process, by setting the drive frequencies for the one-side recording mode and the two-sided recording mode to be same in the recording-speed priority mode, the image-recording device 1 can record images on both sides of the sheet 3 in the recording-speed priority mode with higher recording speed than that of the second example of the dot-number setting process.

A description will now be given of a fourth example of a dot-number setting process taken by the processing unit 60 in the control unit with reference to FIG. 50.

Figure 50:
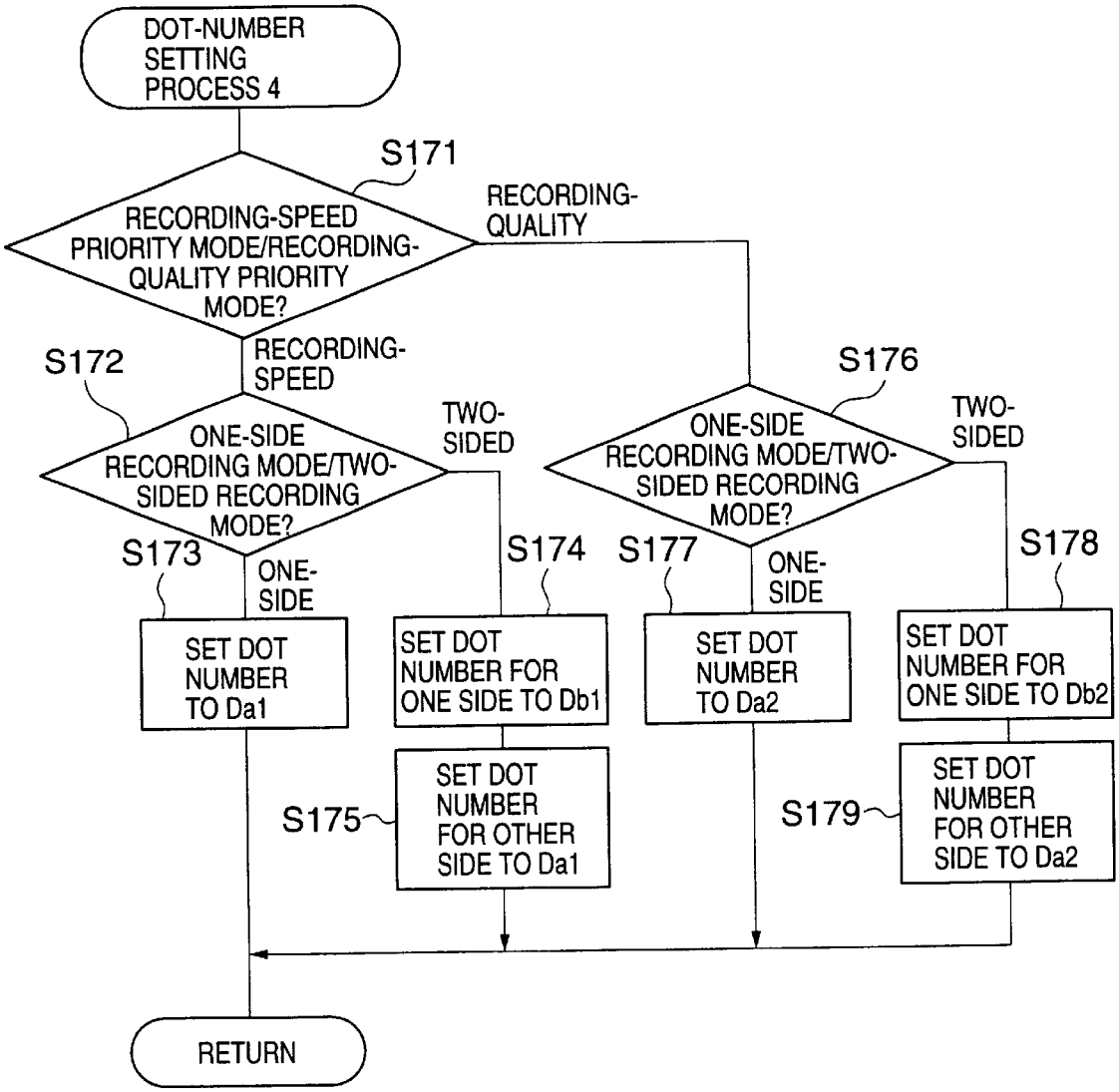
FIG. 50 is a flowchart for describing a fourth example of the dot-number setting process according to the fourth embodiment of the present invention.

The processing unit 60 in the control unit of the image-recording device 1 decides whether the recording-priority mode is the recording-speed priority mode or the recording-quality priority mode at a step S171 of FIG. 50. If the recording-priority mode is set to the recording-speed priority mode, the processing unit 60 proceeds to a step S172, and decides whether the recording-side mode is set to the one-side recording mode or the two-sided recording mode. If the recording-side mode is set to the one-side recording mode, the processing unit 60 proceeds to a step S173, and sets the dot number to Da1. If it is ascertained at the step S172 that the recording-side mode is set to the two-sided recording mode, the processing unit 60 proceeds to a step S174, and sets the dot number for recording an image on one side of the sheet 3 to Db1 that is smaller than Da1 (Db1<Da1). Subsequently, the processing unit 60 sets the dot number for recording an image on the other side of the sheet 3 to Da1 at a step S175.

If it is ascertained at the step S171 that the recording-priority mode is set to the recording-quality priority mode, the processing unit 60 proceeds to a step S176, and decides whether the recording-side mode is set to the one-side recording mode or the two-sided recording mode. If the recording-side mode is set to the one-side recording mode, the processing unit 60 proceeds to a step S177, and sets the dot number to Da2. If it is ascertained at the step S176 that the recording-side mode is set to the two-sided recording mode, the processing unit 60 proceeds to a step S178, and sets the dot number for recording an image on one side of the sheet 3 to Db2 that is smaller than Da2 (Db2<Da2). Subsequently, the processing unit 60 sets the dot number for recording an image on the other-side of the sheet 3 to Da2 at a step S179. After setting the dot number as described above, the image-recording device 1 records an image on one side or images on both sides of the sheet 3 by discharging ink onto the sheet 3 from the nozzles attached to the recording head 14 with the dot number set at the above-described steps.

For instance, in the recording-speed priority mode, the dot number Da1 for the one-side recording mode and for recording an image on the other side of the sheet 3 in the two-sided recording mode is set to the level 2, and the dot number Db1 for recording an image on one side of the sheet 3 in the two-sided recording mode is set to the level 1. Additionally in the recording-quality priority mode, the dot number Da2 for the one-side recording mode and for recording an image on the other side of the sheet 3 in the two-sided recording mode is set to the level 8, and the dot number Db2 for recording an image on one side of the sheet 3 in the two-sided recording mode is set to the level 5.

The recording speed of the image-recording device 1 is more fulfilled than the recording speeds in the second example and in the third example of the dot-number setting process in the two-sided recording mode according to evaluation of the integers given for each of the drive frequencies Da1, Da2, Db1 and Db2.

According to the fourth example of the dot-number setting process, by setting the dot number for recording an image on the other side of the sheet 3 different from the dot number for recording an image on one side of the sheet 3 in the two-sided recording mode, the image-recording device 1 can record images on both sides of the sheet 3 in the two-sided recording mode with the higher recording speed than that of the second example of the dot-number setting process and that of the third example of the dot-number setting process.

A description will now be given of a first example of a dot-density setting process according to a sixth embodiment of the present invention that is taken by the processing unit 60 in the control unit depending on the recording-side mode of the image-recording device 1 that is either the one-side recording mode or the two-sided recording mode, with reference to FIG. 51 through FIG. 55.

Figures 51, 52:
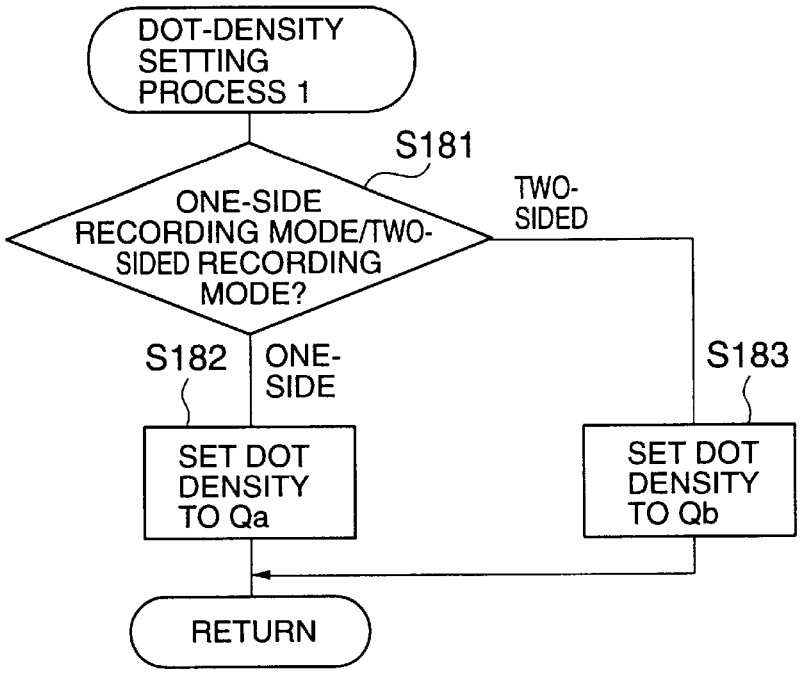
FIG. 51 is a flowchart for describing a first example of a dot-density setting process according to a fifth embodiment of the present invention.
FIG. 52 is a table showing a level number and its corresponding dot density.
Figure 53:
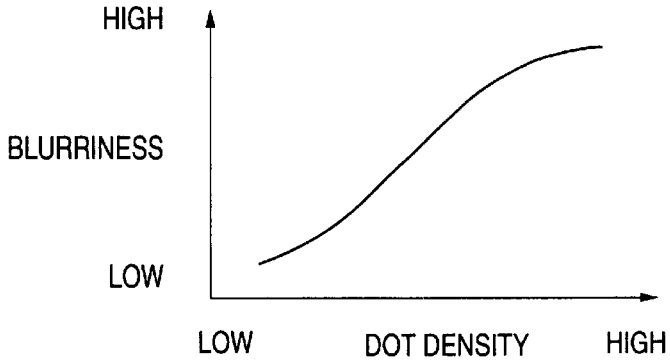
FIG. 53 is a diagram showing relation between the dot density and blurriness of the image recorded on one side of the sheet 3 seen from the other side of the sheet 3.
Figure 54:
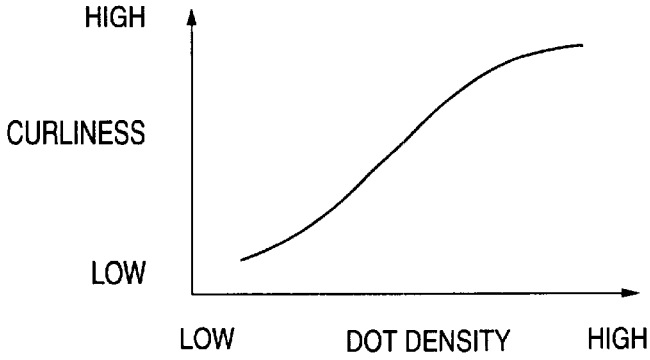
FIG. 54 is a diagram showing relation between the dot density and curliness of the sheet 3.
Figure 55:
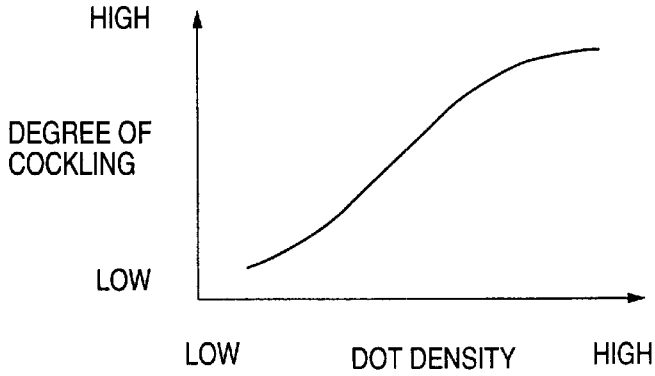
FIG. 55 is a diagram showing relation between the dot density and the degree of cockling of the sheet 3.

Dot density is maximum density of dots discharged per every inch (DPI) on a surface of the sheet 3 by the nozzles attached to the recording head 14 of the image-recording device 1. The dot density is set by the resolution of the image-recording device 1. FIG. 52 shows levels 1 though 8 and the corresponding resolution or the maximum density of the image-recording device 1. FIGS. 53, 54 and 55 show respectively relation-between the dot density and the blurriness of an image recorded on one side of the sheet 3 seen from the other side, relation between the dot density and the curliness of the sheet 3, and relation between the dot density and the degree of cockling of the sheet 3. As seen from FIGS. 53, 54 and 55, the lower the dot density is, the lower the blurriness, the curliness, the degree of cockling are. Accordingly, the lower the dot density is, the higher the image quality is.

The processing unit 60 in the control unit executes the dot-density setting process preceding an image recording on the sheet 3. In FIG. 51, the processing unit 60 decides whether the recording-side mode is set to the one-side recording mode or the two-sided recording mode at a step S181. If it is ascertained at the step S141 that the recording-side mode is set to the one-side recording mode, the processing unit 60 proceeds to a step S182, and sets the dot density to Qa. If it is ascertained at the step S181 that the recording-side mode is set to the two-sided recording mode, the processing unit 60 proceeds to a step S183, and sets the dot density to Qb that is lower than Qa (Qb<Qa). After setting the dot density, the image-recording device 1 records an image on one side of the sheet 3 or images on both sides of the sheet 3 by discharging ink onto the sheet 3 from the nozzles attached to the recording head 14 with the dot density set at the step S182 or the step S183.

In the two-sided recording mode, there is a case that recording an image on the other side becomes difficult after having an image on one side of the sheet 3 blurred and the sheet 3 curled or cockled. Therefore, by setting the dot density Qb for the two-sided recording mode lower than the dot density Qa for the one-side recording mode, the image-recording device 1 can prevent the blurriness of the image on one side of the sheet 3, the curliness and the degree of cockling of the sheet 3 when recording the image on one side of the sheet 3 so that an image can be recorded on the other side of the sheet 3 with higher image quality.

Accordingly, the image-recording device 1 can record an image on one side of the sheet 3 or images on both sides of the sheet 3 with higher image quality by setting the dot density to an appropriate number depending on the one-side recording mode or the two-sided recording mode.

In the following second, third and fourth examples of the dot-density setting process, by ignoring the blurriness of an image recorded on one side of the sheet 3 seen from the other side, and the curliness and the degree of cockling of the sheet 3, recording speed of the image-recording device 1 generally decreases, and recording quality of an image on the sheet 3 generally increases as the dot density increases.

A description will now be given of a second example of the dot-density setting process taken by the processing unit 60 in the control unit with reference to FIGS. 56, 57 and 58.

When the image-recording device 1 records an image on the sheet 3, if the recording speed of the image-recording device 1 increases, the quality of the image recorded on the sheet 3 generally decreases. On the other hand, if the recording speed of the image-recording device 1 decreases, the quality of the image recorded on the sheet 3 increases. Accordingly, in the second example of the dot-density setting process, a recording-priority mode that is either a recording-speed priority mode or a recording-quality priority mode is provided to the image-recording device 1.

In the recording-speed priority mode, the processing unit 60 sets the recording speed of the image-recording device 1 to take priority over the quality of the image recorded on the sheet 3. Additionally, in the recording-quality priority mode, the processing unit 60 sets the recording quality of the image on the sheet 3 to take priority over the recording speed of the image-recording device 1. The recording-priority mode is selected by the control panel 8 of the image-recording device 1 or by the printer driver 101 located in the host 100.

Figure 56:
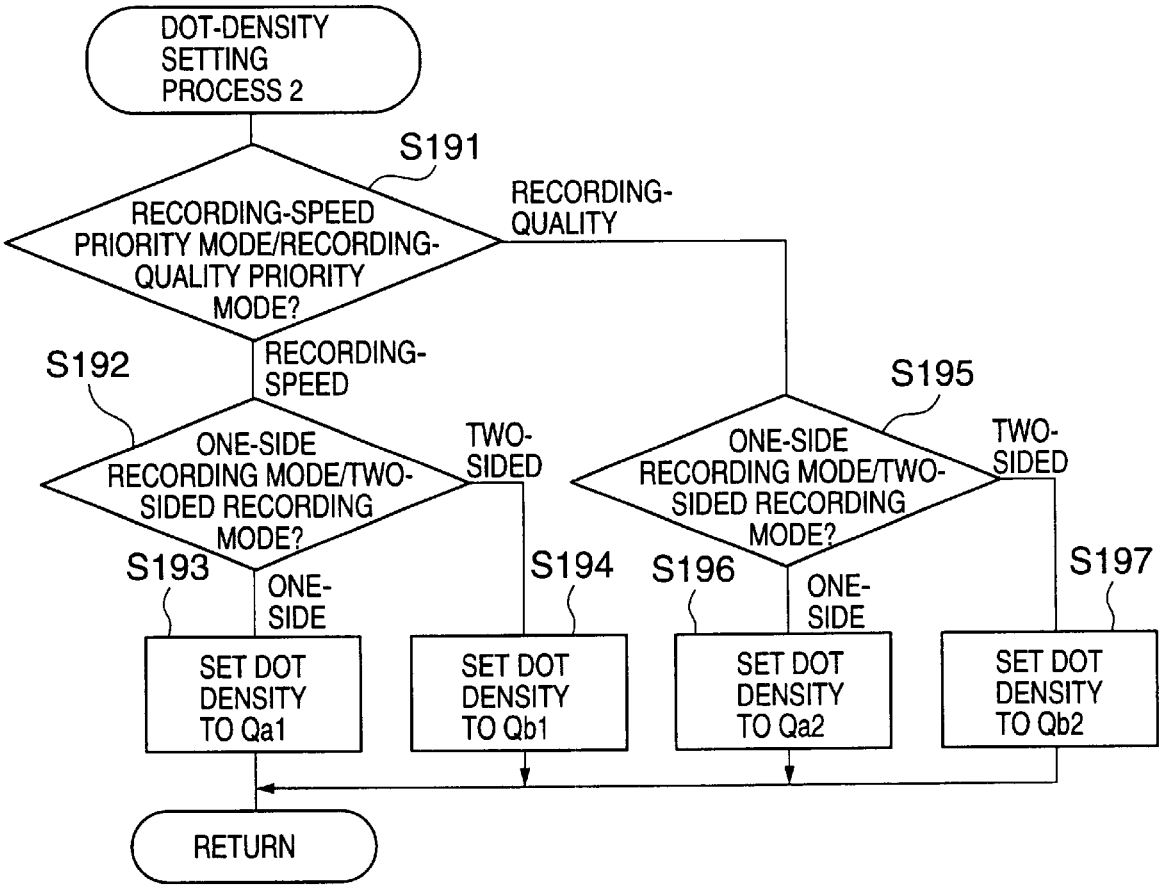
FIG. 56 is a flowchart for describing a second example of the dot-density setting process according to the fifth embodiment of the present invention.

The processing unit 60 in the control unit of the image-recording device 1 decides whether the recording-priority mode is the recording-speed priority mode or the recording-quality priority mode at a step S191 of FIG. 56. If the recording-priority mode is set to the recording-speed priority mode, the processing unit 60 proceeds to a step S192, and decides whether the recording-side mode is set to the one-side recording mode or the two-sided recording mode. If the recording-side mode is set to the one-side recording mode, the processing unit 60 proceeds to a step S193, and sets the dot density to Qa1. If it is ascertained at the step S192 that the recording-side mode is set to the two-sided recording mode, the processing unit 60 proceeds to a step S194, and sets the dot density to Qb1 that is lower than Qa1 (Qb1<Qa1).

If it is ascertained at the step S191 that the recording-priority mode is set to the recording-quality priority mode, the processing unit 60 proceeds to a step S195, and decides whether the recording-side mode is set to the one-side recording mode or the two-sided recording mode. If the recording-side mode is set to the one-side recording mode, the processing unit 60 proceeds to a step S196, and sets the dot density to Qa2. If it is ascertained at the step S195 that the recording-side mode is set to the two-sided recording mode, the processing unit 60 proceeds to a step S197, and sets the dot density to Qb2 that is lower than Qa2 (Qb2<Qa2). After setting the dot density as described above, the image-recording device 1 records an image on one side or images on both sides of the sheet 3 by discharging ink from the nozzles attached to the recording head 14 with the dot density set at the above-described steps.

Figure 57:
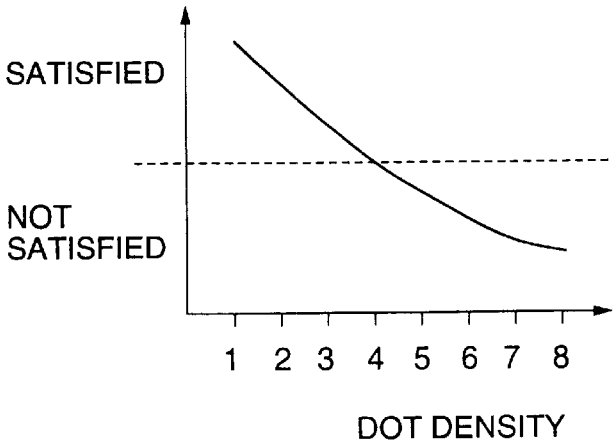
FIG. 57 is a diagram showing relation between the dot density and the recording speed of the image-recording device.
Figure 58:
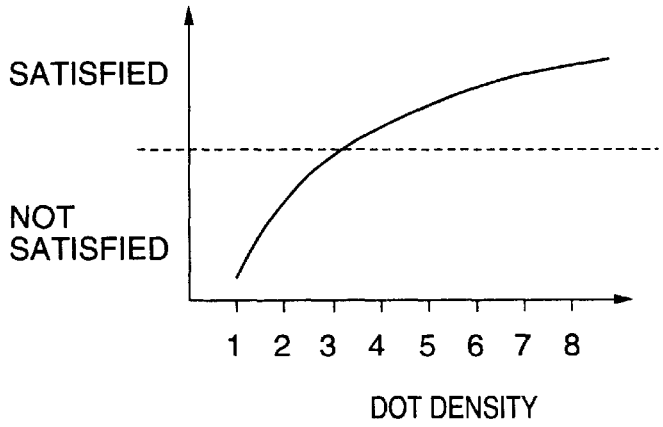
FIG. 58 is a diagram showing relation between the dot density and quality of the image recorded by the image-recording device.

FIG. 57 shows a relation between the dot density and a subjective sense of satisfaction for the recording speed of the image-recording device 1. Additionally, FIG. 58 shows a relation between the dot density and a subjective sense of satisfaction for the recording quality of an image on the sheet 3. FIGS. 57 and 58 are created with data taken from enough number of experiments for the relation between the dot density and the sense of satisfaction for the recording speed and the recording quality. As shown in FIGS. 57 and 58, when the dot density is lower than or equal to the level 4, the recording speed is fulfilled. Additionally, if the dot density is higher than or equal to the level 3, the recording quality is fulfilled. Accordingly, the ascendant order of the drive frequencies Qa1, Qa2, Qb1 and Qb2 are preferably set to Qb1<Qa1<Qb2<Qa2.

For instance, in the recording-speed priority mode, the dot density Qa1 for the one-side recording mode is set to the level 2, and the dot density Qb1 for the two-sided recording mode is set to the level 1. Additionally in the recording-quality priority mode, the dot density Qa2 for the one-side recording mode is set to the level 8, and the dot density Qb2 for the two-sided recording mode is set to the level 5. The recording speed is fulfilled in the recording-speed priority mode, and the recording quality is fulfilled in the recording-quality mode according to evaluation of the integers given for each of the drive frequencies Qa1, Qa2, Qb1 and Qb2.

According to the second example of the dot-density setting process, by altering the dot density depending on the recording-side mode, the image-recording device 1 can record an image on one side of the sheet 3 in the one-side recording mode or images on both sides of the sheet 3 in the two-sided recording mode with the recording speed and the recording quality requested by the control panel 8 of the image-recording device 1 or by the printer driver 101 in the host 100.

A description will now be given of a third example of a dot-density setting process taken by the processing unit 60 in the control unit with reference to FIG. 59.

Figure 59:
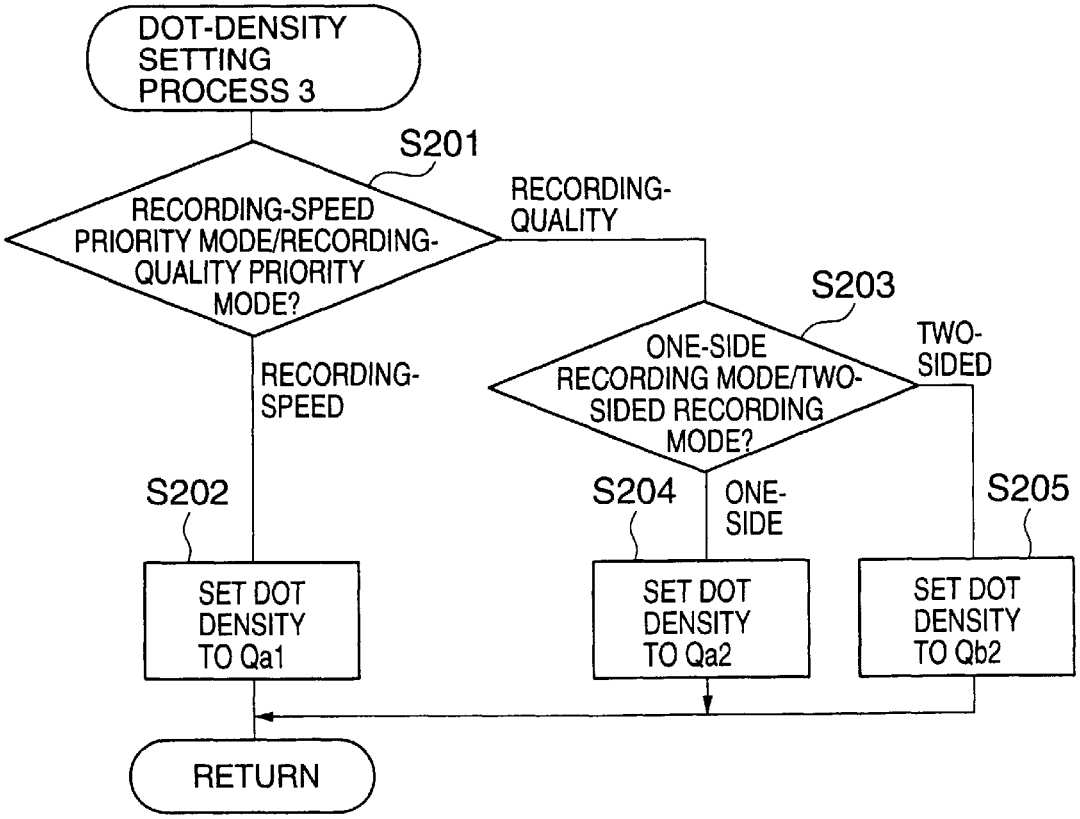
FIG. 59 is a flowchart for describing a third example of the dot-density setting process according to the fifth embodiment of the present invention.

The processing unit 60 in the control unit of the image-recording device 1 decides whether the recording-priority mode is the recording-speed priority mode or the recording-quality priority mode at a step S201 of FIG. 59. If the recording-priority mode is set to the recording-speed priority mode, the processing unit 60 proceeds to a step S202, and sets the dot density to Qa1. If it is ascertained at the step S201 that the recording-priority mode is set to the recording-quality priority mode, the processing unit 60 proceeds to a step S203, and decides whether the recording-side mode is set to the one-side recording mode or the two-sided recording mode. If the recording-side mode is set to the one-side recording mode, the processing unit 60 proceeds to a step S204, and sets the dot density to Qa2. If it is ascertained at the step S203 that the recording-side mode is set to the two-sided recording mode, the processing unit 60 proceeds to a step S205, and sets the dot density to Qb2 that is lower than Qa2 (Qb2<Qa2). After setting the dot density as described above, the image-recording device 1 records an image on one side or images on both sides of the sheet 3 by discharging ink onto the sheet 3 from the nozzles attached to the recording head 14 with the dot density set at the above-described steps.

As described above, the drive frequencies for the one-side recording mode and the two-sided recording mode in the recording-speed priority mode are set to Qa1 so that the image-recording device 1 can set the recording-speed to its first priority. For instance, in the recording-speed priority mode, the dot density Qa1 for the one-side recording mode and the two-sided recording mode is set to the level 1. Additionally in the recording-quality priority mode, the dot density Qa2 for the one-side recording mode is set to the level 8, and the dot density Qb2 for the two-sided recording mode is set to the level 5. The recording speed is more fulfilled than the recording speed in the second example of the dot-density setting process in the recording-speed priority mode, and the recording quality is fulfilled as much as the recording quality in the second example of the dot-density setting process in the recording-quality mode according to evaluation of the integers given for each of the drive frequencies Qa1, Qa2 and Qb2.

According to the third example of the dot-density setting process, by setting the drive frequencies for the one-side recording mode and the two-sided recording mode to be same in the recording-speed priority mode, the image-recording device 1 can record images on both sides of the sheet 3 in the recording-speed priority mode with higher recording speed than that of the second example of the dot-density setting process.

A description will now be given of a fourth example of a dot-density setting process taken by the processing unit 60 in the control unit with reference to FIG. 60.

Figure 60:
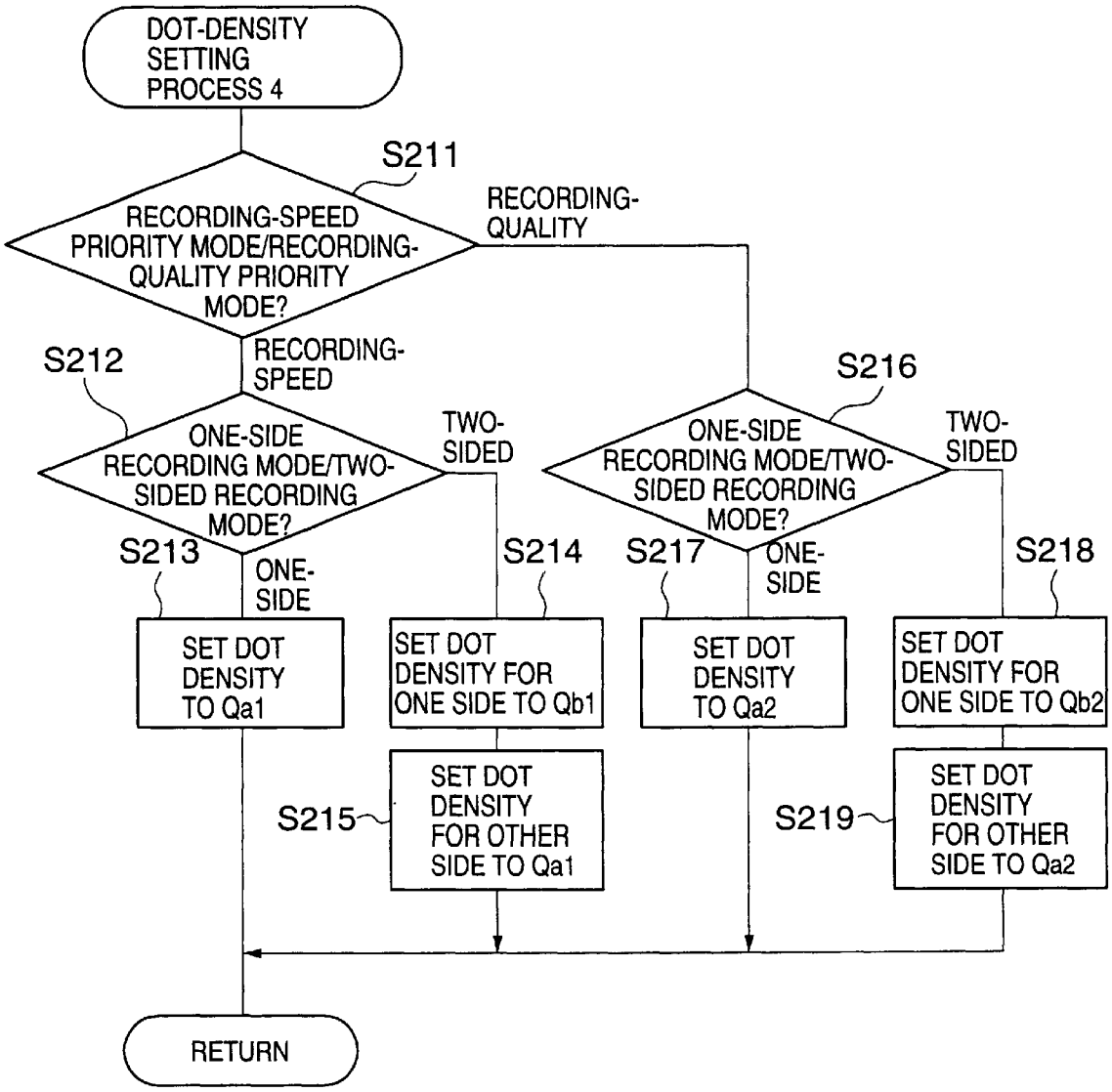
FIG. 60 is a flowchart for describing a fourth example of the dot-density setting process according to the fifth embodiment of the present invention.

The processing unit 60 in the control unit of the image-recording device 1 decides whether the recording-priority mode is the recording-speed priority mode or the recording-quality priority mode at a step S211 of FIG. 60. If the recording-priority mode is set to the recording-speed priority mode, the processing unit 60 proceeds to a step S212, and decides whether the recording-side mode is set to the one-side recording mode or the two-sided recording mode. If the recording-side mode is set to the one-side recording mode, the processing unit 60 proceeds to a step S213, and sets the dot density to Qa1. If it is ascertained at the step S212 that the recording-side mode is set to the two-sided recording mode, the processing unit 60 proceeds to a step S214, and sets the dot density for recording an image on one side of the sheet 3 to Qb1 that is lower than Qa1 (Qb1<Qa1). Subsequently, the processing unit 60 sets the dot density for recording an image on the other side of the sheet 3 to Qa1 at a step S215.

If it is ascertained at the step S211 that the recording-priority mode is set to the recording-quality priority mode, the processing unit 60 proceeds to a step S216, and decides whether the recording-side mode is set to the one-side recording mode or the two-sided recording mode. If the recording-side mode is set to the one-side recording mode, the processing unit 60 proceeds to a step S217, and sets the dot density to Qa2. If it is ascertained at the step S216 that the recording-side mode is set to the two-sided recording mode, the processing unit 60 proceeds to a step S218, and sets the dot density for recording an image on one side of the sheet 3 to Qb2 that is lower than Qa2 (Qb2<Qa2). Subsequently, the processing unit 60 sets the dot density for recording an image on the other side of the sheet 3 to Qa2 at a step S219. After setting the dot density as described above, the image-recording device 1 records an image on one side or images on both sides of the sheet 3 by discharging ink onto the sheet 3 from the nozzles attached to the recording head 14 with the dot density set at the above-described steps.

For instance, in the recording-speed priority mode, the dot density Qa1 for the one-side recording mode and for recording an image on the other side of the sheet 3 in the two-sided recording mode is set to the level 2, and the dot density Qb1 for recording an image on one side of the sheet 3 in the two-sided recording mode is set to the level 1. Additionally in the recording-quality priority mode, the dot density Qa2 for the one-side recording mode and for recording an image on the other side of the sheet 3 in the two-sided recording mode is set to the level 8, and the dot density Qb2 for recording an image on one side of the sheet 3 in the two-sided recording mode is set to the level 5.

The recording speed of the image-recording device 1 is more fulfilled than the recording speeds in the second example and in the third example of the dot-density setting process in the two-sided recording mode according to evaluation of the integers given for each of the drive frequencies Qa1, Qa2, Qb1 and Qb2.

According to the fourth example of the dot-density setting process, by setting the dot density for recording an image on the other side of the sheet 3 different from the dot density for recording an image on one side of the sheet 3 in the two-sided recording mode, the image-recording device 1 can record images on both sides of the sheet 3 in the two-sided recording mode with the higher recording speed than that of the second example of the dot-density setting process and that of the third example of the dot-density setting process.

A description will now be given of a first embodiment of a printer driver according to the present invention. The printer driver 101 is stored in the host device 100 that supplies data to the image-recording device 1 through a printer cable and a communication line including a public switched telephone network (PSTN), an exclusive line or a local area network (LAN), or in a storage unit of a compound device that includes a copier machine, a facsimile, or a printer. The printer driver 101 is installed in the host device 100 or in the compound device through a record medium or a communication network.

The printer driver 101 includes a program that executes one or more of the above-described path-number setting processes, which set the path number in the two-sided recording mode different from the path number in the one-side recording mode, and the program can be installed in the image-recording device 1. Accordingly, the printer driver 101 enables the image-recording device to adjust the path number for recording an image with lower blurriness and having the sheet 3 with lower curliness and lower degree of cockling than conventional image-recording devices.

In a second embodiment of the printer driver according to the present invention, the printer driver 101 includes a program that executes one or more of the above-described nozzle-number setting processes which set the nozzle number in the two-sided recording mode different from the nozzle number in the one-side recording mode, and the program can be installed in the image-recording device 1. Accordingly, the printer driver 101 enables the image-recording device 1 to adjust the nozzle number for recording an image with lower blurriness and having the sheet 3 with lower curliness and lower degree of cockling than conventional image-recording devices.

In a third example of the printer driver according to the present invention, the printer driver 101 includes a program that executes one or more of the above-described drive-frequency setting processes which set the drive frequency in the two-sided recording mode different from the drive frequency in the one-side recording mode, and the program can be installed in the image-recording device 1. Accordingly, the printer driver 101 enables the image-recording device 1 to adjust the drive frequency for recording an image with lower blurriness and having the sheet 3 with lower curliness and lower degree of cockling than conventional image-recording devices.

In a fourth example of the printer driver according to the present invention, the printer driver 101 includes a program that executes one or more of the above-described dot-number setting processes which set the dot number in the two-sided recording mode different from the dot number in the one-side recording mode, and the program can be installed in the image-recording device 1. Accordingly, the printer driver 101 enables the image-recording device 1 to adjust the dot number for recording an image with lower blurriness and having the sheet 3 with lower curliness and lower degree of cockling than conventional image-recording devices.

In a fifth example of the printer driver according to the present invention, the printer driver 101 includes a program that executes one or more of the above-described dot-density setting processes which set the dot density in the two-sided recording mode different from the dot density in the one-side recording mode, and the program can be installed in the image-recording device 1. Accordingly, the printer driver 101 enables the image-recording device 1 to adjust the dot density for recording an image with lower blurriness and having the sheet 3 with lower curliness and lower degree of cockling than conventional image-recording devices.

Additionally, the image-recording device 1 may include a plurality of the above-described programs that execute the path-number setting processes, the nozzle-number setting processes, the drive-frequency setting processes, the dot-number setting processes and the dot-frequency setting processes. Accordingly, the image-recording device 1 can easily specify and notify which process to execute to the printer driver 101 so as to record an image on the sheet 3 with the recording speed and the recording quality that are requested by a user.

A description will now be given of a sheet-type detection device according to the present invention with reference to FIG. 61 through FIG. 64. The sheet-type detection device may be installed in an image-recording device so that the image-recording device can apply the sheet-type detection device to detect the type of a sheet provided to the image-detecting device.

Inkjet recording devices such as a printer, a copier machine, a facsimile, and a plotter that are used as image-recording devices record an image on a sheet by discharging ink thereon. The ink adhered to the surface of the sheet dries up by evaporating into air and by permeating into the sheet. Accordingly, the quality of the image recorded on the sheet is affected by the characteristic of the sheet.

Consequently, conventional image-recording devices are made to select a recording-sheet mode that is either a regular-sheet mode wherein the device records an image on a regular sheet of paper which sides are not coated (a regular sheet), or a special-sheet mode wherein the device records the image on a special type of paper (a special sheet) such as a coated paper or a glossy paper that includes coating layers for increasing permeability of ink thereon. Since the special sheet has greater permeability of ink than the regular sheet, an image-recording device records an image with higher drive frequency, greater path number, less nozzle number and less volume of an ink drop discharged from a nozzle in the special-sheet mode than in the regular-sheet mode to prevent ink from permeating into the special sheet.

Most of the special sheet is generally a regular sheet with its one side coated foaming the coating layers, and does not have the other side coated, and the image-recording device records an image on one side of the special sheet that is coated with the coating layers (a coated surface) in the special-sheet mode, and records an image on the other side of the special sheet that is not coated (a regular surface) also in the special-sheet mode. If the image-recording device records the image on the regular surface in the special-sheet mode, recording speed of the image-recording device decreases especially in the recording-speed priority mode since the path number is greater and the nozzle number is less than in the regular-sheet mode.

Additionally, when the image-recording device records an image on the regular surface of the special sheet in the special-sheet mode, the following situations may occur. Assuming an image is recorded on the coated surface, the image-recording device does not prevent blurriness of ink on a surface of the special sheet in the special-sheet mode so that the ink blurs on the regular surface. The volume of an ink drop discharged from a nozzle in the special-sheet mode is smaller than in the regular-sheet mode so that image density on the regular surface decreases. In a case that an UCR level in the special-sheet mode is different from the UCR level in the regular-sheet mode, the blurriness of an image recorded on the regular surface of the sheet seen from the other side may occur, and ink adhering on the regular surface of the sheet may permeate through the sheet to the other side. Additionally, since color tone of an image recorded in the special-sheet mode is different from the color tone of the same image recorded in the regular-sheet mode, the image recorded on the regular surface in the special-sheet mode has different color tone from the image recorded on the regular surface in the regular-sheet mode. As described above, the quality of an image recorded on the regular surface in the special-sheet mode decreases.

Alternatively, images may be recorded on the coated surface and the regular surface in the regular-sheet mode. Since the recording speed of the image-recording device in the regular-sheet mode is slower than in the special-sheet mode, the recording speed of the image-recording device remarkably decreases when recording an image on the coated surface in the regular-sheet mode. Additionally, since color tone of an image recorded in the special-sheet mode is different from the color tone of the same image recorded in the regular-sheet mode, the image recorded on the coated surface in the regular-sheet mode has different color tone from the image recorded on the coated surface in the special-sheet mode so that the quality of the image recorded on the coated surface decreases.

Accordingly, the sheet-type detection device is provided to the image-recording device to detect the sheet type that is either the coated sheet or the regular sheet. The image-recording device can detect the type of a sheet by use of the sheet-type detection device, and can execute an image-recording process that is appropriate to the sheet.

Figure 61:
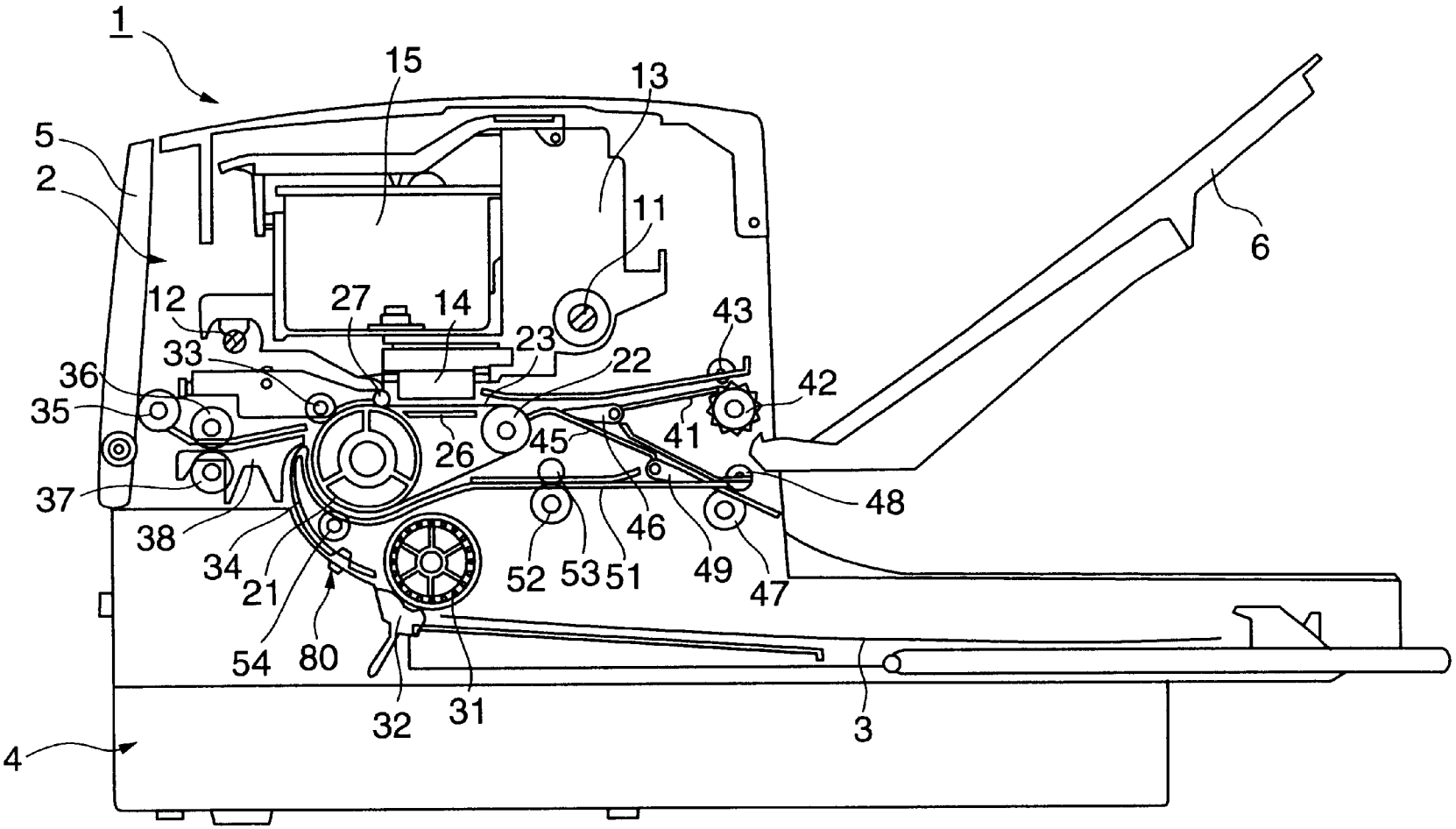
FIG. 61 is a perspective diagram of the image-recording device including a sheet-type detection sensor according to the present invention.

FIG. 61 is a perspective diagram of the image-recording device 1 including the sheet-type detection device according to the present invention. The sheet-type detection device that is a sheet-type detection sensor 80 is placed on the guide unit 34 between the paper-supplying roller 31 and the conveyance roller 21. All the other components shown in FIG. 61 are described previously with reference to FIG. 2.

Figure 62:
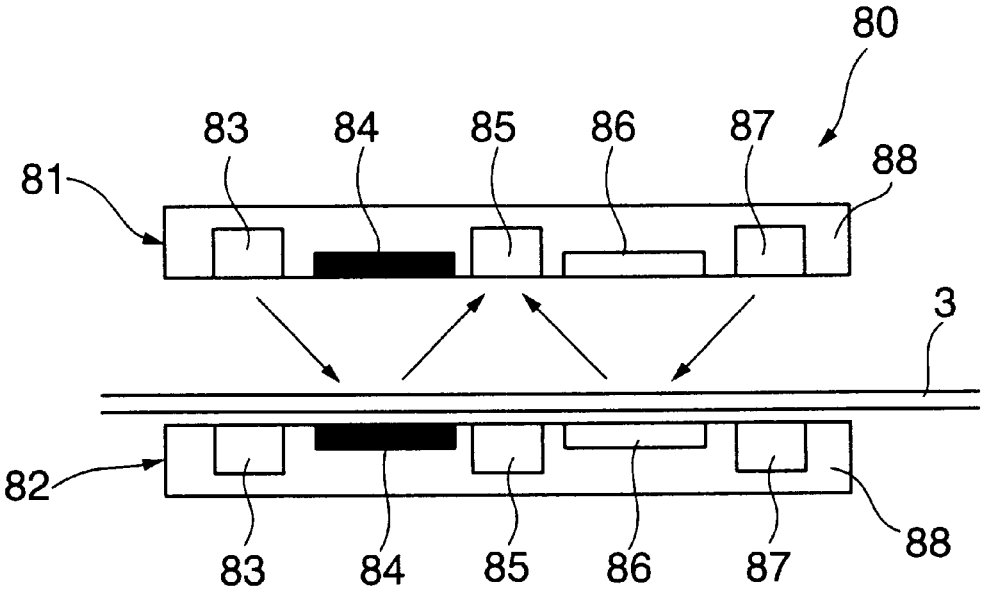
FIG. 62 is a diagram showing sheet-density sensors in the sheet-type detection sensor, and its mechanism.
Figure 63:
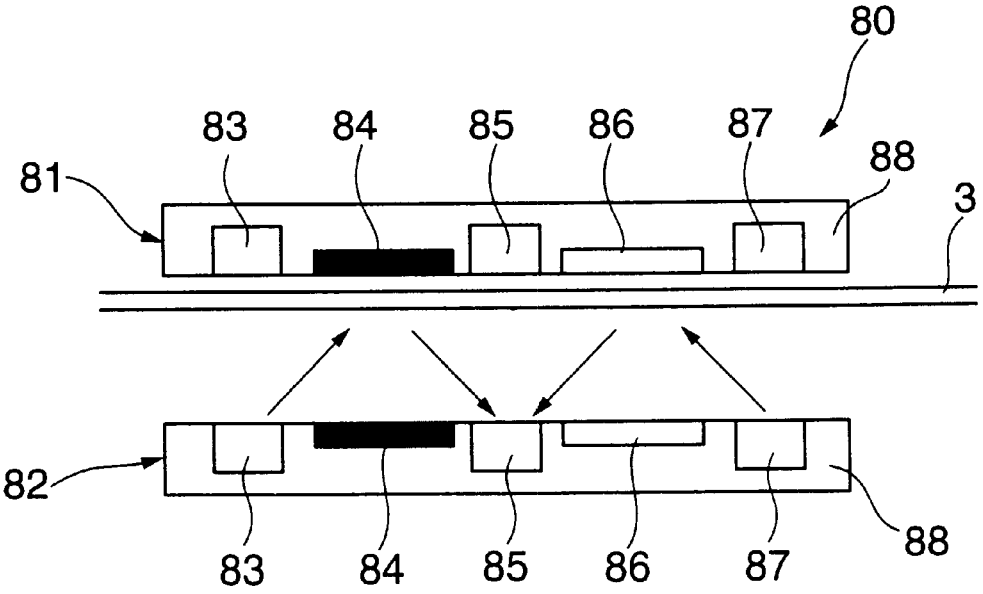
FIG. 63 is a diagram showing sheet-density sensors in the sheet-type detection sensor, and its mechanism.
Figure 64:
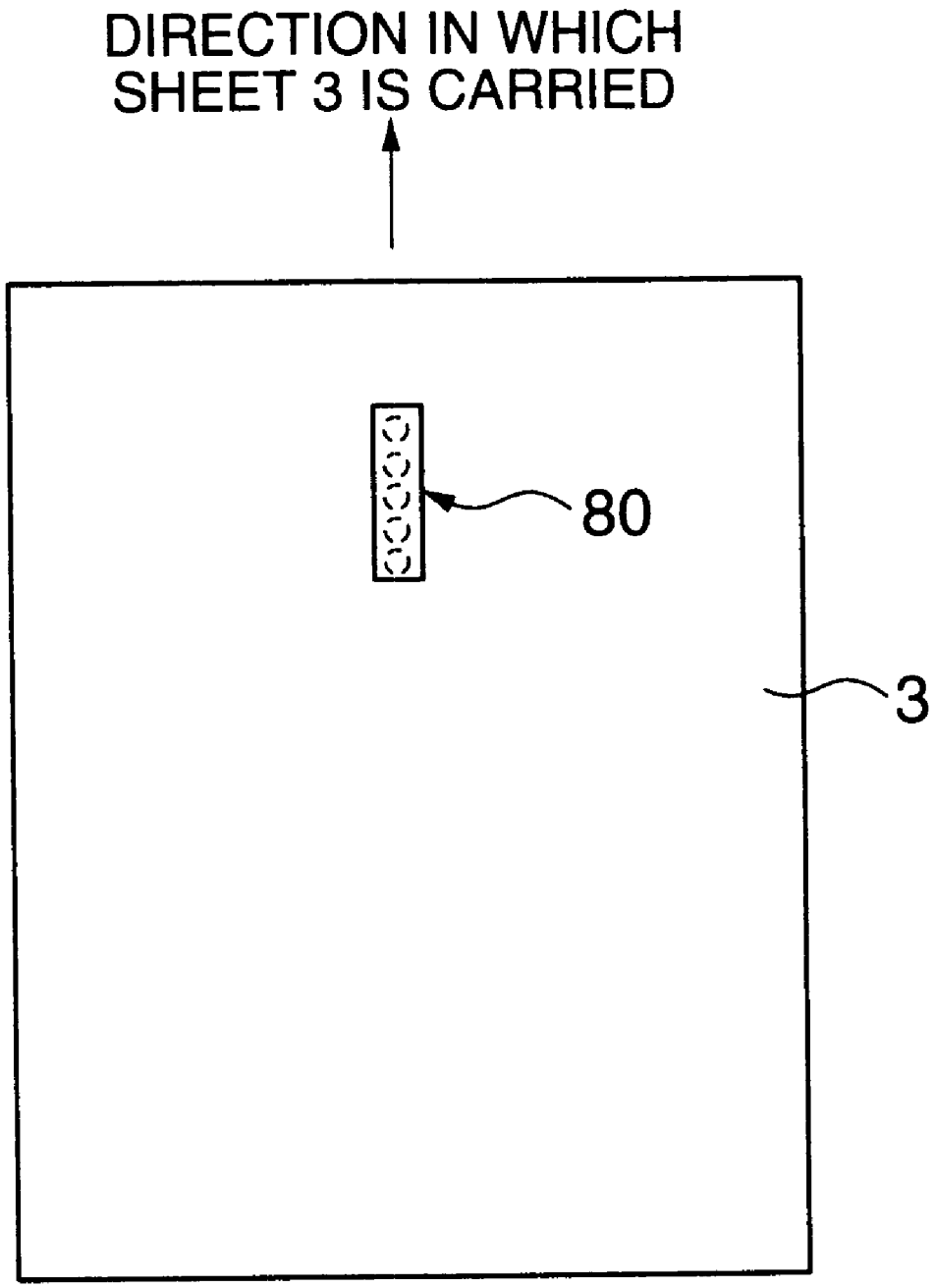
FIG. 64 is a diagram showing a position of the sheet-type detection sensor with respect to the sheet 3.

As shown in FIGS. 62 and 63, the sheet-type detection sensor 80 includes sheet-density sensors 81 and 82. Each of the sheet-density sensors 81 and 82 includes light-emitting units 83 and 87, a black reflector 84, a light-intercepting unit 85, a white reflector 86 and a holding unit 88. The light-emitting units 83 and 87 emit light to the sheet 3 that is carried through the space between the holding units 88 of the sheet-density sensors 81 and 82. The light-intercepting unit 85 receives the light reflected on the sheet 3. The black reflector 84 is colored black, and the white reflector 86 is colored white.

The sheet-density sensors 81 and 82 are placed in the middle of a line perpendicular to a direction in which the sheet 3 is carried, and are able to move forward and backward in the direction in which the sheet 3 is carried by use of solenoids 74 and 75 that is not shown in the figure. The sheet-density sensor 81 is situated to detect the sheet density of a surface of the sheet 3 whereon an image is recorded initially in the two-sided recording mode or the sheet density of a surface of the sheet 3 whereon an image is recorded in the one-side recording mode. The sheet-density sensor 82 is situated to detect the sheet density of a surface of the sheet 3 whereon an image is recorded afterward in the two-sided recording mode or the sheet density of a surface of the sheet 3 whereon an image is not recorded in the one-side recording mode. It should be noted that the sheet-density sensors 81 and 82 may be substituted with color-density sensors in the sheet-type detection sensor 80.

Figure 65:
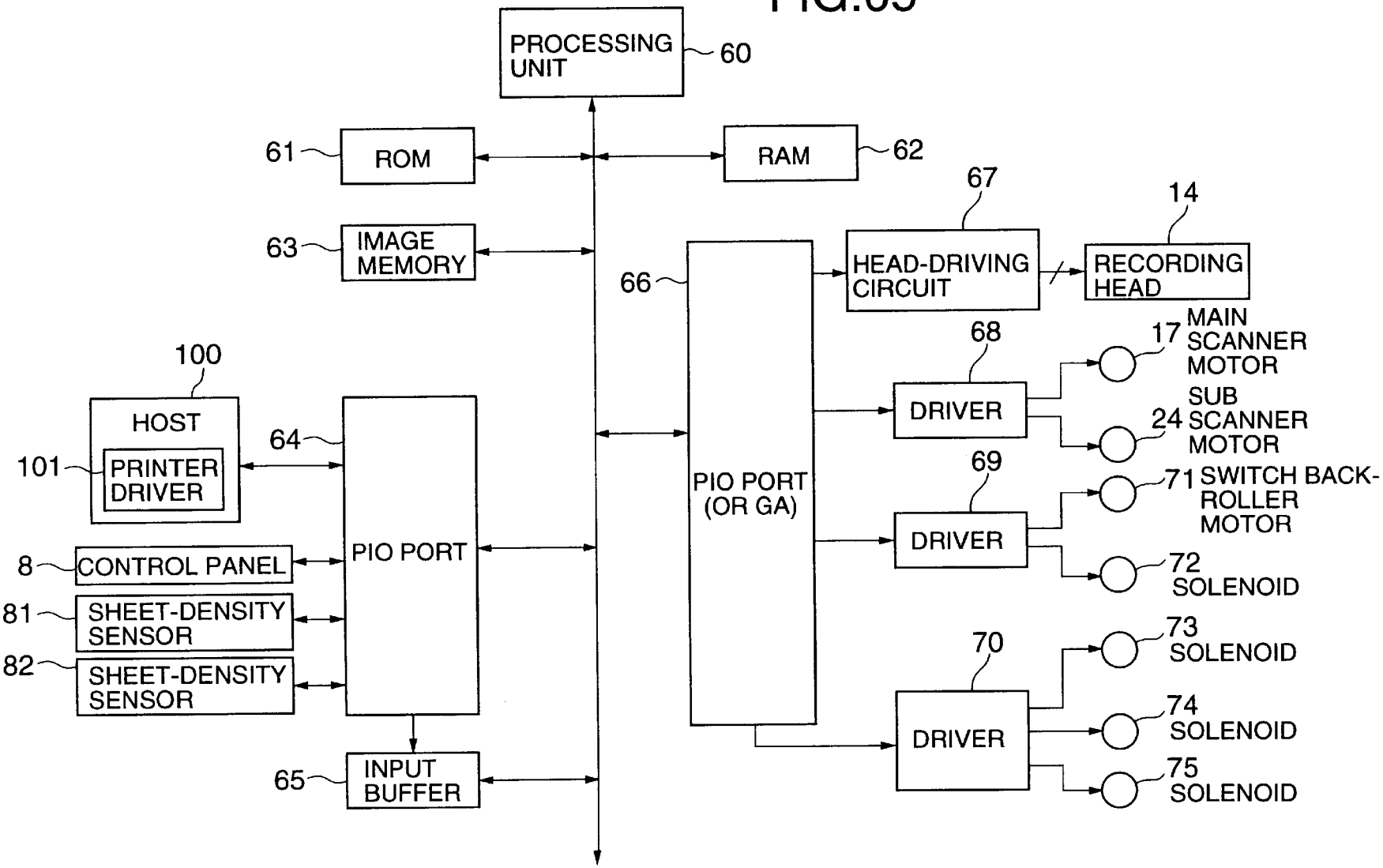
FIG. 65 is a block diagram showing a control unit of the image-recording device that includes the sheet-type detection sensor.

A description will now be given of the control unit of the image-recording device 1 with reference to FIG. 65. The control unit of the image-recording device 1 includes.the processing unit 60, the ROM 61, the RAM 62, the image memory 63, the PIO port 64, the input buffer 65, the PIO port 66, the head-driving circuit 67 and the drivers 68 and 69. Additionally, the control unit includes a driver 70. The driver 70 controls the solenoids 74 and 75 that respectively make the sheet-density sensors 81 and 82 move forward and backward in the direction in which the sheet 3 is carried.

The processing unit 60 includes, for instance, a procedure to detect each surface type of the sheet 3 that is either the coated surface or the regular surface, and a procedure to control an image-recording process on the sheet 3 in a recording-side mode corresponding to the surface type. The PIO port 64 receives, for example, information to select the recording-sheet mode that is either the special-sheet mode or the regular-sheet mode and the recording-side mode that is either the one-side recording mode or the two-sided recording mode from the printer driver 101 located in the host 100. Additionally, the PIO port 64 receives image information from the host 100, various types of control information to control the image-recording process such as the recording-sheet mode from the control panel 8 shown in FIG. 1, and signals from sensors located in the image-recording device 1 such as the home-position sensor detecting the home position (standard position) of the carriage 13, and the sheet-density sensors 81 and 82. Additionally, the control unit outputs information necessary to control the image-recording device 1 through the PIO port 64 to the host 100 and the control panel 8.

A description will now be given of a first example of a sheet-type detecting process executed by the sheet-type detection sensor 80 according to a sixth embodiment of the present invention with reference to FIGS. 66 and 67.

Figure 66:
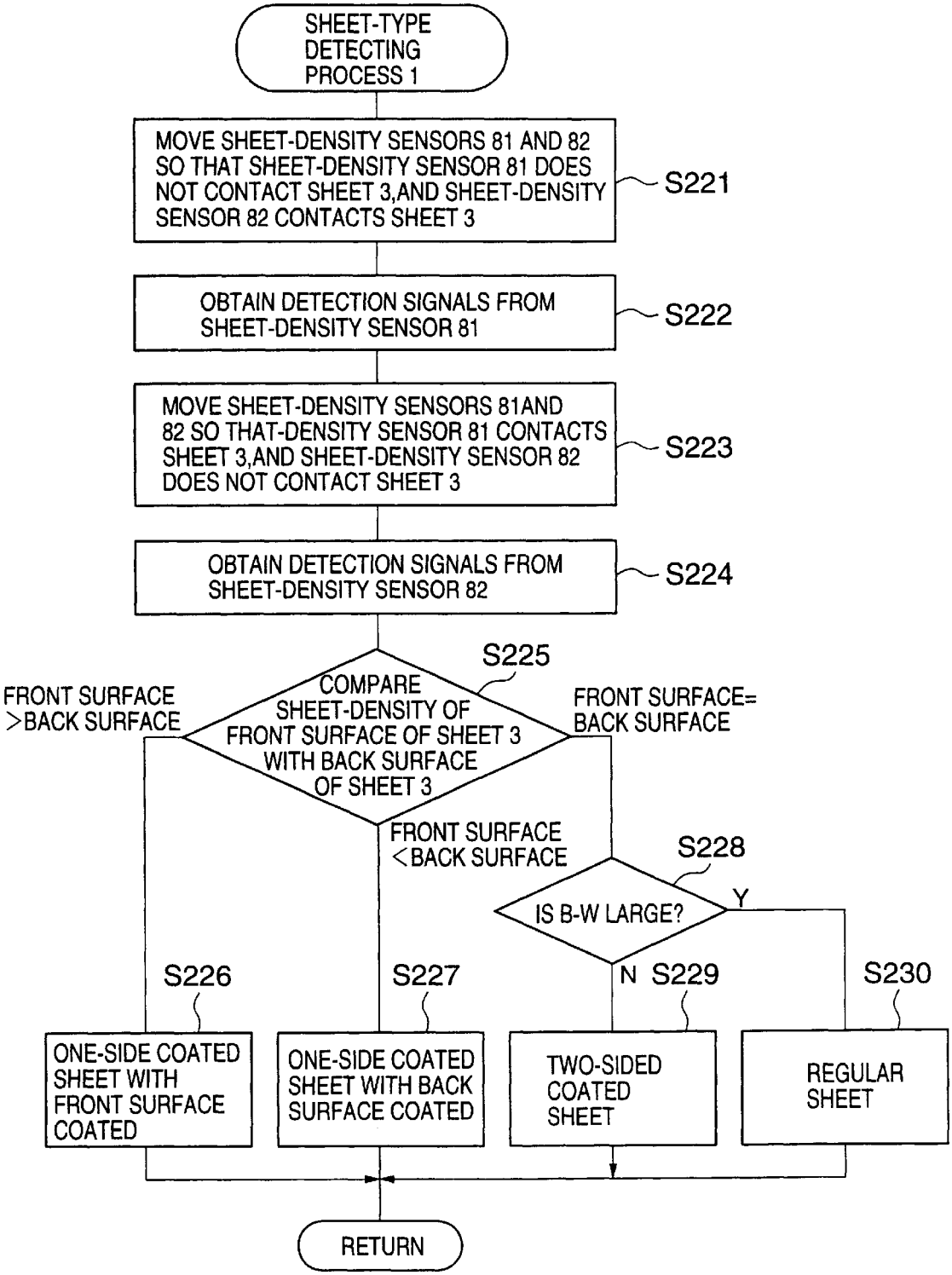
FIG. 66 is a flowchart for describing a first example of a sheet-type detecting process according to a sixth embodiment of the present invention.

At a step S221 in FIG. 66, the control unit initially controls the sheet-density sensor 81 not to touch the sheet 3 and the sheet-density sensor 82 to contact the sheet 3 by use of the solenoids 74 and 75 as shown in FIG. 62. Subsequently, at a step S222, the control unit makes the light-emitting unit 83 of the sheet-density sensor 81 emit light. The emitted light is reflected by the surface of the sheet 3, and the light-intercepting unit 85 of the sheet-density sensor 81 receives the reflected light. Additionally, at the step S222, the control unit makes the light-emitting unit 87 of the sheet-density sensor 81 emit light. The emitted light is reflected by the surface of the sheet 3, and the light-intercepting unit 85 of the sheet-density sensor 81 receives the reflected light. The control unit obtains a detection signal corresponding to the light that is emitted from the light-emitting unit 83 and is reflected by the surface of the sheet 3 with the black reflector 84 located underneath the sheet 3, and a detection signal corresponding to the light that is emitted from the light-emitting unit 87 and is reflected by the surface of the sheet 3 with the white reflector 86 located underneath the sheet 3, from the light-intercepting unit 85. Accordingly, the control unit can detect the sheet density of one side (a front surface) of the sheet 3 from the obtained detection signals.

It should be noted that, hereinafter, the sheet density obtained by the control unit when the light is emitted from the light-emitting unit 83 and is reflected by the surface of the sheet 3 with the black reflector 84 located underneath the sheet 3 is called a black-reflector sheet density, and the sheet density obtained by the control unit when the light is emitted from the light-emitting unit 87 and is reflected by the surface of the sheet 3 with the white reflector 86 located underneath the-sheet 3 is called a white-reflector sheet density.

At a step S223, the control unit initially controls the sheet-density sensor 81 to contact the sheet 3 and the sheet-density sensor 82 not to touch the sheet 3 by use of the solenoids 74 and 75 as shown in FIG. 63. Subsequently, at a step S224, the control unit obtains a detection signal corresponding to the light that is emitted from the light-emitting unit 83 of the sheet-density sensor 82 and is reflected by the surface of the sheet 3 with the black reflector 84 located underneath the sheet 3, and a detection signal corresponding to the light that is emitted from the light-emitting unit 87 of the sheet-density sensor 82 and is reflected by the surface of the sheet 3 with the white reflector 86 located underneath the sheet 3, from the light-intercepting unit 85 of the sheet-density sensor 82 similarly to the step S222. Accordingly, the control unit can determine the black-reflector sheet density and the white-reflector sheet density from the detection signals obtained from the light-intercepting unit 85 of the sheet-density sensor 82. Additionally, the control unit can detect the sheet density of the other side (a back surface) of the sheet 3.

Figure 67:
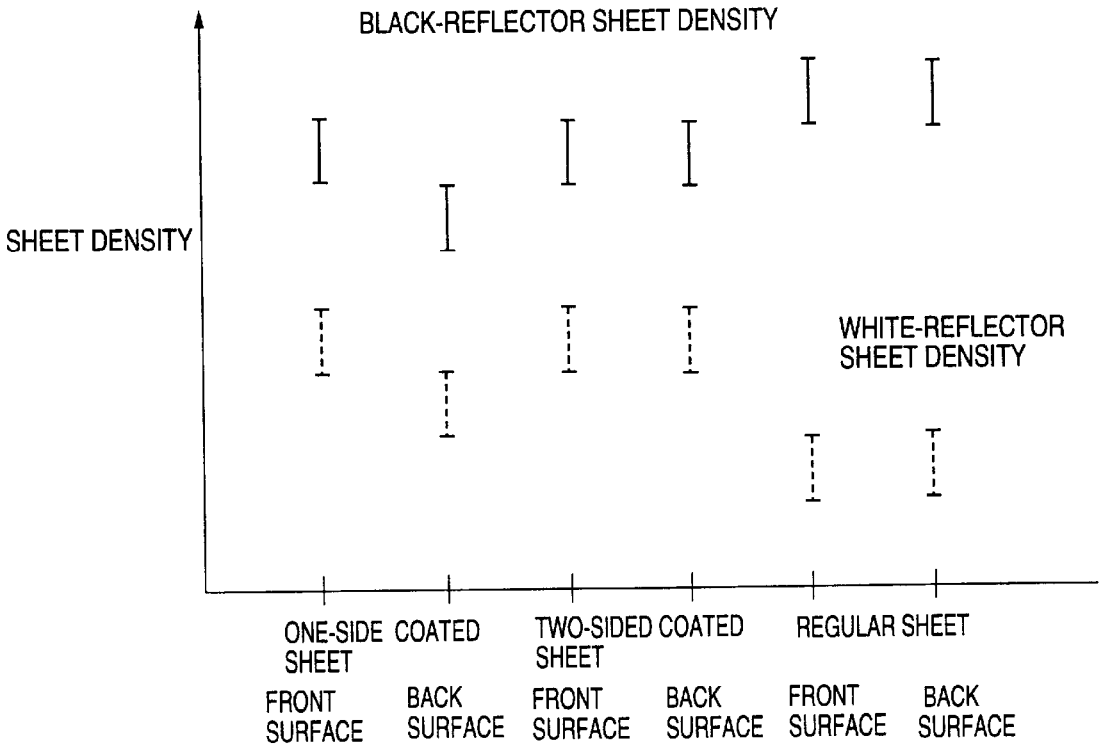
FIG. 67 is a diagram showing distribution of sheet density detected by the sheet-type detection sensor in the first example of the sheet-type detecting process.

The black-reflector sheet density and the white-reflector sheet density of each type of the sheet 3 are shown in FIG. 67. Ranges for the black-reflector sheet density are shown in solid lines, and the ranges for the white-reflector sheet density are shown in broken lines. A one-side coated sheet includes a coated surface with the coating layers and a regular surface as the other surface of the sheet. The black-reflector sheet density and the white-reflector sheet density of the coated surface are respectively higher than the black-reflector sheet density and the white-reflector sheet density of the regular surface. The black-reflector sheet density of a both-sides coated sheet which surfaces are coated and a regular sheet which surfaces are regular surfaces are respectively same as the white-reflector sheet density of the both-sides coated sheet and-the regular sheet. Accordingly, if the black-reflector sheet density or the white-reflector sheet density of a surface of the sheet 3 is respectively different from the black-reflector sheet density or the white-reflector sheet density of the other surface of the sheet 3, the sheet 3 is determined as the one-side coated sheet.

Since the difference between the black-reflector sheet density and the white-reflector sheet density of the both-sides coated sheet is smaller than that of the regular-sheet, the both-sides coated sheet can be distinguished from the regular sheet. It should be noted that the difference between the black-reflector sheet density and the white-reflector sheet density is shown as "B-W"in the figures.

Accordingly, at a step S225 on FIG. 66, the control unit checks the sheet density obtained from the sheet-density sensor 81 and the sheet density obtained from the sheet-density sensor 82. If it is ascertained at the step S225 that the sheet density obtained from the sheet-density sensor 81 is higher than the sheet density obtained from the sheet-density sensor 82, the control unit decides that the sheet 3 is the one-side coated sheet wherein the front surface of the sheet is coated at a step S226. If it is ascertained at the step S225 that the sheet density obtained from the sheet-density sensor 81 is lower than the sheet density obtained from the sheet-density sensor 82, the control unit decides that the sheet 3 is the one-side coated sheet wherein the back surface of the sheet is coated at a step S227.

If it is ascertained at the step S225 that the sheet density obtained from the sheet-density sensor 81 is equal to the sheet density obtained from the sheet-density sensor 82, the control unit additionally checks the difference between the black-reflector sheet density and the white-reflector sheet density of a surface is large enough to detect the sheet 3 as the regular sheet at a step S228. If not, the control unit decides that the sheet 3 is the both-sides coated sheet at a step S229. If the difference between the black-reflector sheet density and the white-reflector sheet density of a surface is large enough, the control unit decides that the sheet 3 is the regular sheet at a step S230.

By comparing the sheet density obtained from the sheet-density sensor 81 and the sheet density obtained from the sheet-density sensor 82, the control unit can detect the coated surface and the regular surface. Accordingly, the image-recording device 1 can record an image only on the coated surface or only on the regular surface of the sheet 3. Additionally, the image-recording device 1 can notify the host device 100 if the sheet 3 is inserted thereto with its coated surface and its regular surface swapped.

According to the first example of the sheet-type detecting process, by use of the sheet-type detection sensor 80, the image-recording device 1 can detect a type of the sheet 3 such as the one-side coated sheet, the both-sides coated sheet or the regular sheet, and additionally can determine whether a surface of the sheet 3 is coated or not so that the front surface and the back surface of the one-side coated sheet can be detected.

Figure 68:
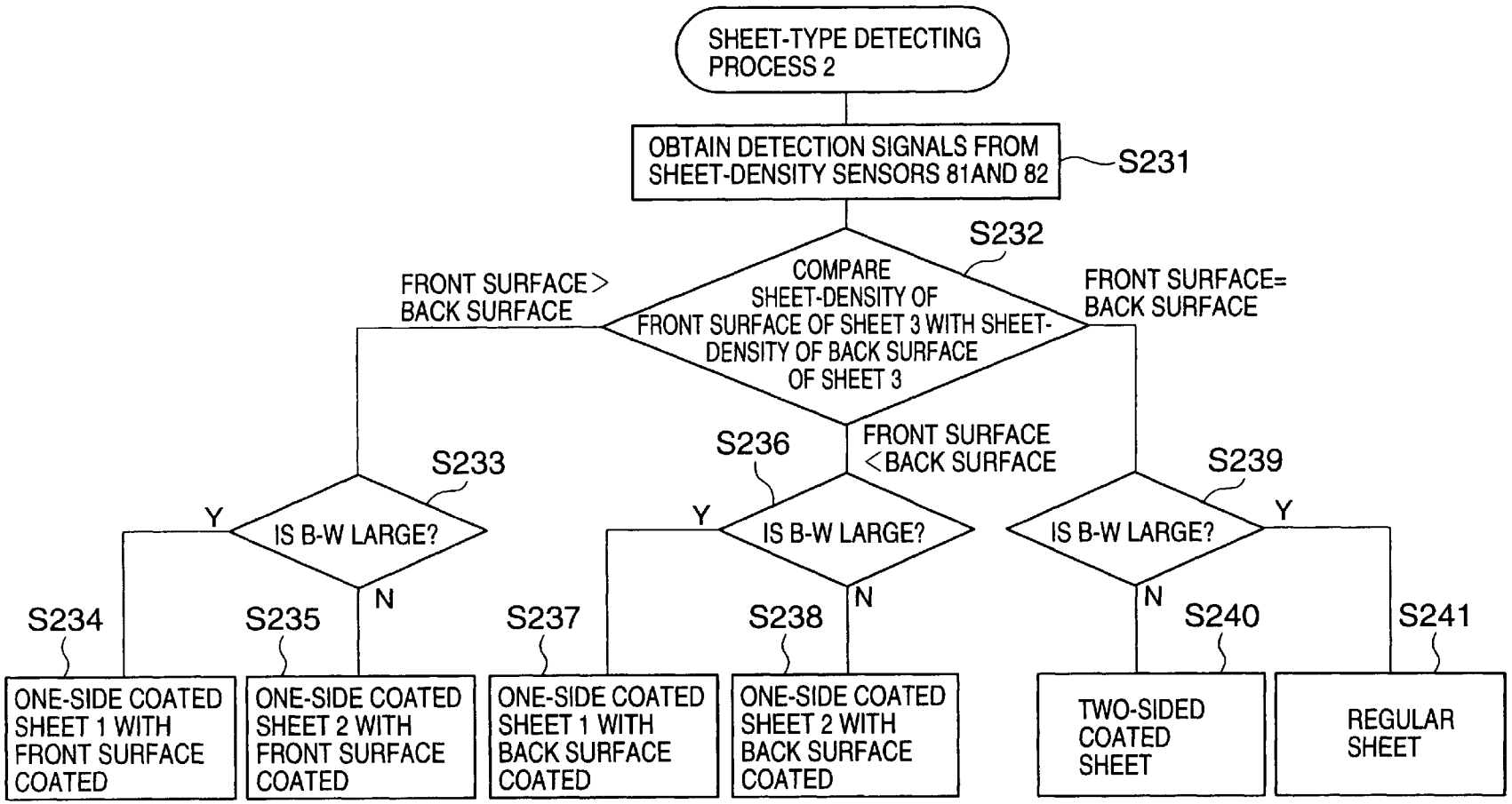
FIG. 68 is a flowchart for describing a second example of the sheet-type detecting process according to the sixth embodiment of the present invention.

A description will now be given of a second example of the sheet-type detecting process executed by the sheet-type detection sensor 80 with reference to FIGS. 68 and 69.

The second example of the sheet-type detecting process enables the control unit to detect a one-side coated sheet 1 and a one-side coated sheet 2. The sheet density of the coated surface of the one-side coated sheet 1 is lower than that of the one-side coated sheet 2. Additionally, the density difference between the black-reflector sheet density and the white-reflector sheet density (B-W) on a surface of the one-side coated sheet 1 is larger than that of the one-side coated sheet 2. Accordingly, by comparing the above-described sheet density or density difference between the one-side coated sheet 1 and the one-side coated sheet 2, the control unit can determine whether the sheet 3 is the one-side coated sheet 1 or the one-side coated sheet 2.

The control unit initially obtains the detection signals from the sheet-density sensors 81 and 82 at a step S231 similarly to the step S221 through the step S224 shown in FIG. 66. Subsequently, at a step S232, the control unit checks the density difference between the sheet density obtained from the sheet-density sensor 81 and the sheet density obtained from the sheet-density sensor 82. If it is ascertained at the step S232 that the sheet density obtained from the sheet-density sensor 81 is higher than the sheet density obtained from the sheet-density sensor 82, the control unit proceeds to a step S233, and decides whether the density difference between the black-reflector sheet density and the white-reflector sheet density on the sheet 3 is large enough to detect the sheet 3 as the one-side coated sheet 1. If the difference is large enough, the control unit decides that the sheet 3 is the one-side coated sheet 1 wherein the front surface of the sheet is coated at a step S234. If the difference is not large enough to detect the sheet 3 as the one-side coated sheet 1, the control unit detects that the sheet 3 is the one-side coated sheet 2 wherein the front surface of the sheet is coated at a step S235.

If it is ascertained at the step S232 that the sheet density obtained from the sheet-density sensor 81 is lower than the sheet density obtained from the sheet-density sensor 82, the control unit proceeds to a step S236, and decides whether the density difference between the black-reflector sheet density and the white-reflector sheet density on the sheet 3 is large enough to detect the sheet 3 as the one-side coated sheet 1. If the difference is large enough, the control unit decides that the sheet 3 is the one-side coated sheet 1 wherein the back surface of the sheet is coated at a step S237. If the difference is not large enough to detect the sheet 3 as the one-side coated sheet 1, the control unit detects that the sheet 3 is the one-side coated sheet 2 wherein the back surface of the sheet is coated at a step S238.

If it is ascertained at the step S232 that the sheet density obtained from the sheet-density sensor 81 is equal to the sheet density obtained from the sheet-density sensor 82, the control unit additionally checks the difference between the black-reflector sheet density and the white-reflector sheet density of a surface is large enough to be detected as the regular sheet at a step S239. If not, the control unit decides that the sheet 3 is the both-sides coated sheet at a step S240. If the difference between the black-reflector sheet density and the white-reflector sheet density of a surface is large enough, the control unit decides that the sheet 3 is the regular sheet at a step S241.

According to the second example of the sheet-type detecting process, the image-recording device can detect different types of the one-side coated sheet by checking the density difference between the black-reflector sheet density and the white-reflector sheet density on a surface of each type of the one-side coated sheet.

A description will now be given of a third example of the sheet-type detecting process executed by the sheet-type detection sensor 80 with reference to FIGS. 69 and 70.

Figure 69:
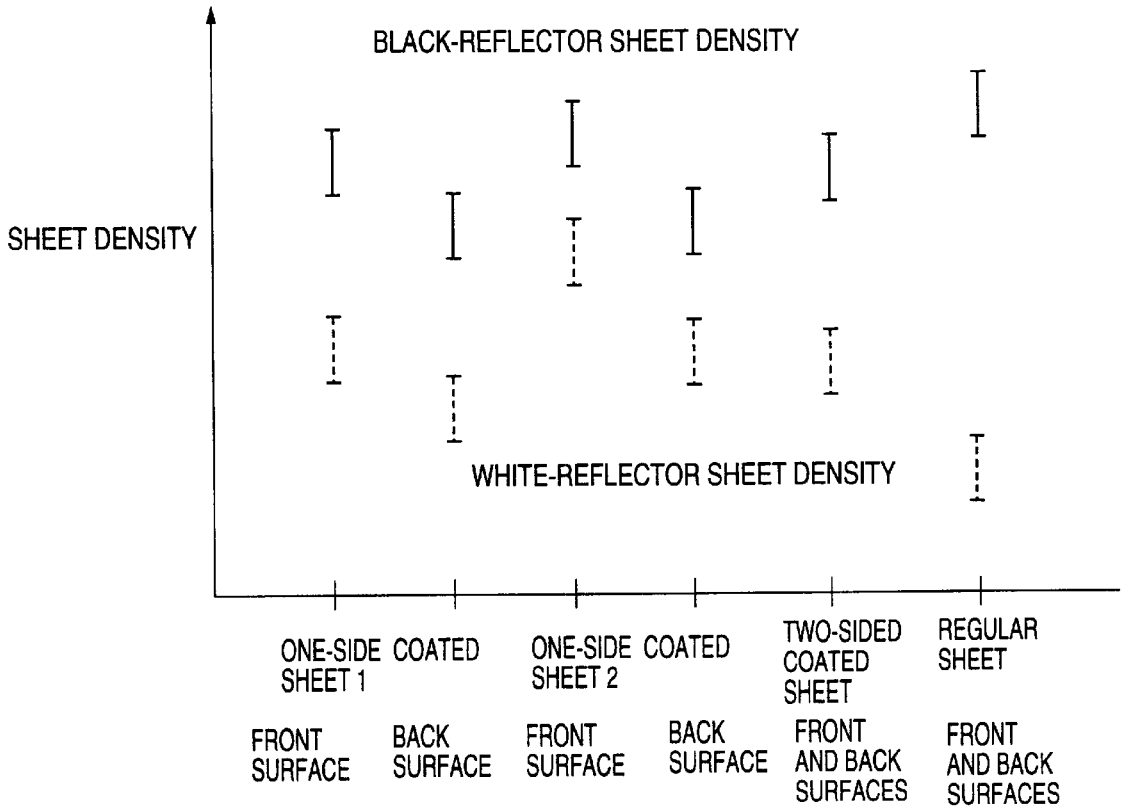
FIG. 69 is a diagram showing distribution of sheet density detected by the sheet-type detection sensor in the second example of the sheet-type detecting process.
Figure 70:
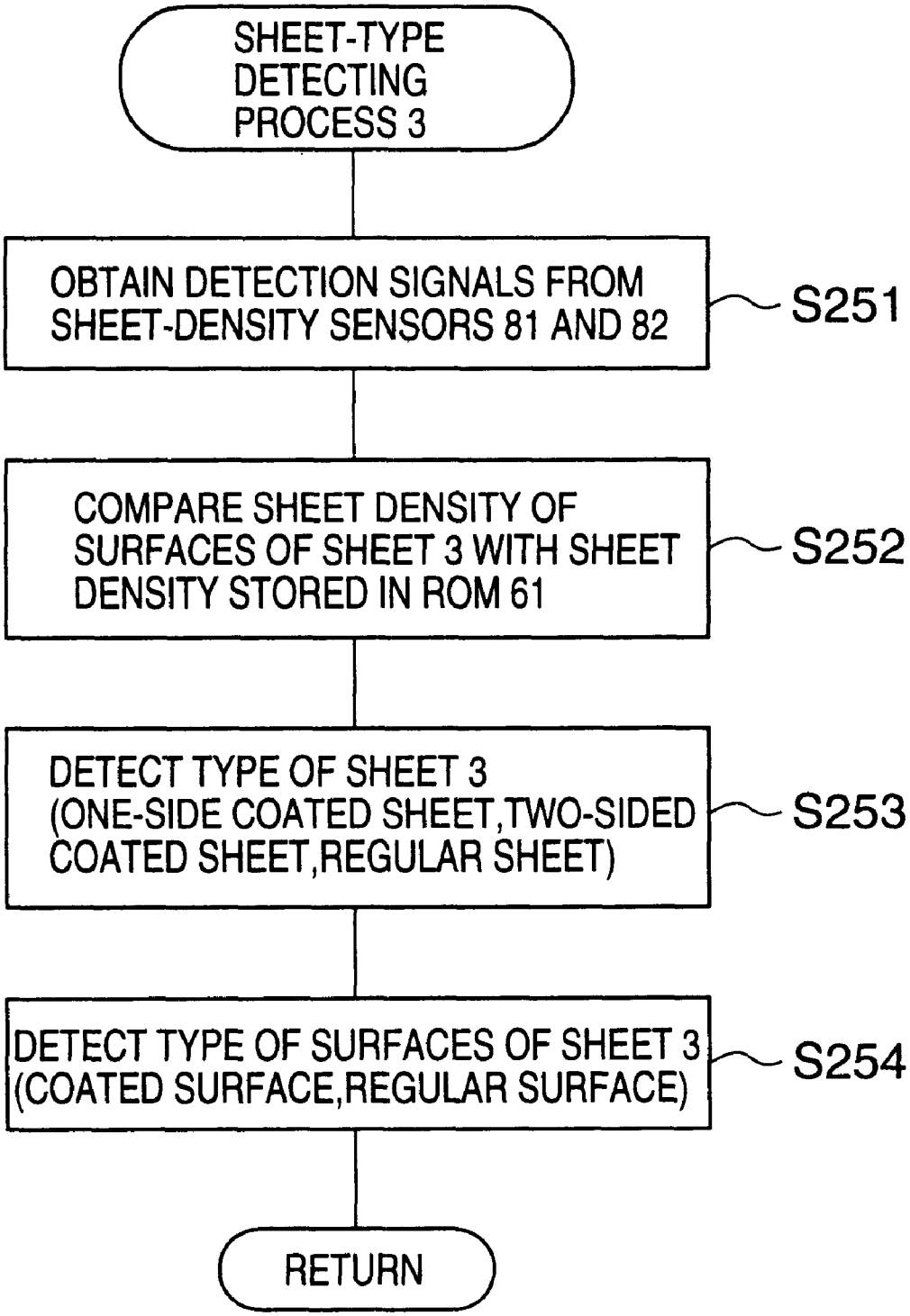
FIG. 70 is a flowchart for describing a third example of the sheet-type detecting process according to the sixth embodiment of the present invention.

In the third example of the sheet-type detecting process, the control unit stores the black-reflector sheet density and the white-reflector sheet density for surfaces of each sheet 3 as shown in FIG. 69 in the ROM 61 of the control unit. The control unit initially obtains the black-reflector sheet density and the white-reflector sheet density for the surfaces of the sheet 3 from the sheet-density sensors 81 and 82 at a step S251 in FIG. 70 similarly to the step S221 through the step S224 shown in FIG. 66. Subsequently, at a step S252, the control unit compares the obtained black-reflector sheet density and white-reflector sheet density with black-reflector sheet density and white-reflector sheet density stored in the ROM 61. At a step S253, the control unit detects the type of the sheet 3 according to the black-reflector sheet density and the white-reflector sheet density stored in the ROM 61 that match the black-reflector sheet density and the white-reflector sheet density that are obtained at the step S251. Subsequently, at a step S254, the control unit detects the front and the back surfaces, and the coated surface and the regular surface of the sheet 3.

According to the third example of the sheet-type detecting process, the image-recording device 1 can correctly detect a plurality of sheet types such as the one-side coated sheet, the both-sides coated sheet and the regular sheet, a surface type such as the coated surface and the regular surface, and the front and back surfaces by comparing the black-reflector sheet density and the white-reflector sheet density that are obtained from the sheet 3 with black-reflector sheet density and white-reflector sheet density stored in the ROM 61.

Additionally, the image-recording device 1 can detect a plurality of the sheet types by substituting color sensors to the sheet-density sensors 81 and 82.

Figure 71:
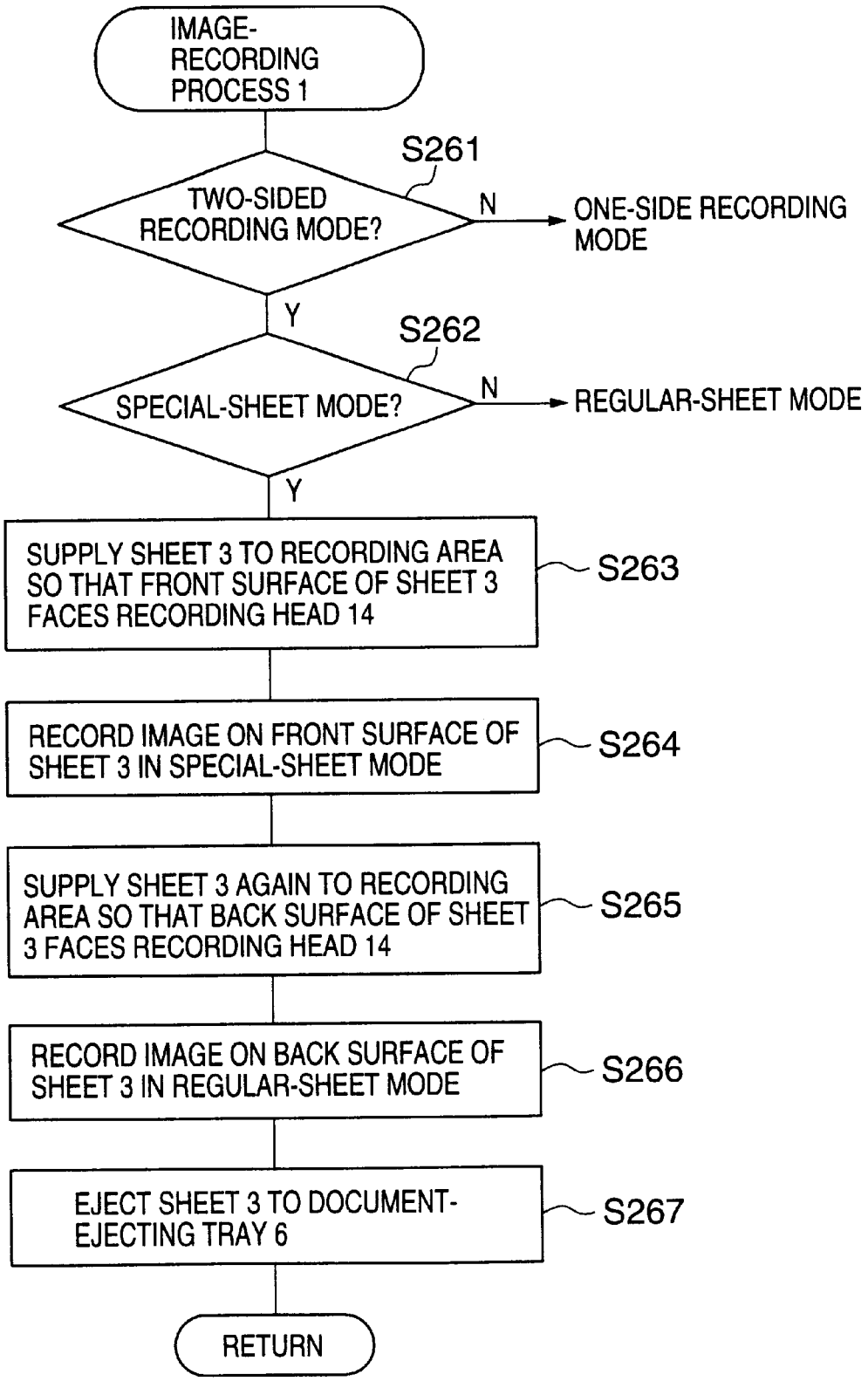
FIG. 71 is a flowchart for describing a first example of an image-recording process according to a seventh embodiment of the present invention.

A description will now be given of a first example of an image-recording process according to a seventh embodiment of the present invention with reference to FIG. 71. In order to describe the first example of the image-recording process, it is assumed that the sheet 3 is a one-side coated sheet that is provided to the document cassette 4 so that a coated surface (a front surface) is recorded at first, and a regular surface (a back surface) is recorded next in the two-sided recording mode.

The control unit located in the image-recording device 1 initially checks whether the recording-side mode is set to the two-sided recording mode or the one-side recording mode at a step S261. If it is ascertained at the step S261 that the recording-side mode is set to the one-side recording mode, the image-recording device 1 records an image on a surface of the sheet 3. If it is ascertained at the step S261 that the recording-side mode is set to the two-sided recording mode, the control unit proceeds to a step S262, and checks whether the recording-sheet mode is the special-sheet mode or the regular-sheet mode. If it is ascertained at the step S262 that the recording-sheet mode is the regular-sheet mode, the image-recording device 1 records images on both surfaces of the sheet 3 in the regular-sheet mode. If it is ascertained at the step S262 that the recording-sheet mode is the two-sided recording mode, the control unit proceeds to a step S263, and supplies the sheet 3 from the document cassette 4 to the recording area.

At a step S264, the image-recording device 1 records an image on the front surface of the sheet 3 that is coated in the special-sheet mode since the sheet 3 is supplied to the recording area so that the front surface is recorded at first. Subsequently, the image-recording device 1 swaps the sheet 3 so that the back surface of the sheet 3 as shown in FIG. 5, and supplies the sheet 3 again to the recording area at a step S265. The image-recording device 1 then records an image on the back surface of the sheet 3 in the regular-sheet mode at a step S266, and ejects the sheet 3 to the document-ejecting tray 6 at a step S267 after recording the image.

According to the first example of the image-recording process, when the recording-side mode is set to the two-sided recording mode, and the recording-sheet mode is set to the special-sheet mode, the image-recording device 1 can record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by recording the image on the coated surface in the special-sheet mode, and by recording the image on the regular surface in the regular-sheet mode.

Figure 72:
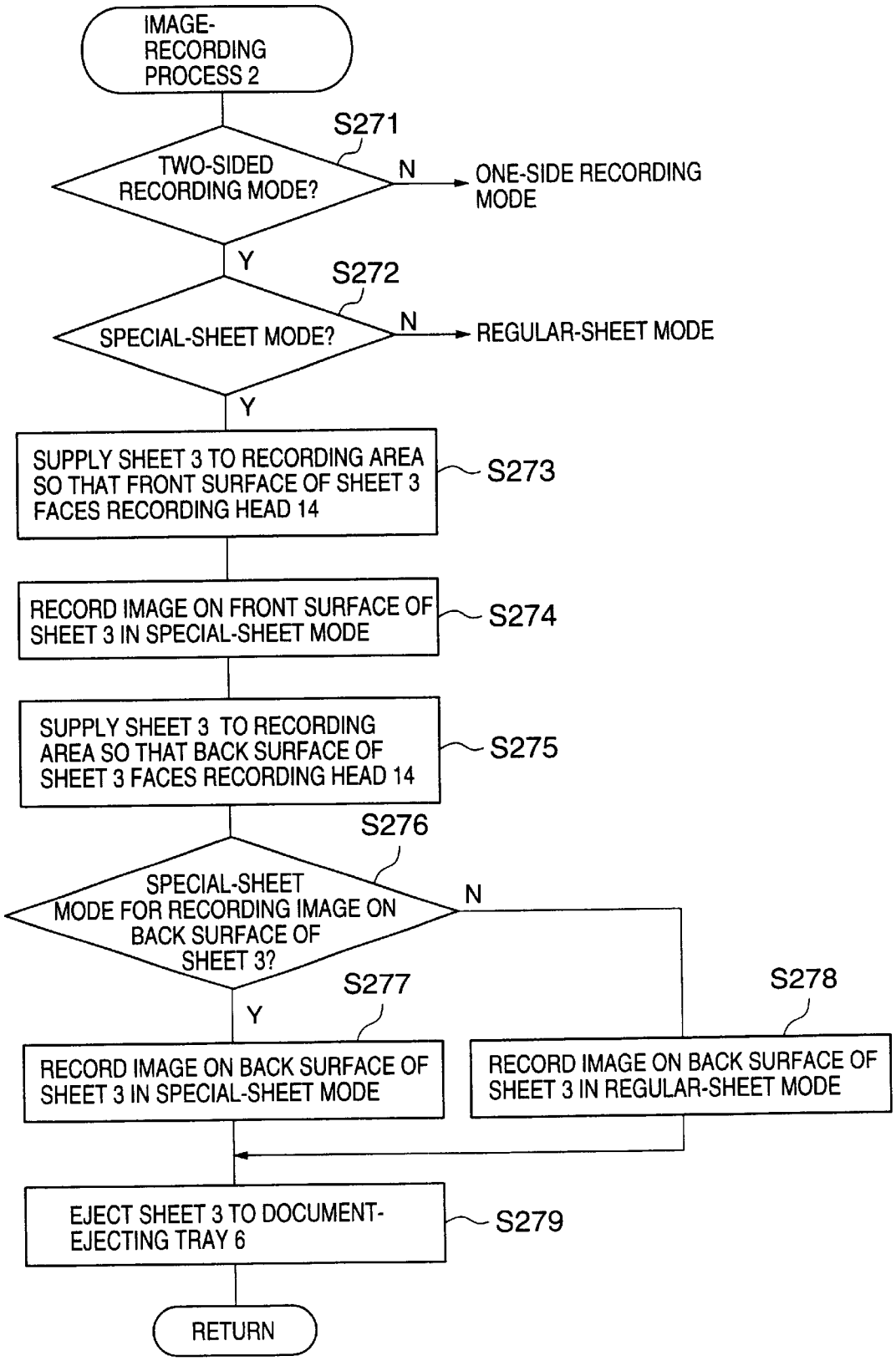
FIG. 72 is a flowchart for describing a second example of the image-recording process according to the seventh embodiment of the present invention.

A description will now be given of a second example of the image-recording process with reference to FIG. 72. In order to describe the second example of the image-recording process, it is assumed that the sheet 3 is a one-side coated sheet that is provided to the document cassette 4 so that a coated surface (a front surface) is recorded at first, and a regular surface (a back surface) is recorded next in the two-sided recording mode.

The control unit located in the image-recording device 1 initially checks whether the recording-side mode is set to the two-sided recording mode or the one-side recording mode at a step S271. If it is ascertained at the step S271 that the recording-side mode is set to the one-side recording mode, the image-recording device 1 records an image on a surface of the sheet 3. If it is ascertained at the step S271 that the recording-side mode is set to the two-sided recording mode, the control unit proceeds to a step S272, and checks whether the recording-sheet mode is the special-sheet mode or the regular-sheet mode. If it is ascertained at the step S272 that the recording-sheet mode is the regular-sheet mode, the image-recording device 1 records images on both surfaces of the sheet 3 in the regular-sheet mode. If it is ascertained at the step S272 that the recording-sheet mode is the two-sided recording mode, the control unit proceeds to a step S273, and supplies the sheet 3 from the document cassette 4 to the recording area. At a step S274, the image-recording device 1 records an image on the front surface of the sheet 3 that is coated in the special-sheet mode since the sheet 3 is supplied to the recording area so that the front surface is recorded at first. Subsequently, the image-recording device 1 swaps the sheet 3 so that the back surface of the sheet 3 as shown in FIG. 5, and supplies the sheet 3 again to the recording area at a step S275. At a step S276, the control unit checks whether the recording-sheet mode for recording an image on the back surface is the special-sheet mode or the regular-sheet mode. If it is ascertained at the step S276 that the recording-sheet mode is the special-sheet mode, the image-recording device 1 records an image in the special-sheet mode at a step S277, and ejects the sheet 3 to the document-ejecting tray 6 at a step S279 after recording the image. If it is ascertained at the step S276 that the recording-sheet mode is the regular-sheet mode, the image-recording device 1 records an image in the regular-sheet mode at a step S278, and ejects the sheet 3 to the document-ejecting tray 6 at a step S279 after recording the image.

According to the second example of the image-recording process, when the recording-side mode is set to the two-sided recording mode, and the recording-sheet mode is set to the special-sheet mode, the image-recording device 1 can record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by recording the image on the coated surface in the special-sheet mode, and by recording the image on the regular surface in the regular-sheet mode. Additionally, since the image-recording device 1 can select the recording-sheet mode between the special-sheet mode and the regular-sheet mode for recording an image on the back surface of the sheet 3, the image-recording device 1 can record images on coated surfaces of a both-sides coated sheet in the special-sheet mode not to decrease quality of the images and recording speed of the image-recording device 1 by selecting the special-sheet mode for the coated surfaces.

Figure 73:
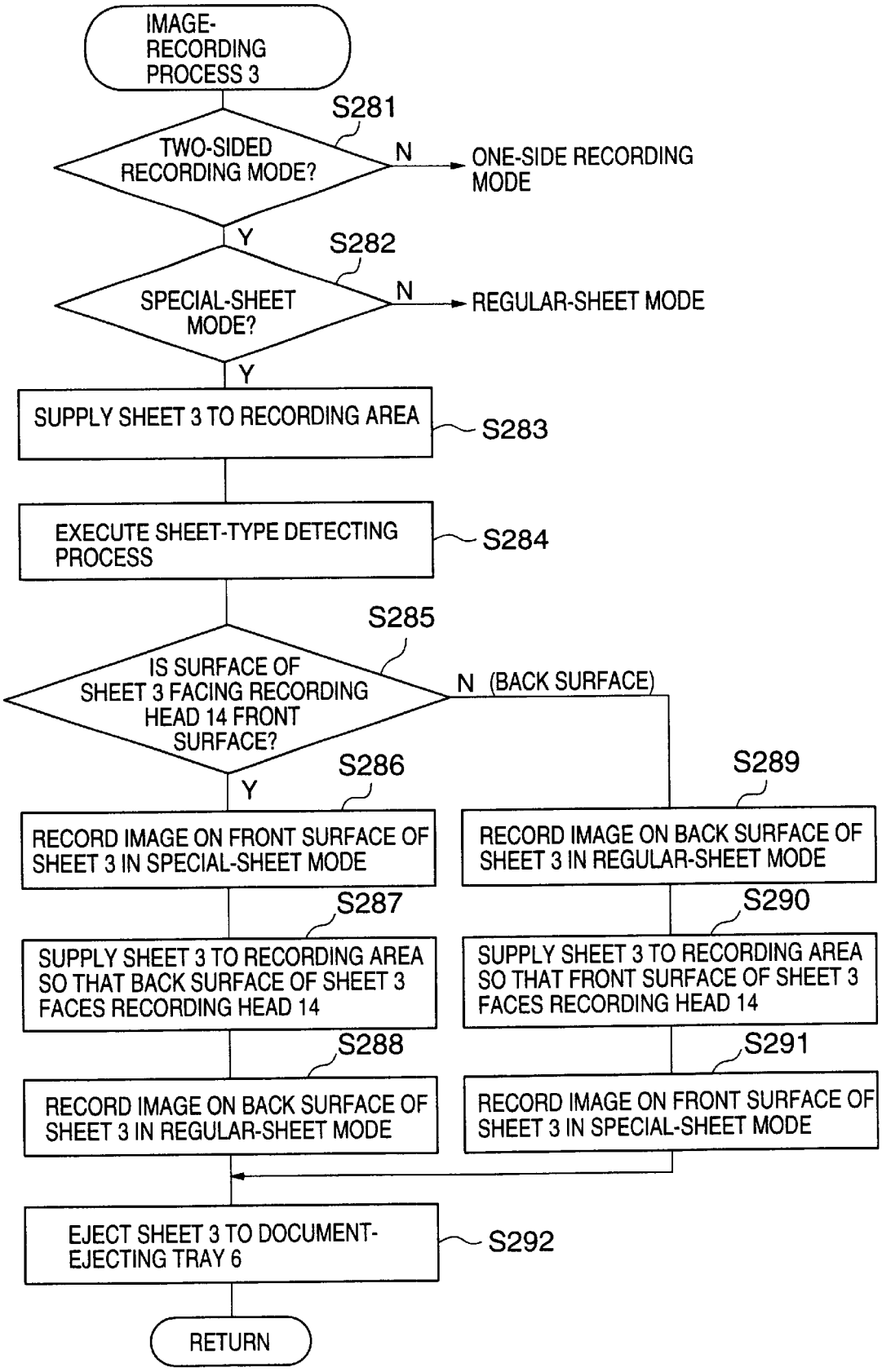
FIG. 73 is a flowchart for describing a third example of the image-recording process according to the seventh embodiment of the present invention.

A description will now be given of a third example of the image-recording process with reference to FIG. 73. In order to describe the third example of the image-recording process, it is assumed that the sheet 3 is a one-side coated sheet wherein it is not specified which surface is coated.

The control unit located in the image-recording device 1 initially checks whether the recording-side mode is set to the two-sided recording mode or the one-side recording mode at a step S281. If it is ascertained at the step S281 that the recording-side mode is set to the one-side recording mode, the image-recording device 1 records an image on a surface of the sheet 3. If it is ascertained at the step S281 that the recording-side mode is set to the two-sided recording mode, the control unit proceeds to a step S282, and checks whether the recording-sheet mode is the special-sheet mode or the regular-sheet mode. If it is ascertained at the step S282 that the recording-sheet mode is the regular-sheet mode, the image-recording device 1 records images on both surfaces of the sheet 3 in the regular-sheet mode. If it is ascertained at the step S282 that the recording-sheet mode is set to the two-sided recording mode, the control unit proceeds to a step S283, and supplies the sheet 3 from the document cassette 4 to the recording area.

At a step S284, the control unit executes the above-described sheet-type detecting process, and checks whether a surface of the sheet 3 facing the recording head 14 in the recording area is the coated surface or the regular surface at a step S285. If it is ascertained at the step S285 that the surface is the coated surface (the front surface), the image-recording device 1 records an image on the coated surface in the special-sheet mode at a step S286. Subsequently, the image-recording device 1 supplies the sheet 3 to the recording area so that the regular surface (the back surface) faces the recording head 14 at a step S287, and records an image on the regular surface in the regular-sheet mode at a step S288. The image-recording device 1 then ejects the sheet 3 to the document-ejecting tray 6 at a step S292.

If it is ascertained at the step S285 that the surface is the regular surface (the back surface), the image-recording device 1 records an image on the regular surface in the regular-sheet mode at a step S289. Subsequently, the image-recording device 1 supplies the sheet 3 to the recording area so that the coated surface (the front surface) faces the recording head 14 at a step S290, and records an image on the coated surface in the special-sheet mode at a step S291. The image-recording device 1 then ejects the sheet 3 to the document-ejecting tray 6 at a step S292.

According to the third example of the image-recording process, when the recording-side mode is set to the two-sided recording mode, and the recording-sheet mode is set to the special-sheet mode, the image-recording device 1 can record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by detecting the coated surface and recording the image on the coated surface in the special-sheet mode, and by detecting the regular surface and recording the image on the regular surface in the regular-sheet mode. Additionally, since the image-recording device 1 can detect the type of a surface of the sheet 3 in the sheet-type detecting process, the image-recording device 1 can record an image on the surface in a recording-sheet mode that is appropriate to characteristics of the surface.

Figure 74:
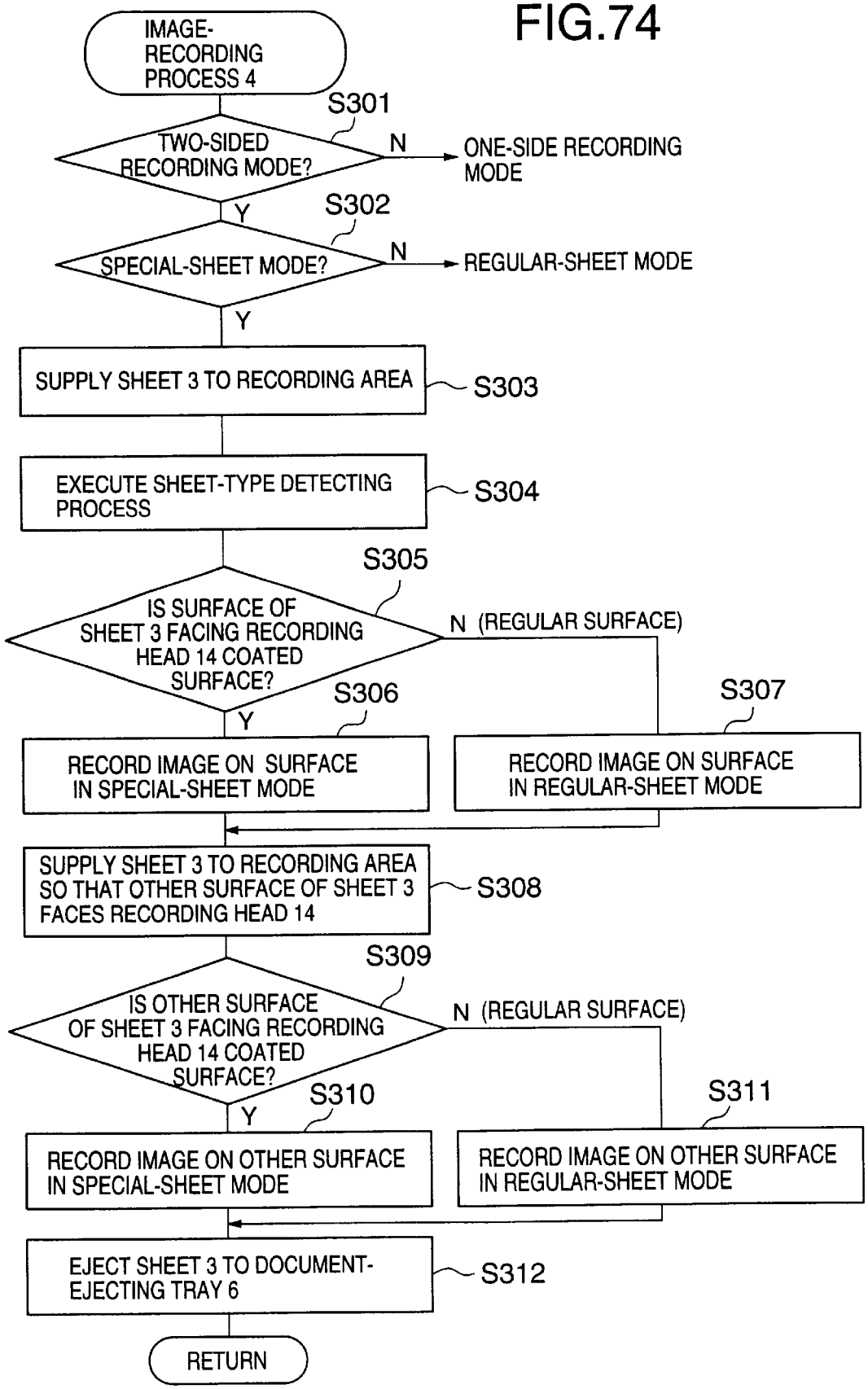
FIG. 74 is a flowchart for describing a fourth example of the image-recording process according to the seventh embodiment of the present invention.

A description will now be given of a fourth example of the image-recording process with reference to FIG. 74. In order to describe the fourth example of the image-recording process, the sheet 3 may be a one-side coated sheet wherein it is not specified which surface is coated, a both-sides coated sheet or a regular sheet.

The control unit located in the image-recording device 1 initially checks whether the recording-side mode is set to the two-sided recording mode or the one-side recording mode at a step S301. If it is ascertained at the step S301 that the recording-side mode is set to the one-side recording mode, the image-recording device 1 records an image on a surface of the sheet 3. If it is ascertained at the step S301 that the recording-side mode is set to the two-sided recording mode, the control unit proceeds to a step S302, and checks whether the recording-sheet mode is the special-sheet mode or the regular-sheet mode. If it is ascertained at the step S302 that the recording-sheet mode is the regular-sheet mode, the image-recording device 1 records images on both surfaces of the sheet 3 in the regular-sheet mode. If it is ascertained at the step S302 that the recording-sheet mode is the two-sided recording mode, the control unit proceeds to a step S303, and supplies the sheet 3 from the document cassette 4 to the recording area.

At a step S304, the control unit executes the above-described sheet-type detecting process, and checks whether a surface of the sheet 3 facing the recording head 14 in the recording area is the coated surface or the regular surface at a step S305. If it is ascertained at the step S305 that the surface is the coated surface, the image-recording device 1 records an image on the coated surface in the special-sheet mode at a step S306, and proceeds to a step S308. If it is ascertained at the step S305 that the surface is the regular surface, the image-recording device 1 records the image on the regular surface in the regular-sheet mode at a step S307, and proceeds to the step S308.

At the step S308, the image-recording device 1 supplies the sheet 3 to the recording area so that the other surface faces the recording head 14. Subsequently, at a step S309, the control unit checks whether the other surface of the sheet 3 facing the recording head 14 in the recording area is the coated surface or the regular surface. If it is ascertained at the step S309 that the surface is the coated surface, the image-recording device 1 records an image on the coated surface in the special-sheet mode at a step S310, and ejects the sheet 3 to the document-ejecting tray 6 at a step S312. If it is ascertained at the step S309 that the surface is the regular surface, the image-recording device 1 records the image on the regular surface in the regular-sheet mode at a step S311, and ejects the sheet 3 to the document-ejecting tray 6 at the step S312.

According to the fourth example of the image-recording process, when the recording-side mode is set to the two-sided recording mode, and the recording-sheet mode is set to the special-sheet mode, the image-recording device 1 can record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by detecting the coated surface and recording the image on the coated surface in the special-sheet mode, and by detecting the regular surface and recording the image on the regular surface in the regular-sheet mode. Additionally, since the image-recording device 1 can detect the type of a surface of the sheet 3 in the sheet-type detecting process, the image-recording device 1 can record an image on the surface in a recording-sheet mode that is appropriate to characteristics of the surface.

Figure 75:
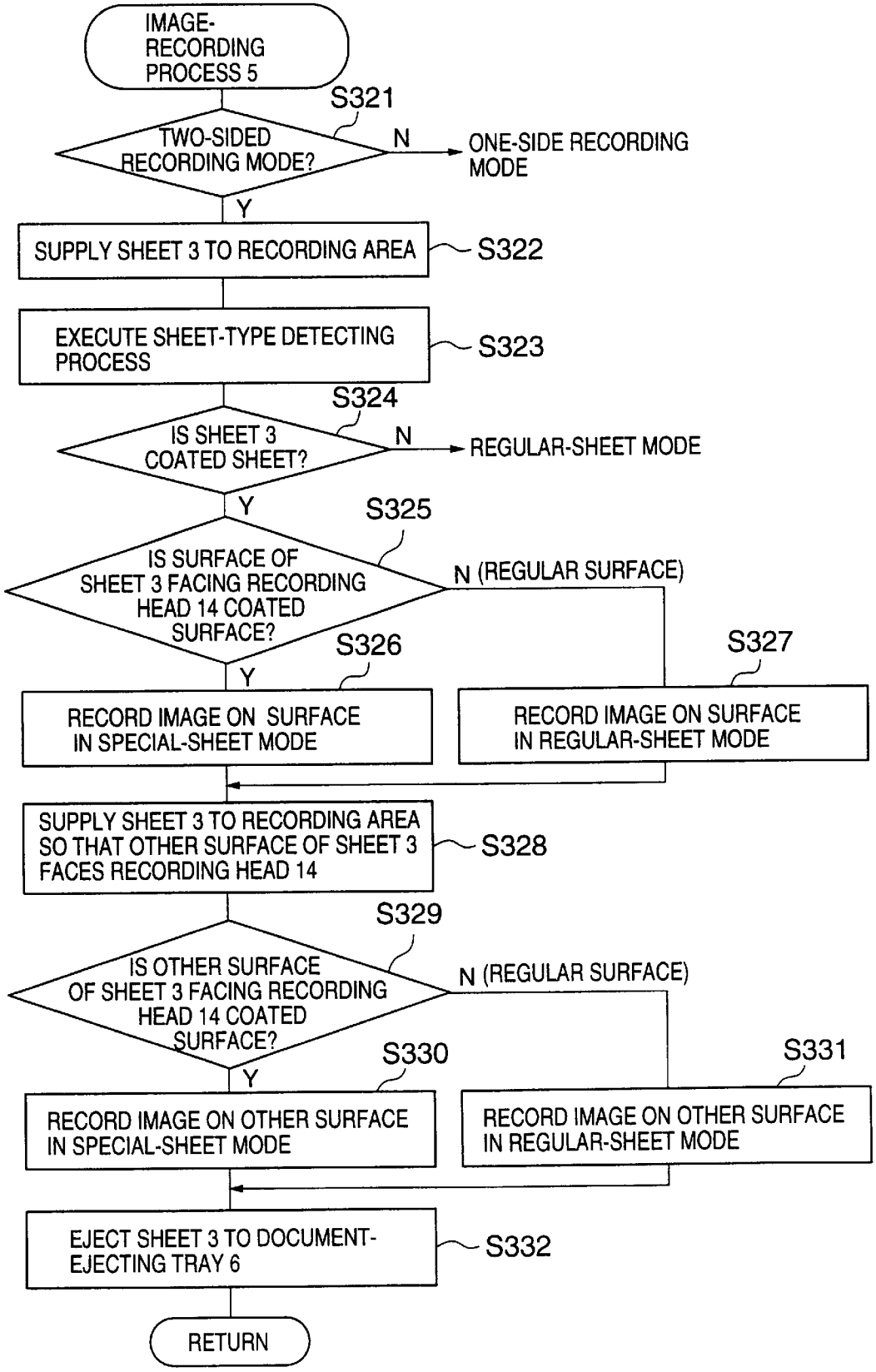
FIG. 75 is a flowchart for describing a fifth example of the image-recording process according to the seventh embodiment of the present invention.

A description will now be given of a fifth example of the image-recording process with reference to FIG. 75. In order to describe the fifth example of the image-recording process, the sheet 3 may be a one-side coated sheet wherein it is not specified which surface is coated, a both-sides coated sheet or a regular sheet. When the recording-side mode is set to the two-sided recording mode, a recording-sheet mode appropriate to characteristics of a surface of the sheet 3 is selected by the sheet-type detecting process.

The control unit located in the image-recording device 1 initially checks whether the recording-side mode is set to the two-sided recording mode or the one-side recording mode at a step S321. If it is ascertained at the step S321 that the recording-side mode is set to the one-side recording mode, the image-recording device 1 records an image on a surface of the sheet 3. If it is ascertained at the step S321 that the recording-side mode is set to the two-sided recording mode, the image-recording device 1 supplies the sheet 3 from the document cassette 4 to the recording area at a step S322. Subsequently, at a step S323, the control unit executes the sheet-type detecting process, and checks whether the sheet 3 is a coated sheet or a regular sheet at a step S324. If it is ascertained at the step S324 that the sheet 3 is the regular sheet, the image-recording device 1 records images on both surfaces of the sheet 3 in the regular-sheet mode. If it is ascertained at the step S324 that the sheet 3 is the coated sheet, the control unit proceeds to a step S325.

At a step S325, the control unit checks whether a surface of the sheet 3 facing the recording head 14 in the recording area is the coated surface or the regular surface. If it is ascertained at the step S325 that the surface is the coated surface, the image-recording device 1 records an image on the coated surface in the special-sheet mode at a step S326, and proceeds to a step S328. If it is ascertained at the step S325 that the surface is the regular surface, the image-recording device 1 records the image on the regular surface in the regular-sheet mode at a step S327, and proceeds to the step S328.

At the step S328, the image-recording device 1 supplies the sheet 3 to the recording area so that the other surface faces the recording head 14. Subsequently, at a step S329, the control unit checks whether the other surface of the sheet 3 facing the recording head 14 in the recording area is the coated surface or the regular surface. If it is ascertained at the step S329 that the surface is the coated surface, the image-recording device 1 records an image on the coated surface in the special-sheet mode at a step S330, and ejects the sheet 3 to the document-ejecting tray 6 at a step S332. If it is ascertained at the step S329 that the surface is the regular surface, the image-recording device 1 records the image on the regular surface in the regular-sheet mode at a step S331, and ejects the sheet 3 to the document-ejecting tray 6 at the step S332.

According to the fourth example of the image-recording process, when the recording-side mode is set to the two-sided recording mode, and the recording-sheet mode is set to the special-sheet mode, the image-recording device 1 can record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by detecting the coated surface and recording the image on the coated surface in the special-sheet mode, and by detecting the regular surface and recording the image on the regular surface in the regular-sheet mode. Additionally, the image-recording device 1 does not need to select a sheet type that is a one-side coated sheet, a both-sides coated sheet or a regular sheet.

Figure 76:
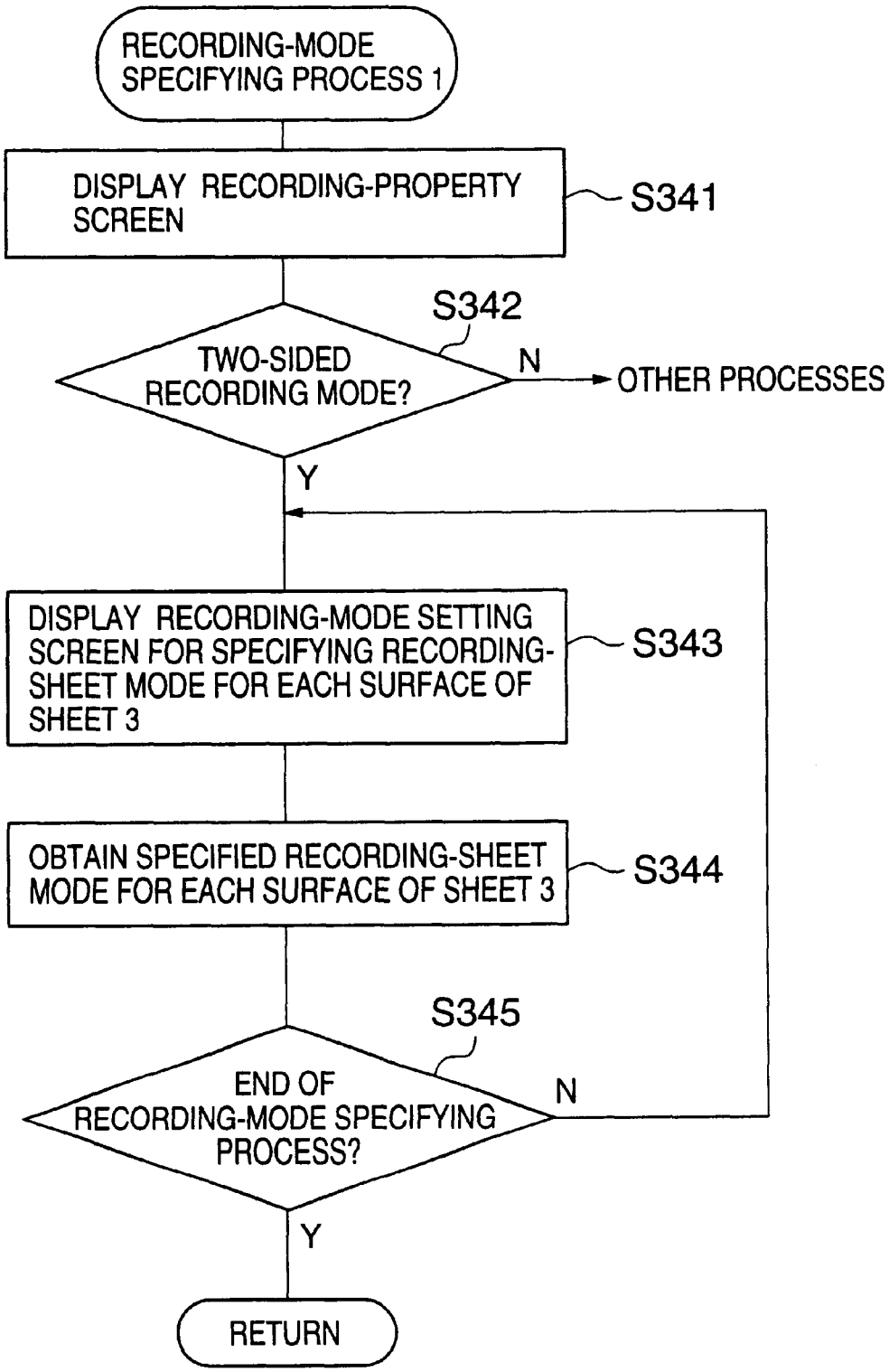
FIG. 76 is a flowchart for describing a first example of a recording-mode specifying process according to an eighth embodiment of the present invention.

A description will now be given of a sixth embodiment of the printer driver according to the present invention with reference to FIG. 76. The printer driver 101 is stored in the host device 100 that supplies data to an image-recording device through a printer cable and a communication line including a public switched telephone network (PSTN), an exclusive line or a local area network (LAN), or in a storage unit of a compound device that includes a copier machine, a facsimile, or a printer. The printer driver 101 is installed in the host device 100 or in the compound device through a record medium or a communication network.

The printer driver 101 includes a program that executes a recording-mode specifying process according to an eighth embodiment of the present invention, and the program can be installed in the image-recording device 1. The printer driver 101 initially displays a recording-property screen on a monitor of the compound device or on the control panel 8 of the image-recording device 1 at a step S341. At a step S342, the printer driver 101 checks whether the recording-side mode is set to the one-side recording mode or the two-sided recording mode. If it is ascertained at the step S342 that the recording-side mode is set to the two-sided recording mode, the printer driver 101 displays a recording-mode setting screen on the monitor at a step S343. At the step S343, the recording-sheet mode that is either the special-sheet mode or the regular-sheet mode is selected for each surface of the sheet 3 or for each surfaces of the sheet 3. If it is ascertained at the step S342 that the recording-side mode is set to the one-side recording mode, the printer driver 101 executes other processes. At a step S344, the printer driver 101 obtains information about the selected recording-sheet mode. At a step S345, the printer driver 101 checks whether the recording mode is specified. If not, the printer driver 101 goes back to the step S343. If the recording mode is specified, the printer driver 101 terminates the recording-mode specifying process.

According to the sixth embodiment of the printer driver, the printer driver can make the image-recording device 1 to record an image on a surface of the sheet 3 in a recording-sheet mode that is appropriate to characteristics of the surface so as to record the image without slowing down its recording speed and having blurriness of the image, the image density drop, blurriness of the image seen from the other surface, permeation of ink to the other surface and color displacement, by setting a recording-sheet mode for each surface of the sheet 3.

Figure 77:
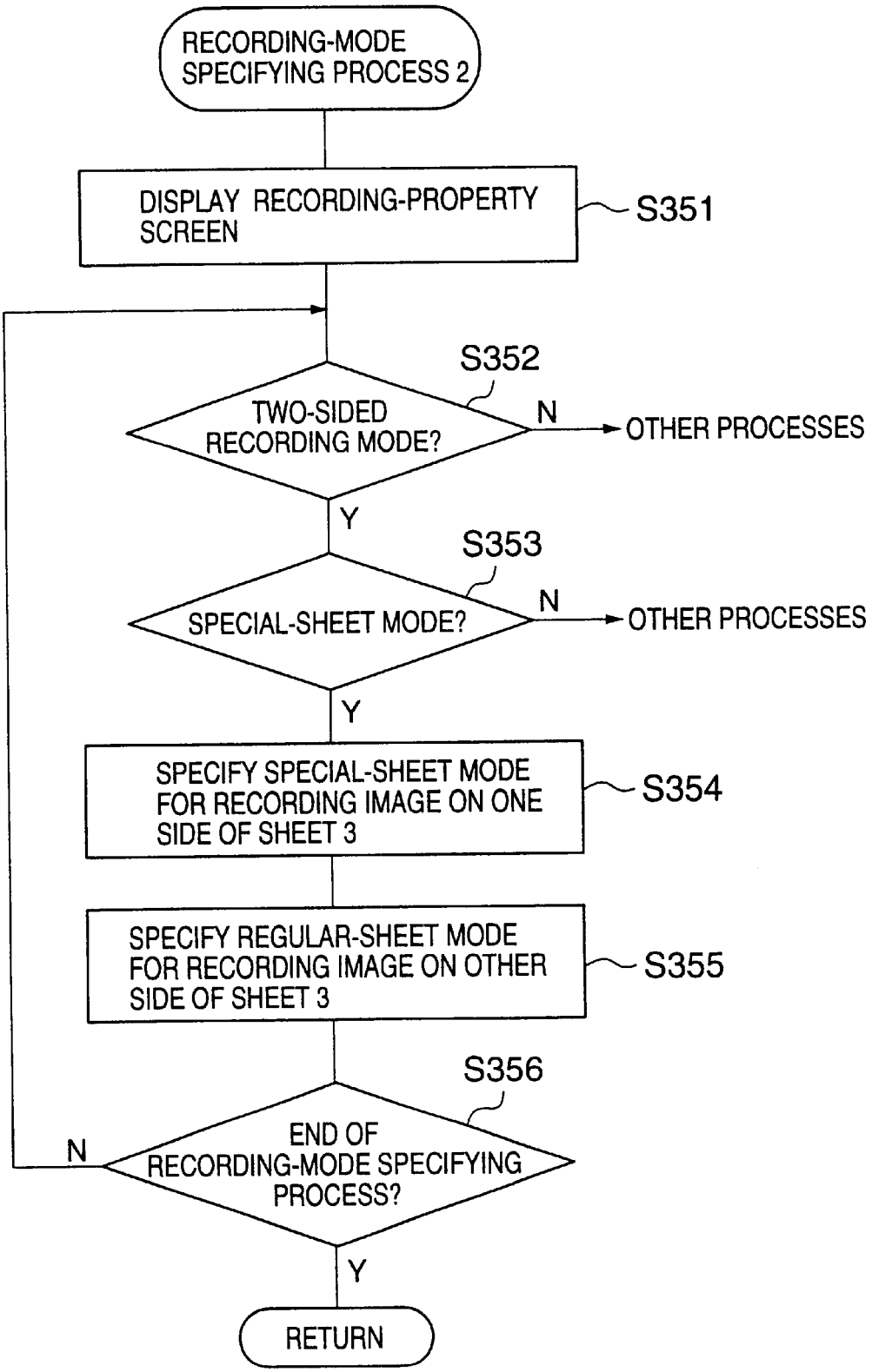
FIG. 77 is a flowchart for describing a second example of the recording-mode specifying process according to the eighth embodiment of the present invention.

A description will now be given of a seventh embodiment of the printer driver according to the present invention with reference to FIG. 77. The printer driver 101 includes a program that executes a recording-mode specifying process, and the program can be installed in the image-recording device 1. The printer driver 101 initially displays a recording-property screen on a monitor of the compound device or on the control panel 8 of the image-recording device 1 at a step S351. At a step S352, the printer driver 101 checks whether the recording-side mode is set to the one-side recording mode or the two-sided recording mode. If it is ascertained at the step S352 that the recording-side mode is set to the two-sided recording mode, the printer driver proceeds to a step S353. If it is ascertained at the step S352 that the recording-side mode is set to the one-side recording mode, the printer driver 101 executes other processes.

At the step S353, the printer driver 101 checks whether the recording-sheet mode for the sheet 3 is set to the special-sheet mode or the regular-sheet mode. If it is ascertained at the step S353 that the recording-sheet mode for the sheet 3 is set to the regular-sheet mode, the printer driver 101 executes other processes. If it is ascertained at the step S353 that the recording-sheet mode for the sheet 3 is set to the special-sheet mode, the printer driver 101 specifies the image-recording device 1 to record one side of the sheet 3 in the special-sheet mode at a step S354 and the other side of the sheet 3 in the regular-sheet mode at a step S355. At a step S356, the printer driver 101 checks whether the recording mode is specified. If not, the printer driver 101 goes back to the step S352. If the recording mode is specified, the printer driver 101 terminates the recording-mode specifying process.

According to the seventh embodiment of the printer driver, the printer driver specifies the image-recording device 1 to record an image on one side of the sheet 3 in the special-sheet mode and an image on the other side of the sheet 3 in the regular-sheet mode when the two-sided recording mode and the special-sheet mode are selected, and a controllability of the image-recording device 1 increases by omitting a process to specify a recording-sheet mode for each surface of the sheet 3.

Figure 78:
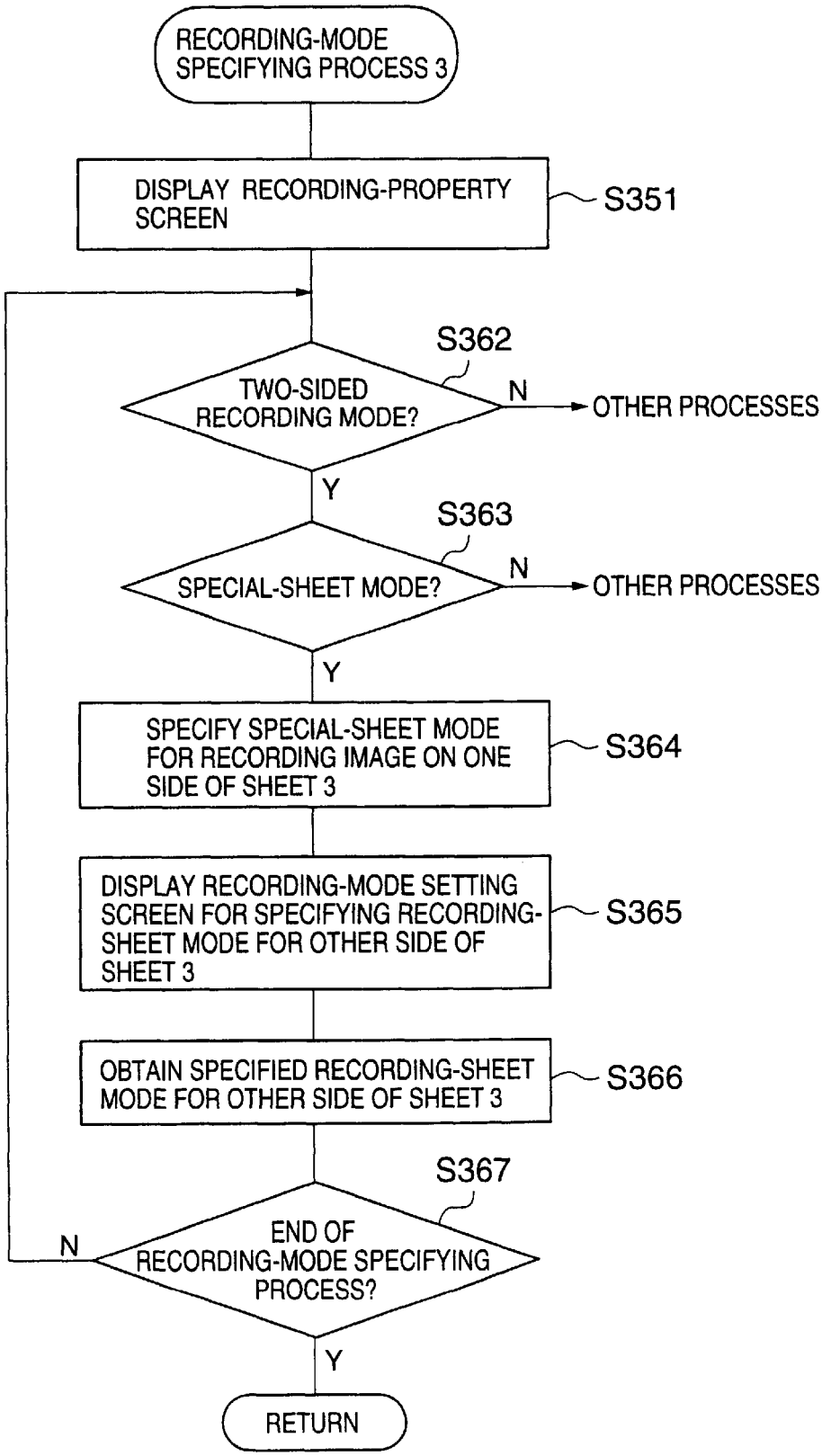
FIG. 78 is a flowchart for describing a third example of the recording-mode specifying process according to the eighth embodiment of the present invention.

A description will now be given of an eighth embodiment of the printer driver according to the present invention with reference to FIG. 78. The printer driver 101 includes a program that executes a recording-mode specifying process, and the program can be installed in the image-recording device 1. The printer driver 101 initially displays a recording-property screen on a monitor of the compound device or on the control panel 8 of the image-recording device 1 at a step S361. At a step S362, the printer driver 101 checks whether the recording-side mode is set to the one-side recording mode or the two-sided recording mode. If it is ascertained at the step S362 that the recording-side mode is set to the two-sided recording mode, the printer driver proceeds to a step S363. If it is ascertained at the step S362 that the recording-side mode is set to the one-side recording mode, the printer driver 101 executes other processes. At the step S363, the printer driver 101 checks whether the recording-sheet mode for the sheet 3 is set to the special-sheet mode or the regular-sheet mode. If it is ascertained at the step S363 that the recording-sheet mode for the sheet 3 is set to the regular-sheet mode, the printer driver 101 executes other processes. If it is ascertained at the step S363 that the recording-sheet mode for the sheet 3 is set to the special-sheet mode, the printer driver 101 specifies the image-recording device 1 to record one side of the sheet 3 in the special-sheet mode at a step S364, and proceeds to a step S365.

At the step S365, the printer driver 101 displays a recording-mode setting screen on the monitor, and the recording-sheet mode that is either the special-sheet mode or the regular-sheet mode is selected for the other side of the sheet 3. At a step S344, the printer driver 101 obtains information about the selected recording-sheet mode for the other side of the sheet 3. At a step S367, the printer driver 101 checks whether the recording mode is specified. If not, the printer driver 101 goes back to the step S362. If the recording mode is specified, the printer driver 101 terminates the recording-mode specifying process.

According to the eighth embodiment of the printer driver, the printer driver specifies the image-recording device 1 to record an image on one side of the sheet 3 in the special-sheet mode and an image on the other side of the sheet 3 in a recording-sheet mode that can be selected between the special-sheet mode and the regular-sheet mode when the two-sided recording mode and the special-sheet mode are selected so that a recording-sheet mode appropriate to each surface of a one-side coated sheet or a both-sides coated sheet can be selected Additionally, the image-recording device 1 may include one of the above-described programs that execute the recording-mode specifying processes with a plurality of the programs that execute the path-number setting processes, the nozzle-number setting processes, the drive-frequency setting processes, the dot-number setting processes and the dot-frequency setting processes. Accordingly, the image-recording device can easily specify and notify which process to execute to the printer driver so as to record an image on the sheet 3 with the recording speed and the recording quality that are requested by a user.

Additionally, the above-described programs may be stored in a readable record medium. The programs stored in the readable record medium are read therefrom and are installed in the host device 100 so that the image-recording device 1 can record an image on a surface of the sheet 3 in a recording mode that is appropriate to characteristics of the surface.

The above description is provided in order to enable any person skilled in the art to make and use the invention and sets forth the best mode contemplated by the inventors of carrying out the invention.

The present invention is not limited to the specifically disclosed embodiments and variations, and modifications may be made without departing from the scope and spirit of the invention.

The present application is based on Japanese Priority Application No. 11-253742, filed on Sep. 8, 1999, Japanese Priority Application No. 2000-073338, filed on Mar. 16, 2000, and Japanese Priority Application No. 2000-221617, filed on Jul. 24, 2000 with the Japanese Patent Office, the entire contents of which are hereby incorporated by reference.

What is claimed is:

1. An image-recording device comprising:

a control unit setting a recording-side mode to one of a one-side recording mode and a two-sided recording mode, and setting a recording parameter related to a recording speed and quality of an image recorded on a sheet for each surface of the sheet, wherein said control unit sets a first numerical value to the recording parameter when the recording-side mode is set to the one-side recording mode, and sets a second numerical value to the recording parameter when the recording-side mode is set to the two-sided recording mode; and a recording head that records the image on the sheet in the recording-side mode set by the control unit.

2. The image-recording device as claimed in claim 1, wherein the recording parameter includes a path number that is a number of paths, which said recording head takes to record the image on a surface of the sheet.

3. The image-recording device as claimed in claim 2, wherein said control unit sets a recording-priority mode to either a recording-speed priority mode wherein a recording speed of said image-recording device has priority over quality of the image recorded on the surface of the sheet, or a recording-quality priority mode wherein the quality of the image recorded on the surface of the sheet has priority over the recording speed of said image-recording device, and sets the path number in the two-sided recording mode larger than or equal to the path number in the one-side recording mode when the recording-priority mode is set to the recording-speed priority mode, and the path number in the two-sided recording mode larger than the path number in the one-side recording mode when the recording-priority mode is set to the recording-quality priority mode.

4. The image-recording device as claimed in claim 3, wherein said control unit sets the path number in the both-side recording mode and the path number in the one-side recording mode when the recording-priority mode is set to the recording-quality priority mode respectively larger than the path number in the two-sided recording mode and the path number in the one-side recording mode when the recording-priority mode is set to the recording-speed priority mode.

5. The image-recording device as claimed in claim 1, wherein said recording head includes a plurality of nozzles where ink is discharged therefrom to the sheet for recording the image, and said recording parameter includes a nozzle number that is a number of nozzles, which said recording head uses to record the image on a surface of the sheet.

6. The image-recording device as claimed in claim 5, wherein said control unit sets a recording-priority mode to either a recording-speed priority mode wherein a recording speed of said image-recording device has priority over quality of the image recorded on the surface of the sheet, or a recording-quality priority mode wherein the quality of the image recorded on the surface of the sheet has priority over the recording speed of said image-recording device, and sets the nozzle number in the two-sided recording mode smaller than or equal to the nozzle number in the one-side recording mode when the recording-priority mode is set to the recording-speed priority mode, and the nozzle number in the two-sided recording mode smaller than the nozzle number in the one-side recording mode when the recording-priority mode is set to the recording-quality priority mode.

7. The image-recording device as claimed in claim 6, wherein said control unit sets the nozzle number in the both-side recording mode and the nozzle number in the one-side recording mode when the recording-priority mode is set to the recording-quality priority mode respectively smaller than the nozzle number in the two-sided recording mode and the nozzle number in the one-side recording mode when the recording-priority mode is set to the recording-speed priority mode.

8. The image-recording device as claimed in claim 1, said recording parameter includes drive frequency that is a frequency of said recording head at which said recording head records the image on a surface of the sheet.

9. The image-recording device as claimed in claim 8, wherein said control unit sets a recording-priority mode to either a recording-speed priority mode wherein a recording speed of said image-recording device has priority over quality of the image recorded on the surface of the sheet, or a recording-quality priority mode wherein the quality of the image recorded on the surface of the sheet has priority over the recording speed of said image-recording device, and sets the drive frequency in the two-sided recording mode lower than or equal to the drive frequency in the one-side recording mode when the recording-priority mode is set to the recording-speed priority mode, and the drive frequency in the two-sided recording mode lower than the drive frequency in the one-side recording mode when the recording-priority mode is set to the recording-quality priority mode.

10. The image-recording device as claimed in claim 9, wherein said control unit sets the drive frequency in the both-side recording mode and the drive frequency in the one-side recording mode when the recording-priority mode is set to the recording-quality priority mode respectively lower than the drive frequency in the two-sided recording mode and the drive frequency in the one-side recording mode when the recording-priority mode is set to the recording-speed priority mode.

11. The image-recording device as claimed in claim 1, said recording parameter includes dot number that is a maximum number of dots, which said recording head records in an area unit of a surface of the sheet.

12. The image-recording device as claimed in claim 11, wherein said control unit sets a recording-priority mode to either a recording-speed priority mode wherein a recording speed of said image-recording device has priority over quality of the image recorded on the surface of the sheet, or a recording-quality priority mode wherein the quality of the image recorded on the surface of the sheet has priority over the recording speed of said image-recording device, and sets the dot number in the two-sided recording mode smaller than or equal to the dot number in the one-side recording mode when the recording-priority mode is set to the recording-speed priority mode, and the dot number in the two-sided recording mode smaller than the dot number in the one-side recording mode when the recording-priority mode is set to the recording-quality priority mode.

13. The image-recording device as claimed in claim 12, wherein said control unit sets the dot number in the both-side recording mode and the dot number in the one-side recording mode when the recording-priority mode is set to the recording-quality priority mode respectively smaller than the dot number in the two-sided recording mode and the dot number in the one-side recording mode when the recording-priority mode is set to the recording-speed priority mode.

14. The image-recording device as claimed in claim 1, said recording parameter includes dot density that is density of dots, which said recording head records in an area unit of a surface of the sheet.

15. The image-recording device as claimed in claim 14, wherein said control unit sets a recording-priority mode to either a recording-speed priority mode wherein a recording speed of said image-recording device has priority over quality of the image recorded on the surface of the sheet, or a recording-quality priority mode wherein the quality of the image recorded on the surface of the sheet has priority over the recording speed of said image-recording device, and sets the dot density in the two-sided recording mode lower than or equal to the dot density in the one-side recording mode when the recording-priority mode is set to the recording-speed priority mode, and the dot density in the two-sided recording mode lower than the dot density in the one-side recording mode when the recording-priority mode is set to the recording-quality priority mode.

16. The image-recording device as claimed in claim 15, wherein said control unit sets the dot density in the both-side recording mode and the dot density in the one-side recording mode when the recording-priority mode is set to the recording-quality priority mode respectively lower than the dot density in the two-sided recording mode and the dot density in the one-side recording mode when the recording-priority mode is set to the recording-speed priority mode.

17. The image-recording device as claimed in claim 1, wherein said control unit sets a recording-priority mode to either a recording-speed priority mode wherein a recording speed of said image-recording device has priority over quality of the image recorded on a surface of the sheet, or a recording-quality priority mode wherein the quality of the image recorded on the surface of the sheet has priority over the recording speed of said image-recording device.

18. The image-recording device as claimed in claim 17, wherein said control unit sets the first numerical value for the one-side recording mode different from the second numerical value for the two-sided recording mode when the recording-priority mode for the first numerical value and the recording-priority mode for the second numerical value are set to a same recording-priority mode.

19. The image-recording device as claimed in claim 17, wherein said control unit sets the second numerical value for the two-sided recording mode different from the first numerical value for the one-side recording mode according to the recording-priority mode.

20. The image-recording device as claimed in claim 17, wherein said control unit sets the second numerical value for the two-sided recording mode equal to or different from the first numerical value for the one-side recording mode according to the recording-priority mode.

21. The image-recording device as claimed in claim 1, wherein said control unit sets the first numerical value for the one-side recording mode equal to a numerical value for recording the image on one surface after recording the image on the other surface of the sheet in the two-sided recording mode.

22. The image-recording device as claimed in claim 1, wherein said control unit sets a recording-sheet mode to either a special-sheet mode wherein said image-recording device records the image on a coated surface of the sheet, or a recording-sheet mode other than the special-sheet mode.

23. The image-recording device as claimed in claim 22, wherein said image-recording device records the image on one surface of the sheet in the special-sheet mode, and records the image on the other surface of the sheet in the recording-sheet mode other than the special-sheet mode.

24. The image-recording device as claimed in claim 22, wherein said image-recording device records the image on one surface of the sheet in the special-sheet mode, and records the image on the other surface of the sheet in a predetermined recording-sheet mode other than the special-sheet mode when the recording-side mode is set to the two-sided recording mode.

25. The image-recording device as claimed in claim 22, comprising a recording-mode specifying unit that specifies the recording-sheet mode other than the special-sheet mode.

26. The image-recording device as claimed in claim 25, wherein said image-recording device records the image on one surface of the sheet in the special-sheet mode, and records the image on the other surface of the sheet in the recording-sheet mode other than the special-sheet mode that is specified by said recording-mode specifying unit, when the recording-side mode is set to the two-sided recording mode.

27. The image-recording device as claimed in claim 22, comprising a recording-mode specifying unit selects the recording-sheet mode between the special-sheet mode and the recording-sheet mode other than the special-sheet mode.

28. The image-recording device as claimed in claim 22, wherein said recording-sheet mode other than the special-sheet mode includes a regular-sheet mode wherein said image-recording device records the image on a regular surface of the sheet.

29. The image-recording device as claimed in claim 22, comprising a sheet-type detection unit that detects a type of each surface of the sheet, wherein said control unit sets the recording-sheet mode according to the detected type of each surface, and the recording head records the image on each surface in the selected recording-sheet mode.

30. The image-recording device as claimed in claim 29, wherein said image-recording device detects a coated surface and a surface other than the coated surface of the sheet by use of said sheet-type detection unit, and records the image on the coated surface of the sheet, and the image on the surface of the sheet other than the coated surface, when the recording-sheet mode is set to the special-sheet mode, and the recording-side mode is set to the two-sided recording mode.

31. The image-recording device as claimed in claim 29, wherein said sheet-type detection unit detects the type of each surface of every sheet supplied to said image-recording device.

32. The image-recording device as claimed in claim 29, wherein said sheet-type detection unit detects the type of each surface of the sheet by detecting sheet density of each surface.

33. The image-recording device as claimed in claim 29, wherein said sheet-type detection unit detects the type of each surface of the sheet from sheet density of each surface of the sheet obtained by two sheet-density detection units included therein being situated so that the sheet is carried through between the sheet-density detection units, each of said sheet-density detection unit including a black reflector that is colored black and reflects light emitted thereto, a white reflector that is colored white and reflects the light emitted thereto, two light-emitting units that emit the light, and a light-intercepting unit that receives the light reflected by the black reflector or the white reflector.

34. The image-recording device as claimed in claim 29, wherein said sheet-type detection unit detects the type of each surface of the sheet by detecting color density of the surface.

35. The image-recording device as claimed in claim 29, wherein said image-recording device includes a memory unit that stores information about sheet density or color density of each surface of the sheet according to the type of the sheet.

36. The image-recording device as claimed in claim 1, wherein the recording head of said image-recording device includes an inkjet head that discharges ink therefrom onto a surface of the sheet.

37. A printer driver controlling an image-recording device that records an image on a surface or images on both surfaces of a sheet according to a recording-side mode by use of a recording head, wherein the image-recording device records the image on the surface when the recording-side mode is set to a one-side recording mode, and the images on both surfaces of the sheet when the recording-side mode is set to a two-sided recording mode, comprising a parameter-setting unit a recording parameter related to a recording speed and quality of the image recorded on the surface of the sheet to a first numerical value for the one-side recording mode, and a second numerical value for the two-sided recording mode.

38. The printer driver as claimed in claim 37, wherein said recording parameter includes a path number that is a number of paths, which the recording head of the image-recording device takes to record the image on the surface of the sheet, and said printer driver sets the path number in the two-sided recording mode different from the path number in the one-side recording mode.

39. The image-recording device as claimed in claim 37, wherein said recording parameter includes a nozzle number that is a number of nozzles, which the recording head of the image-recording device uses to record the image on the surface of the sheet, and said printer driver sets the nozzle number in the two-sided recording mode different from the nozzle number in the one-side recording mode.

40. The image-recording device as claimed in claim 37, said recording parameter includes drive frequency that is a frequency of the recording head of the image-recording device at which the recording head of the image-recording device records the image on the surface of the sheet, and said printer driver sets the drive frequency in the two-sided recording mode different from the drive frequency in the one-side recording mode.

41. The image-recording device as claimed in claim 37, said recording parameter includes dot number that is a maximum number of dots, which the recording head of the image-recording device records in an area unit of the surface of the sheet, and said printer driver sets the dot number in the two-sided recording mode different from the dot number in the one-side recording mode.

42. The image-recording device as claimed in claim 37, said recording parameter includes dot density that is density of dots, which the recording head of the image-recording device records in an area unit of the surface of the sheet, and said printer driver sets the dot density in the two-sided recording mode different from the dot density in the one-side recording mode.

43. The printer driver as claimed in claim 37, comprising a recording-mode specifying unit that specifies a recording-sheet mode for each surface of the sheet, said recording-sheet mode being set to a special-sheet mode wherein said image-recording device records the image on a coated surface of the sheet, or a recording-sheet mode other than the special-sheet mode.

44. The printer driver as claimed in claim 37, comprising a recording-mode specifying unit that specifies a recording-sheet mode for each surface of the sheet, said recording-sheet mode being set to a special-sheet mode wherein said image-recording device records the image on a coated surface of the sheet, or a recording-sheet mode other than the special-sheet mode, wherein said recording-mode specifying unit specifies the image-recording device to record the image on one surface of the sheet in the special-sheet mode, and specifies the image-recording device to record the image on the other surface of the sheet in the recording-sheet mode other than the special-sheet.

45. The printer driver as claimed in claim 44, wherein said recording-mode specifying unit specifies the image-recording device to record the image on one of the surfaces of the sheet in the special-sheet mode, and specifies the image-recording device to record the image on the other surface of the sheet in a regular-sheet mode.

46. A sheet-type detection device, comprising two sheet-density detection units, each of said sheet-density detection unit including a black reflector that is colored black and reflects light emitted thereto, a white reflector that is colored white and reflects the light emitted thereto, a light-emitting unit that emits the light, and a light-intercepting unit that receives the light reflected by the black reflector or the white reflector, wherein said sheet-type detection device detects a type of each surface of a sheet by detecting sheet density of each surface of the sheet obtained by said sheet-density detection units being situated so that the sheet is placed in space between the sheet-density detection units.

47. A record medium readable by a machine, tangibly embodying a program of instructions executable by the machine to perform method steps for controlling an image-recording device:

specifying a recording-side mode to one of a one-side recording mode and a two-sided recording mode;

specifying a recording-sheet mode to a special-sheet mode wherein the image-recording device records the image on a coated surface of the sheet and a recording-sheet mode other than the special-sheet mode; and specifying the image-recording device to record the image on the sheet in one of the special-sheet mode and the recording-sheet mode other than the special-sheet mode, if the recording-side mode is set to the two-sided recording mode.

48. The record medium as claimed in claim 47, wherein the program included in the record medium specifies a regular-sheet mode as the recording-sheet mode other than the special-sheet mode when specifying the recording-sheet mode for the image-recording device.

* * * * *